US009616274B2

(12) United States Patent
Wehrell

(10) Patent No.: US 9,616,274 B2
(45) **Date of Patent: *Apr. 11, 2017**

(54) SWING TRAINING APPARATUS AND METHOD

(75) Inventor: Michael A. Wehrell, Tampa, FL (US)

(73) Assignee: Michael A. Wehrell, Tampa, FL (US)

( * ) Notice: Subject to any disclaimer, the term of this patent is extended or adjusted under 35 U.S.C. 154(b) by 972 days.

This patent is subject to a terminal disclaimer.

(21) Appl. No.: 13/356,332

(22) Filed: Jan. 23, 2012

(65) Prior Publication Data

US 2013/0130866 A1 May 23, 2013

Related U.S. Application Data

(60) Continuation-in-part of application No. 12/694,102, filed on Jan. 26, 2010, which is a division of
(Continued)

(51) Int. Cl.
*A63B 21/00* (2006.01)
*A61H 1/02* (2006.01)
(Continued)

(52) U.S. Cl.
CPC ..... *A63B 21/1403* (2013.01); *A61H 1/0229* (2013.01); *A63B 21/00065* (2013.01);
(Continued)

(58) Field of Classification Search
CPC ..... A63B 21/0552; A63B 21/0442; A63B 21/1449; A63B 21/0057; A63B 21/1419;
(Continued)

(56) References Cited

U.S. PATENT DOCUMENTS 775,989 A 11/1904 Roberts
2,893,736 A 7/1959 Tesi
(Continued)

FOREIGN PATENT DOCUMENTS

EP 0936044 A1 8/1999
JP 3-139373 U 2/2008
(Continued)

OTHER PUBLICATIONS

Japanese Patent Office, Notification of Reasons for Refusal dated Jun. 8, 2011 Application No. JP2008-529002, 3pgs.
(Continued)

*Primary Examiner* — Andrew S Lo
(74) *Attorney, Agent, or Firm* — Duane Morris LLP

(57) ABSTRACT

A resistance training apparatus and method for providing a plurality of training vectors having points of origin variable by direction and elevation to a trainee. The apparatus may accommodate a plurality of trainees and provide multiple training vectors to each trainee. In one embodiment the apparatus includes a base forming the training area and a pair of tower assemblies, each providing members for attachment to the harnesses worn by the athlete. In another embodiment the apparatus provides at least sixteen training vectors to a trainee. Each of the members providing the training vectors are independently adjustable such that balanced or unbalanced loading may be applied simultaneously to a trainee from multiple directions and multiple planes.

10 Claims, 75 Drawing Sheets

Related U.S. Application Data application No. 11/364,181, filed on Mar. 1, 2006, now Pat. No. 7,651,450.

(60) Provisional application No. 60/752,872, filed on Dec. 23, 2005, provisional application No. 60/656,920, filed on Mar. 1, 2005, provisional application No. 60/656,887, filed on Mar. 1, 2005, provisional application No. 61/435,177, filed on Jan. 21, 2011.

(51) Int. Cl.

| | |
|---|---|
| ***A63B 21/055*** | (2006.01) |
| ***A63B 69/00*** | (2006.01) |
| ***A63B 23/02*** | (2006.01) |
| ***A63B 23/035*** | (2006.01) |
| ***A63B 69/36*** | (2006.01) |
| *A63B 21/04* | (2006.01) |
| *A63B 23/04* | (2006.01) |
| *A63B 23/00* | (2006.01) |
| *A63B 69/38* | (2006.01) |
| *A63B 15/00* | (2006.01) |

(52) U.S. Cl.

CPC ..... *A63B 21/0552* (2013.01); *A63B 21/154* (2013.01); *A63B 21/4007* (2015.10); *A63B 21/4009* (2015.10); *A63B 21/4011* (2015.10); *A63B 21/4019* (2015.10); *A63B 23/0211* (2013.01); *A63B 23/03508* (2013.01); *A63B 23/03541* (2013.01); *A63B 69/0057* (2013.01); *A63B 69/0059* (2013.01); *A63B 69/0079* (2013.01); *A63B 69/3623* (2013.01); *A63B 15/00* (2013.01); *A63B 21/00069* (2013.01); *A63B 21/04* (2013.01); *A63B 21/0442* (2013.01); *A63B 21/0557* (2013.01); *A63B 21/4017* (2015.10); *A63B 21/4047* (2015.10); *A63B 23/0458* (2013.01); *A63B 69/38* (2013.01); *A63B 2023/003* (2013.01); *A63B 2069/0008* (2013.01); *A63B 2208/0204* (2013.01); *A63B 2208/029* (2013.01); *A63B 2225/09* (2013.01); *A63B 2225/093* (2013.01)

(58) Field of Classification Search

CPC ..... A63B 21/1434; A63B 21/1423; A63B 21/1415; A63B 21/02; A63B 21/154

USPC ..... 473/216; 482/124

See application file for complete search history.

(56) References Cited

U.S. PATENT DOCUMENTS

| | | | | |
|---|---|---|---|---|
| 4,551,108 | A | 11/1985 | Bass | |
| 4,593,909 | A | 6/1986 | Anselmo et al. | |
| 4,659,084 | A | 4/1987 | Vuick | |
| 4,863,163 | A | 9/1989 | Wehrell | |
| 4,968,028 | A | 11/1990 | Wehrell | |
| 5,048,836 | A | 9/1991 | Bellagamba | |
| 5,050,871 | A | 9/1991 | Douglas et al. | |
| 5,242,339 | A | 9/1993 | Thornton | |
| 5,451,194 | A | 9/1995 | Harrigan | |
| 5,512,029 | A | 4/1996 | Barnard et al. | |
| 5,540,642 | A | 7/1996 | Sprague | |
| 5,597,376 | A | 1/1997 | Bode et al. | |
| 5,653,665 | A | 8/1997 | Neeley | |
| 5,803,822 | A | 9/1998 | Pursell | |
| 5,924,933 | A | 7/1999 | Pacheco | |
| 5,941,807 | A | 8/1999 | Cassidy et al. | |
| 6,120,418 | A | 9/2000 | Plough | |
| 6,220,994 | B1 | 4/2001 | Rich | |
| 6,554,747 | B1 * | 4/2003 | Rempe | 482/38 |
| 6,612,845 | B1 | 9/2003 | Macri et al. | |
| 6,634,998 | B2 | 10/2003 | Siaperas | |
| 6,966,870 | B2 | 11/2005 | Lan | |
| 7,625,320 | B2 * | 12/2009 | Wehrell | 482/92 |
| 7,887,471 | B2 * | 2/2011 | McSorley | 482/138 |
| 7,935,026 | B2 * | 5/2011 | McSorley | 482/48 |
| 8,512,171 | B1 * | 8/2013 | Minotti | 473/451 |
| 8,568,253 | B2 * | 10/2013 | Shoaff | 473/409 |
| 2003/0096681 | A1 | 5/2003 | Myers et al. | |
| 2005/0032613 | A1 | 2/2005 | Wehrell | |
| 2005/0043156 | A1 | 2/2005 | Wehrell | |
| 2006/0199706 | A1 | 9/2006 | Wehrell | |
| 2006/0229175 | A1 * | 10/2006 | Frappier | 482/124 |
| 2009/0305827 | A1 * | 12/2009 | Webb et al. | 473/458 |
| 2010/0130338 | A1 * | 5/2010 | Wehrell | 482/124 |
| 2010/0160059 | A1 * | 6/2010 | Burgess | 473/207 |
| 2011/0111890 | A1 * | 5/2011 | Webb et al. | 473/458 |
| 2012/0010057 | A1 * | 1/2012 | Doyle | 482/124 |

FOREIGN PATENT DOCUMENTS

| | | | |
|---|---|---|---|
| WO | 01/19462 | A1 | 3/2001 |
| WO | 2005/009544 | A2 | 2/2005 |

OTHER PUBLICATIONS

International Searching Authority, International Search Report PCT/US2012/022230 mailed May 7, 2012, 1 page.

* cited by examiner

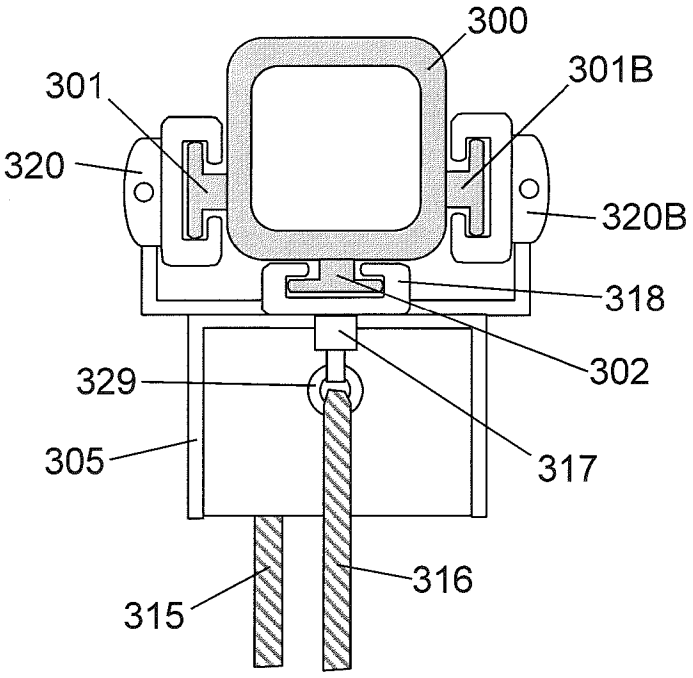
FIGURE 38 (View A)
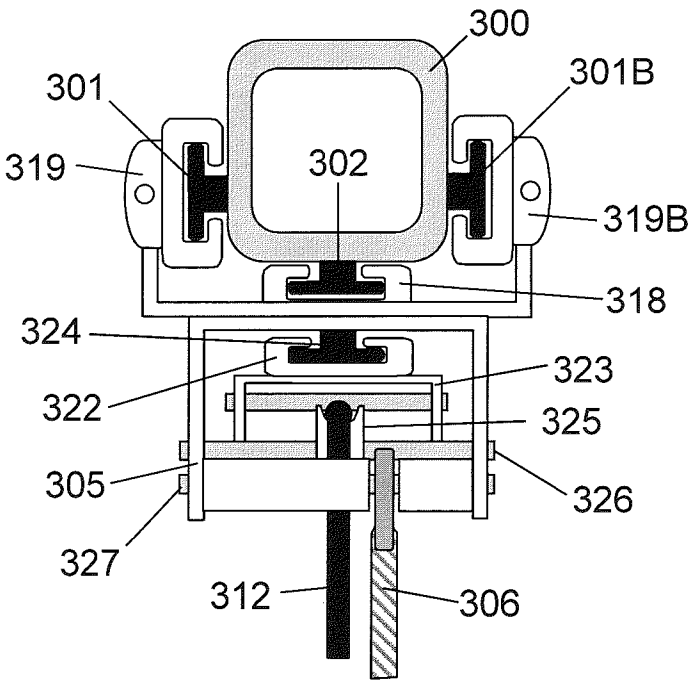
FIGURE 37 (View B)

SWING TRAINING APPARATUS AND METHOD

CLAIM OF PRIORITY

This application is a continuation in part application of U.S. application Ser. No. 12/694,102, filed Jan. 26, 2010, which is a division of U.S. application Ser. No. 11/364,181, filed on Mar. 1, 2006, now U.S. Pat. No. 7,651,450 which claims the priority of U.S. Provisional Patent Application No. 60/752,872 filed Dec. 23, 2005, by the inventor hereof, the entirety of which is incorporated by reference herein; U.S. Provisional Patent Application No. 60/656,920 filed Mar. 1, 2005, by the inventor hereof, the entirety of which is incorporated by reference herein; and U.S. Provisional Patent Application No. 60/656,887 filed Mar. 1, 2005, by the inventor hereof, the entirety of which is incorporated by reference herein. This application also claims the priority of U.S. Provisional Patent Application No. 61/435,177 filed Jan. 21, 2011, by the inventor hereof, the entirety of which is incorporated by reference herein.

RELATED APPLICATIONS

This application is related to co-pending U.S. patent application Ser. No. 10/892,568 entitled "Physical Training Apparatus And Method" filed Jul. 16, 2004, now U.S. Pat. No. 7,494,453 by the inventor hereof, the contents of which is incorporated by reference herein; and U.S. patent application Ser. No. 10/892,196, entitled "Swing Training Apparatus And Method" filed Jul. 16, 2004, now U.S. Pat. No. 7,625,320, by the inventor hereof, the contents of which is incorporated by reference herein.

BACKGROUND

The present invention relates to a physical training apparatus and method for training persons such as athletes or physical therapy patients to improve various motor skills. The present invention further relates to a physical training apparatus and method for training specialized athletes such as golfers and baseball players who rely on generating power by rotation of the hips and torso. More particularly, it relates to a physical training apparatus and method for providing forces of either constant or varying magnitude opposing the motion of a single or multiple points on the body of a trainee while performing slow or high speed movements.

Physical training and conditioning have long been recognized as desirable for improving various motor skills to thereby improve the performance of an athlete, the rehabilitation of a physical therapy patient, or the overall physical well-being of the trainee. Training with resistance while performing specific movements with the body has been found to be very effective in improving various physical abilities such as functional strength, running speed, first-step quickness, jumping ability, and kicking ability. Such resistance training is increasingly becoming favored over training with heavy weights using slow non-sports specific motions.

For example, if an athlete wants to run faster it has been found to be more beneficial to apply light resistance to the leg muscles while running than by performing a press with the legs with heavy weights. Both of these training methods will strengthen the leg muscles of the athlete, however, the high-speed training by providing light resistance while running allows the athlete to generate more power at high speeds since the muscle is conditioned with resistance at high speeds. Training the muscles using slow movement with resistance promotes power generation at slow speeds since the muscle is conditioned at slow speeds. Both training methods are important to most athletes. However, for athletic performance optimization at high speeds the muscles must be physically and neurologically trained at high speeds. The term "training vector" as used herein shall mean a force opposing the motion of a portion of a trainee through a predetermined range of motion. The magnitude and direction of a training vector may be relatively constant or may vary through the predetermined range of motion.

U.S. Pat. Nos. 4,968,028 and 4,863,163 entitled "Vertical Jump Exercise Apparatus" issued to the inventor of the present disclosure each disclose resistance training apparatus for vertical jump training and conditioning. The prior art system disclosed in the Wehrell patents applies two training vectors having relatively constant magnitude to the hips of the trainee for applying resistance to the legs while performing a jumping motion.

A later modification of the exercise apparatus disclosed in the Wehrell patents provided relatively constant resistance to the back of the knees of a trainee performing a running motion by attaching the elastic members of the exercise apparatus to detachable leg harnesses worn by the trainee. This embodiment provided resistance for training the hip flexors of the trainee at high speeds.

Similarly, if an athlete wants to generate more power by rotation of the hips and torso, it will be beneficial to apply light resistance to the rotation of the hips and torso as the athlete performs a specific athletic movement such as swinging a golf club or a baseball/softball bat. Such rotational training of the hips and torso may be beneficial to other athletes such as soccer players, place kickers, track and field athletes, tennis players, and athletes of other racket sports.

Many sports related movements involve multiple muscle groups moving multiple body parts simultaneously to perform the specific movement. For example, when an athlete jumps he or she uses the legs, back and arms simultaneously. To optimize training for a particular movement it is beneficial to train using a natural jumping motion while applying resistance to the legs, back, arms and other body portions simultaneously. Such an exercise method would be more effective than methods where resistance is only applied to the legs because it allows major muscle groups used in jumping to be fired in the proper neurological sequence with applied resistance.

While it is possible in the prior art exercise apparatus described in the Wehrell patents to apply training vectors to a trainee performing a running motion, there remains a need for a physical training apparatus that applies training vectors to the hands, legs, back and other points on the trainee's body for providing resistance to multiple muscle groups while performing complex sports specific movements.

Accordingly, it is an object of the present invention to obviate many of the deficiencies in the prior art and to provide a novel physical training apparatus and method.

It is an object of the present invention to provide a novel physical training apparatus comprising means for providing at least eight training vectors to a trainee.

It is also an object of the present invention to provide a novel physical training apparatus comprising a plurality of means for providing training vectors to a trainee wherein the origin of one or more training vectors is variable in a first and a second dimension and the origin of one or more of the other training vectors is variable in either said first or second dimension and a third dimension normal to said first and second dimensions.

It is another object of the present invention to provide a novel physical training apparatus comprising a plurality of means for providing training vectors to a trainee wherein the training vectors originate from at least three elevations.

It is a further object of the present invention to provide a novel physical training apparatus comprising one or more means for providing a training vector to a trainee and a means to support at least a portion of the trainee's body weight.

It is yet another object of the present invention to provide physical training apparatus comprising a base forming a training area, one or more harnesses each adapted to be worn by a trainee training in said training area, at least one elastic member attached to each harness for providing a force opposing the motion of the harness in a predetermined range of motion, said elastic members having a length whereby the force varies substantially linearly over said predetermined range. The apparatus further comprises an elongated tracking mechanism attached to said base for directing each of said elastic members out of said training area, at least one tracking mechanism being substantially horizontal and at least one tracking mechanism being substantially vertical.

It is another object of the present invention to provide a novel physical training apparatus comprising a base forming a training surface, a plurality of means for providing training vectors to a trainee training on said training surface, said means being attached to said base and comprising an elastic member and tracking members for directing said elastic member from a vector origin location near the training surface to an anchor location. The apparatus further comprises a plurality of means for providing training vectors to a trainee training on said training surface, said means being attached to said base and comprising an elastic member and tracking members for directing said elastic member from a vector origin location elevated from the training surface to an anchor location.

It is a further object of the present invention to provide a novel device with the ability to apply rotational torque to the upper torso or combination of waist and upper torso using resistance members attached to the shoulders, arms, chest, waist or other parts of the body.

One object of the present invention may provide a novel device that applies a balanced torque to the upper body of a user when standing in the erect position. The direction of the torque in such an embodiment may be set and applied in the clockwise or counter clockwise direction based on the attachment position of the resistance members.

Another object of the present invention may allow a user of certain embodiments described herein to bend over while torque is applied to the upper body (and waist if desired) without creating a force opposing or aiding the bending motion. This may be accomplished by the mechanical assemblies' ability to automatically track a user's upper torso (shoulder position movement) throughout the bending motion and automatically reposition the origin of the resistance elements so they follow the shoulder or torso movement.

An additional object of the present invention may provide a novel device that applies torque to the upper torso in a plane parallel to the ground and perpendicular to the spine at shoulder level when the user is standing in the erect position. When the user bends over the apparatus has the ability to automatically shift the plane of applied torque keeping it perpendicular to the spine at shoulder level at all times.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIGS. 37 and 38 are side views of the trolley assembly of FIG. 34.

DESCRIPTION OF PREFERRED EMBODIMENTS

With reference to the figures where like elements have been given like numerical designations to facilitate an understanding of the present invention, the various embodiments of the physical training apparatus of the present invention are described.

According to one aspect of the present invention, a physical training apparatus and method are disclosed for providing multiple training vectors to a trainee while performing various athletic or therapeutic movements such as jumping, running or walking. According to a further aspect of the present invention, a physical training apparatus and method are disclosed for providing training vectors having points of origin variable by direction and elevation to a trainee while performing various athletic or therapeutic movements such as jumping, running or walking or more complex athletic or therapeutic movements. According to another aspect of the present invention, a physical training apparatus and method are disclosed for providing training vectors having points of origin variable by direction and elevation to a plurality of trainees while each are performing athletic or therapeutic movements. According to yet another aspect of the present invention, a physical training apparatus and method are disclosed for providing training vectors and therapeutic exercises to patients or trainees who cannot fully support their own body weight. The physical training apparatus may provide up to sixteen or more training vectors so that multiple muscle groups of a trainee may be exercised simultaneously. It should be noted that the terms user, trainee and/or patient are used interchangeably throughout this disclosure. It should also be noted that the terms assembly and module used interchangeably throughout this disclosure. Such uses, however, should not limit the scope of the claims appended herewith.

Figure 1:
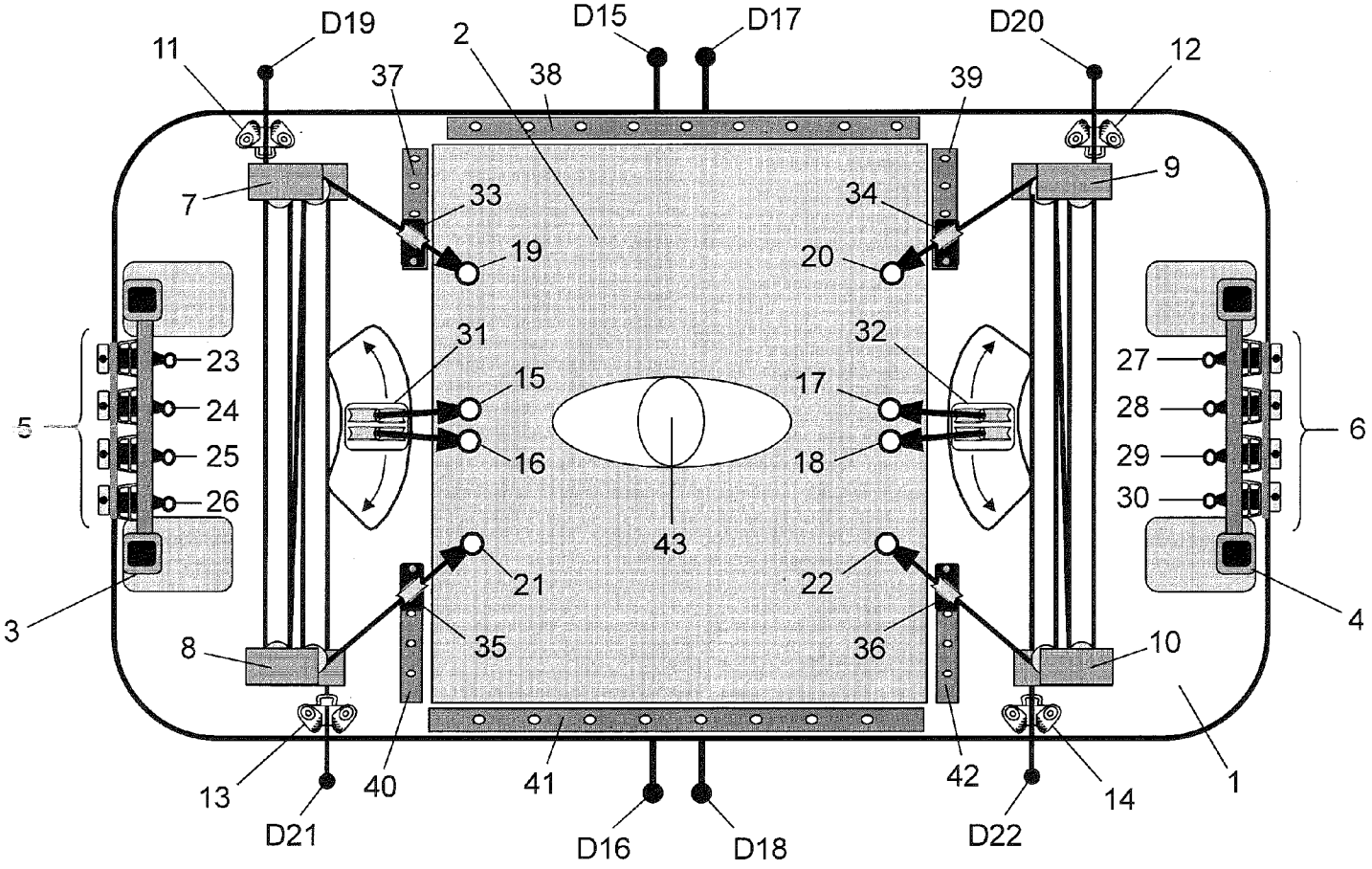
FIG. 1 is a top plan view of an embodiment of the present disclosure for providing a plurality of training vectors having points of origin variable by direction and elevation to a trainee.

FIG. 1 illustrates one embodiment of the physical training apparatus according to the present invention for providing a plurality of training vectors having points of origin variable by direction and elevation to a trainee. With reference to FIG. 1, the physical training apparatus comprises a platform or base 1 forming a training surface on which an athlete or trainee 43 may train. The base 1 may be provided with a centrally located matted exercise area 2 to provide the trainee 43 with cushioning during training exercises. At least two tower assemblies 3, 4 may be mounted along the periphery of the base 1. Both the base 1 and the tower assemblies 3, 4 provide a means for applying training vectors to multiple body portions of the trainee 43.

With reference to FIG. 1, at least four pulley housing structures 7-10 are mounted on the base 1. The pulley housing structures 7-10 route elastic members 19-22 to movable pulley assemblies 33-36. The elastic members 19-22 have a length whereby the magnitude of the training vector provided by each elastic member 19-22 is varies substantially linearly through the range of motion of the body portion of the trainee performing an exercise or training motion. The elastic members 19-22 are routed from a cam assembly 11-14 or other suitable anchor means, between a series of tracking mechanisms, such as pulleys, provided in the housing structures 7-10, to the movable pulley assemblies 33-36. Connectors (not shown) may be attached to the elastic members 19-22 whereby the connectors may be connected to harnesses (not shown) worn on body portions of the trainee. The cam assemblies 11-14 provide a cleating means to adjust the effective lengths of elastic members 19-22 for the purpose of altering the resistance provided by the elastic members 19-22. This may be accomplished by extracting or retracting the distal ends D19-D22 of the elastic members 19-22 through the cam assemblies 11-14. The pulley housing structures 7-10 thus provide a path for routing the elastic members 19-22 therebetween so that an elastic member many times the distance between housing structures mounted on the same side of the exercise area 2 may be utilized. It is also envisioned that a plurality of the training modules disclosed in co-pending U.S. patent application Ser. No. 10/892,568, the contents of which are incorporated by reference herein, may be used in place of the pulley housing structures 7-10.

The movable pulley assemblies 33-36 provide the points of origin for the training vectors provided by the elastic members 19-22. The pulley assemblies 33-36 may rotate 360 degrees and tilt+/−90 degrees in any direction so that the elastic members 19-22 track smoothly on the pulley assemblies 33-36 through the entire range of motion of the body portion of the trainee. The pulley assemblies 33-36 may be mounted on rails 37-42 affixed to the base 1 thereby allowing the pulley assemblies 33-36 to slide linearly to accommodate different exercises performed by a trainee, to accommodate trainees having different body dimensions, or to alter and or adjust the direction of the training vector origin supplied by the pulley assemblies 33-36. The rails 37-42 are slotted so that the pulley assemblies 33-36 may be positioned along the length of the rails 37-42. The pulley assemblies 33-36 may also be adaptable to lock in place on the rails 37-42 by any suitable locking means such as spring loaded locking mechanisms.

At least four elastic members 15-18 are routed from a cam assembly (not shown) or other suitable anchor means beneath the base 1 through pulleys provided in tracking assemblies 31, 32 which provide the point of origin for the training vectors provided by the elastic members 15-18. The elastic members 15-18 have a length whereby the magnitude of the training vector provided by each elastic member 15-18 varies substantially linearly through the range of motion of the body portion of the trainee performing an exercise or training motion. The cam assemblies (not shown) provide a cleating means to adjust the lengths of the elastic members 15-18 for the purposes of altering the resistance of the elastic members 15-18. This may be accomplished by extracting or retracting the distal ends D15-D18 of the elastic members 15-18 through the cam assemblies (not shown). The tracking assemblies 31, 32 may rotate about an axis perpendicular to the base 1 and outwardly lateral to the respective tracking assembly 31, 32 thereby allowing the elastic members 15-18 to track smoothly on the tracking assemblies 31, 32 through the entire range of motion of the body portion of the trainee. Thus, the training vectors provided by the elastic members 15-18 can rotate approximately 120 degrees about the respective tracking assembly pivot point or axis. Connectors (not shown) may be attached to the elastic members 15-18 whereby the connectors may be connected to harnesses (not shown) worn on body portions of the trainee.

With reference to FIG. 1, the tower assemblies 3, 4 house power module assemblies 5, 6 that route elastic members 23-26 and 27-30, respectively. The elastic members 23-30 have a length whereby the magnitude of the training vector provided by each elastic member 23-30 varies substantially linearly through the range of motion of the body portion of the trainee performing an exercise or training motion. The elastic members 23-30 are routed from a cam assembly (not shown) or other suitable anchor means, between a series of tracking mechanisms such as pulleys provided in the power module assemblies 5, 6 to hanging pulley assemblies (not shown) which provide the point of origin for the training vectors provided by the elastic members 23-30. The hanging pulley assemblies are rotatable and tiltable such that the elastic members 23-30 track smoothly on the pulley assemblies through the entire range of motion of the body portion of the trainee. Connectors (not shown) may be attached to the elastic members 23-30 whereby the connectors may be connected to harnesses (not shown) worn on body portions of the trainee. The cam assemblies (not shown) provide a cleating means to adjust lengths of elastic members 23-30 for the purposes of altering the resistance of the elastic members 23-30. The power module assemblies 5, 6 may lock at multiple positions in the respective tower assembly 3, 4 for the purposes of altering the plane of origin of the training vectors provided by the elastic members 23-30 relative to the base 1. Thus, every elastic member 15-30 may be directed to any point on the exercise area 2 to support resistance training for athletic or therapeutic exercises.

The elastic members 15-30 have distal ends that may be extracted through the respective cam assemblies so that the magnitude of the training vectors provided thereby may be selectively increased by shortening the effective length of the elastic members 15-30. Alternatively, the magnitude of the training vectors may be decreased by increasing the effective length of the elastic members 15-30 by releasing the cam assemblies and allowing the members to retract. The can assemblies may comprise any means suitable for securing the elastic members such as cleats, cam cleats or other suitable anchor means known in the industry. The "effective length" of the elastic members is the length of the elastic member between the anchor or cam assembly and the end of the member attached to a harness connector.

The range of variance of the magnitude of a training vector is limited by the diameter of the elastic member. For example, the elastic member 19 may have a diameter of ⅜ inches. The effective length of the elastic member 19 may be varied to thereby vary the force provided by the elastic member in the range between about twenty and about forty pounds. A smaller diameter elastic member (e.g., a diameter of about 5/16 inches), however, would provide a useful resistance force range from about four to about twenty pounds. Accordingly, a larger diameter elastic member (e.g., a diameter of about ½ inches) would provide a useful resistance force range from about thirty-five to about sixty pounds. Furthermore, by utilizing the training modules disclosed in co-pending U.S. patent application Ser. No. 10/892,568, the contents of which are incorporated by reference herein, and where practical in the present invention, the effective range of forces may be expanded without having to replace elastic members.

Figure 2:
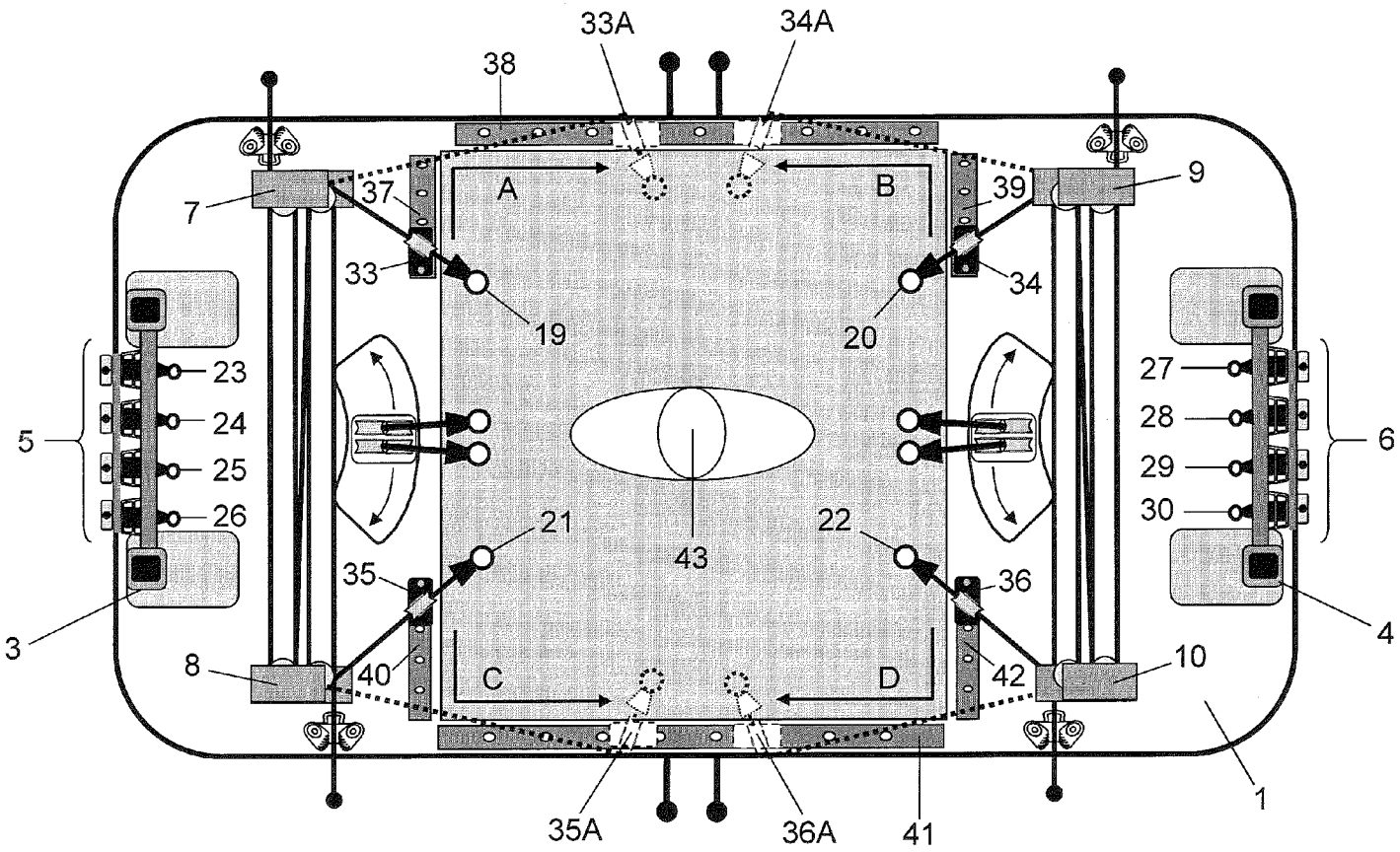
FIG. 2 is a top plan view of another embodiment of the present disclosure for providing a plurality of training vectors having points of origin variable by direction and elevation to a trainee.

FIG. 2 illustrates another embodiment of the physical training apparatus according to the present invention for providing a plurality of training vectors having points of origin variable by direction and elevation to a trainee. With reference to FIG. 2, the pulley assemblies 33-36 may be fixed on the upper surface of the base 1 allowing their position to be set anywhere along the rails 37-42 as illustrated by arrows A, B, C and D. Thus, the point of origin of the training vectors may be moved along the rails 37-42. For example, the pulley assembly 33 can be moved and locked into many positions along the rails 37, 38. As illustrated in FIG. 2, the pulley assembly 33 may be moved to a new position 33A on the rail 38. Thus, the elastic member 19 is routed from a cam assembly or other suitable anchor means, between a series of tracking mechanisms provided in the housing structures 7, 8 to the new position 33A on the rail 38 to thereby change the point of origin of the training vector provided by the elastic member 19. The difference between the locations of the pulley assembly 33 along the rails 37, 38 indicates a typical adjustment range for the pulley assembly 33. Note that the pulley assembly 33 can be attached to multiple positions along any rail 37-42. Likewise, the pulley assemblies 34-36 may be moved and locked into multiple positions along any of the rails 37-42 to thereby change the point of origin of the training vectors provided by the elastic members 20-22. The difference between the alternative locations 34A-36A of the pulley assemblies 34-36 indicate typical adjustment ranges for the pulley assemblies 34-36. Thus, the training vectors provided by the elastic members 19-22 may have a point of origin from all sides of a trainee for applying resistance to selected body portions according to a selected exercise.

Figure 3:
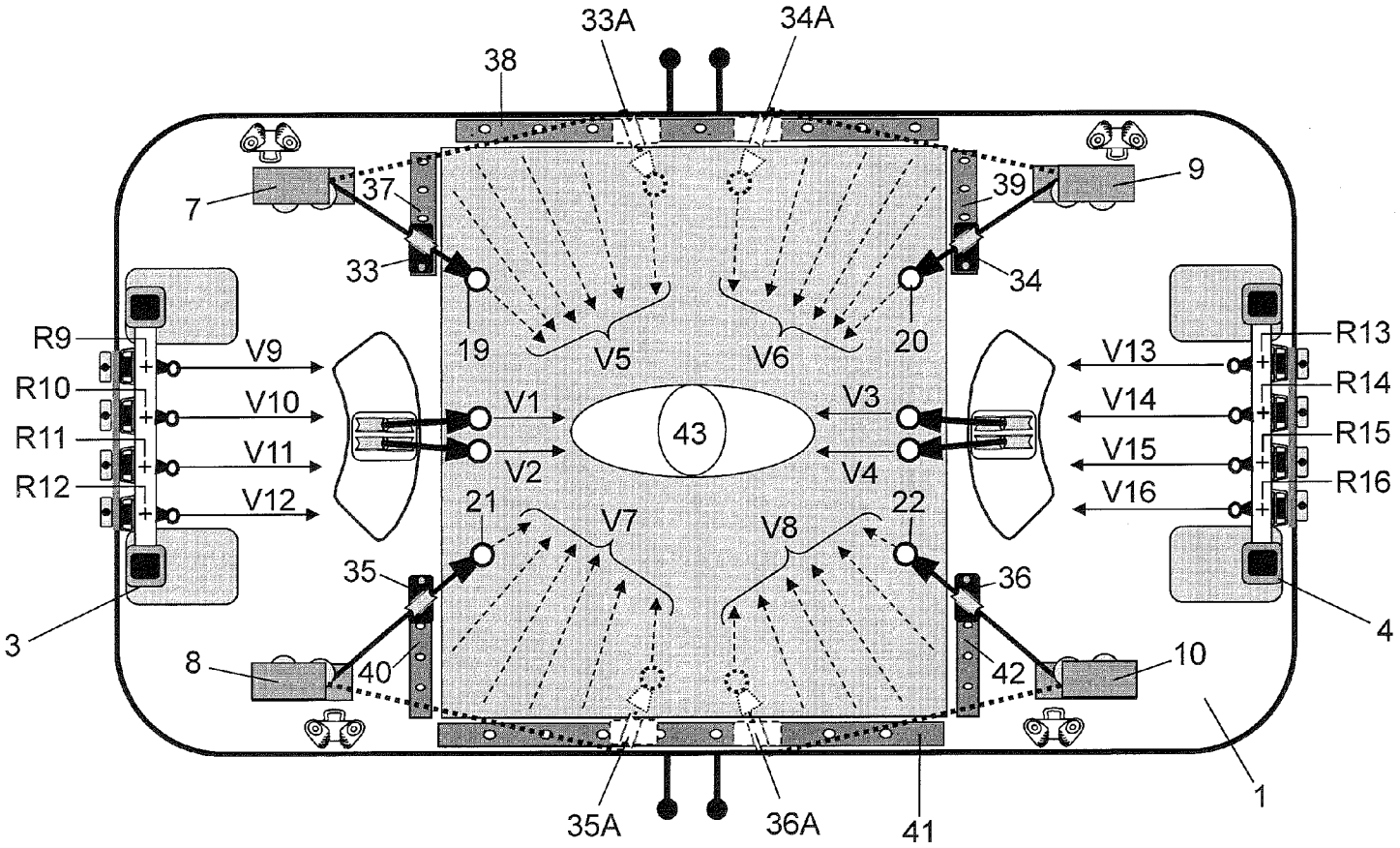
FIG. 3 is a top plan view of a further embodiment of the present disclosure for providing a plurality of training vectors having points of origin variable by direction and elevation to a trainee.

FIG. 3 is a top plan view of yet another embodiment of the present disclosure for providing a plurality of training vectors having points of origin variable by direction and elevation to a trainee. With reference to FIG. 3, the multiple training vectors may be attached to a trainee positioned anywhere on the exercise area 2. For example, training vector grouping V5 illustrates the many points of origin of the training vector provided by the elastic member 19 depending upon the location of the pulley assembly 33 along the rails 37, 38. Furthermore, the training vector groupings V6, V7 and V8 illustrate the multiple points of origin of the training vectors provided by the elastic members 20-22 as the pulley assemblies 34-36 are moved to various exemplary positions along the rails 38-42. Since the pulley assemblies 33-36 may be attached to multiple positions along any rail 37-42, the alternate pulley positions 33A-36A and training vector groupings V5-V8 illustrated in FIG. 3 are illustrative only and are not intended to limit the scope of the invention. As illustrated in FIG. 3, the training vectors V1-V4 provided by elastic members 15-18 may rotate approximately 120 degrees about the tracking assembly pivot points to thereby alter the points of origin of the training vectors V1-V4 provided by the elastic members 15-18. The training vectors V9-V16 provided by the elastic members 23-30 may also rotate 360 degrees about corresponding pivot points R9-R16, respectively, to thereby alter the points of origin of the training vectors V9-V16 provided by the elastic members 23-30.

Figure 5:
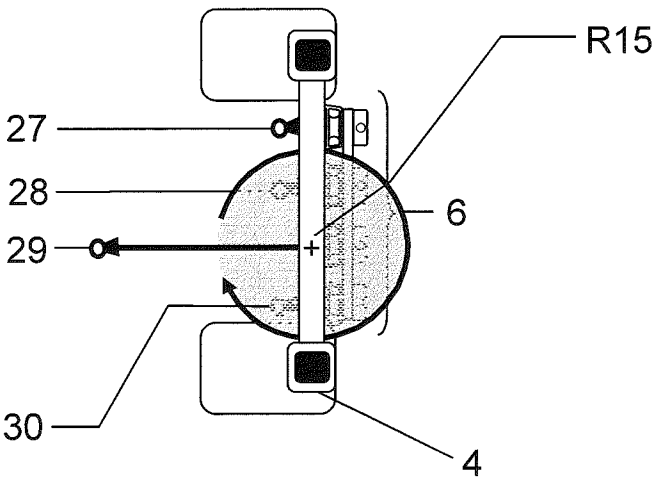
FIGS. 4 and 5 are illustrations of the power module assembly depicting pivoting points of the hanging pulley assemblies of the present disclosure.
Figure 4:
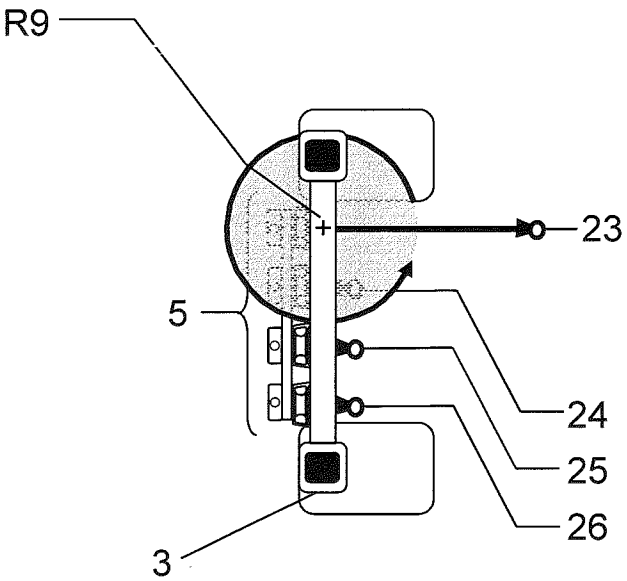

FIGS. 4 and 5 illustrate how the hanging pulley assemblies in the power module assemblies 5, 6 pivot to thereby alter the points of origin of the training vectors. With reference to FIG. 4, the elastic member 23 is adaptable to rotate 360 degrees about its axis R9. At any point during the 360 degree rotation, the elastic member 23 may be extracted and utilized by a trainee for training or exercise purposes. While not illustrated, each of the remaining elastic members 24-26 in the power module assembly 5 possess the same rotational ability depicted for the elastic member 23. With reference to FIG. 5, the elastic member 29 is adaptable to rotate 360 degrees about its axis R15. At any point during the 360 degree rotation, the elastic member 29 may be extracted and utilized by a trainee for training or exercise purposes. While not illustrated, each of the remaining elastic members 27-28 and 30 in the power module assembly 6 possess the same rotational ability depicted for the elastic member 29.

Figure 6:
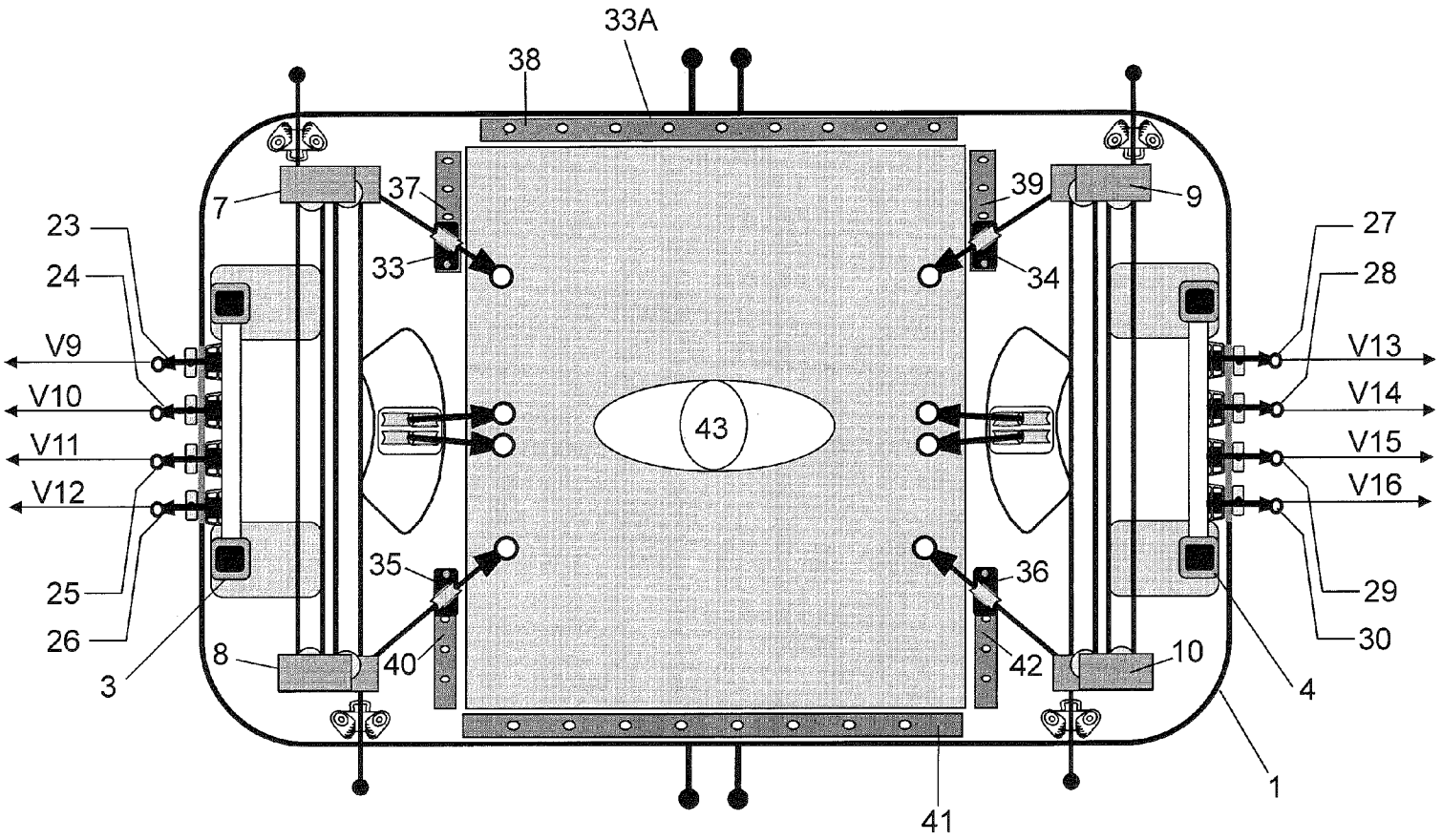
FIG. 6 is a top plan view of an embodiment of the present disclosure for providing a plurality of training vectors having points of origin variable by direction and elevation to a plurality of trainees.

FIG. 6 is a top plan view of a further embodiment of the present disclosure for providing a plurality of training vectors having points of origin variable by direction and elevation to a plurality of trainees. With reference to FIG. 6, the elastic members 23-30 have been rotated 180 degrees relative to each elastic member's respective position illustrated in FIGS. 1-3. Thus, the training vectors V9-V16 are directed away from the platform base 1 to thereby permit additional trainees to train or exercise while positioned off the base 1. As previously noted, the training vectors V9-V16 provided by elastic members 23-30 are adaptable to rotate 360 degrees about corresponding pivot points R9-R16, respectively, to thereby alter the points of origin of the training vectors V9-V16 provided by the elastic members 23-30. Thus, the direction of the training vectors V9-V16 shown by FIG. 6 is illustrative only and is not intended to limit the scope of the invention.

Figure 7:
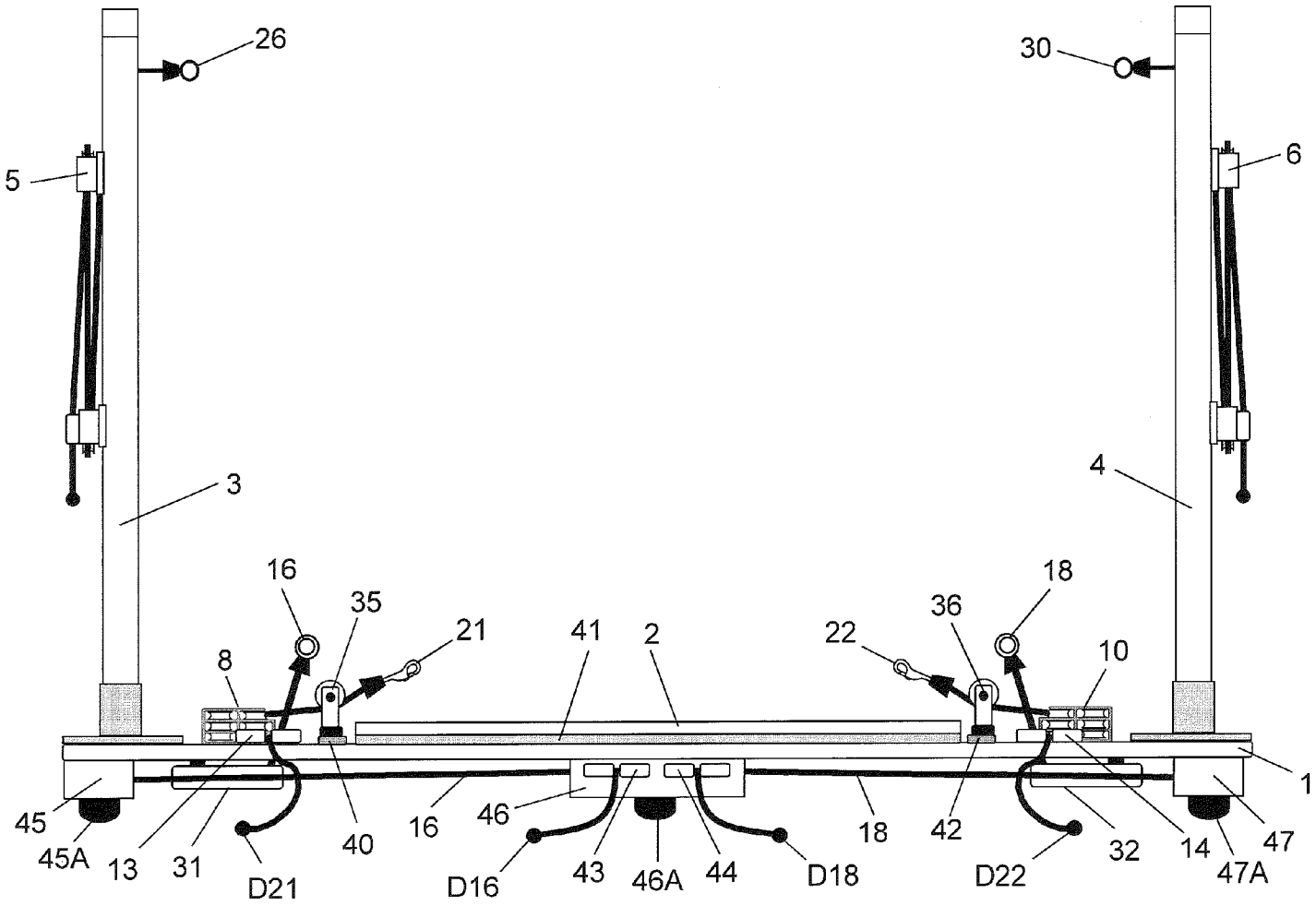
FIG. 7 is a front view of an embodiment of the present disclosure for providing a plurality of training vectors having points of origin variable by direction and elevation to a trainee.

FIG. 7 illustrates a front view of another embodiment of the present disclosure for providing a plurality of training vectors having points of origin variable by direction and elevation to a trainee. With reference to FIG. 7, the elastic members 16, 18 are shown routed from cam assemblies 43, 44 attached to the underside of the base 1 through pulleys provided in the tracking assemblies 31, 32 which provide the point of origin for the training vectors provided by the elastic members 16, 18. The cam assemblies 43, 44 provide a cleating means to adjust the lengths of the elastic members 16, 18 for the purposes of altering the resistance thereof. This may be accomplished by extracting or retracting the distal ends D16, D18 of the elastic members 16, 18 through the cam assemblies 43, 44. The tracking assemblies 31, 32 may rotate about an axis perpendicular to the base 1 and outwardly lateral to the respective tracking assembly 31, 32 thereby allowing the elastic members 16, 18 to track smoothly on the tracking assemblies 31, 32 through the entire range of motion of the body portion of the trainee. Rigid support structures 45-47 house pulley assemblies that route the elastic members 16, 18 from the cam assemblies 43, 44 to the tracking assemblies 31, 32. Pads 45A-47A may be provided on the underside of the rigid support structures 45-47 to protect the surface supporting the base 1 from damage and to provide cushioning or dampening of vibrations induced by a trainee performing training exercises on the apparatus. Thus, the pads 45A-47A may be constructed or molded of any suitable cushioning or dampening material well known in the industry.

With reference to FIG. 7, the tower assemblies 3, 4 are adaptable to slideably house power module assemblies 5, 6 containing the elastic members 23-30. As illustrated, elastic members 23-25 and 27-29 are obstructed from view by the elastic members 26 and 30, respectively. The vertical position of each power module assembly 5, 6 within its respective tower assembly 3, 4 may be changed by a locking mechanism to thereby alter the points and planes of origin of the training vectors provided by the elastic members 23-30.

Figure 9:
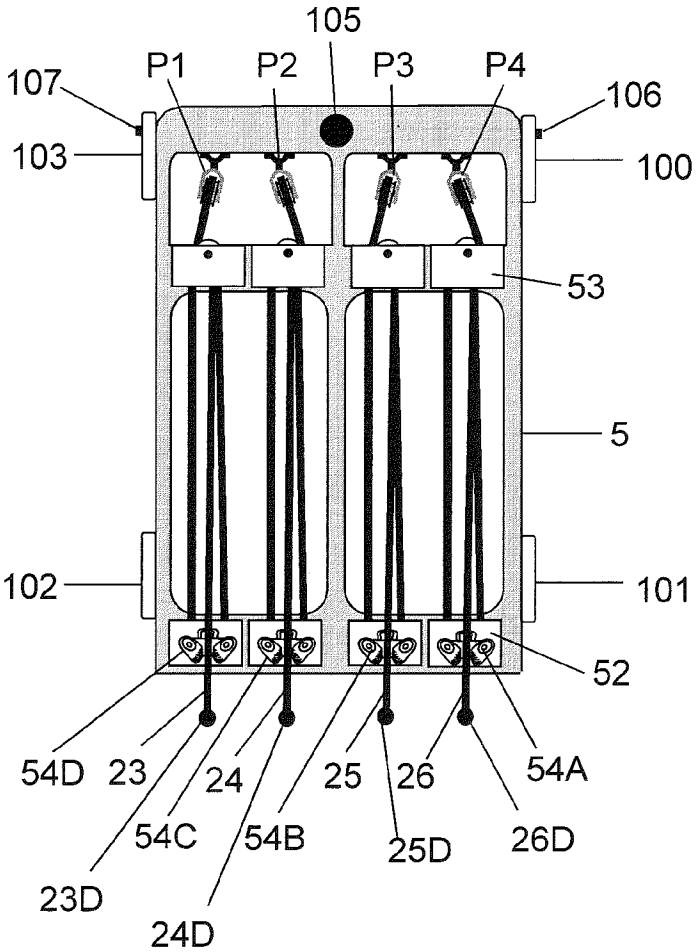
FIG. 9 is a front view of a power module assembly of the present disclosure.
Figure 8:
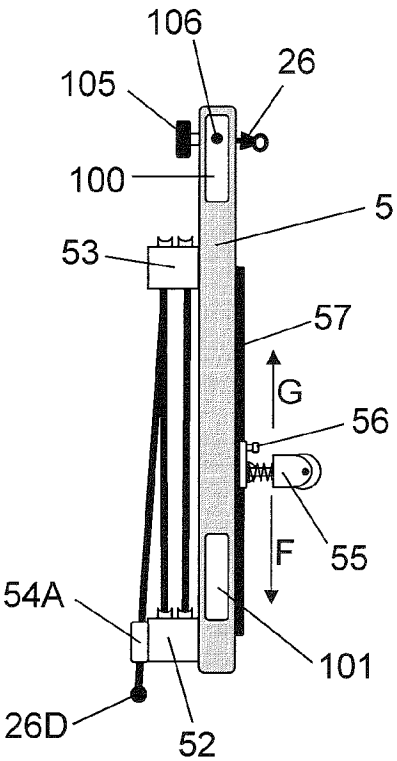
FIG. 8 is a side view of a power module assembly of the present disclosure.
Figure 10:
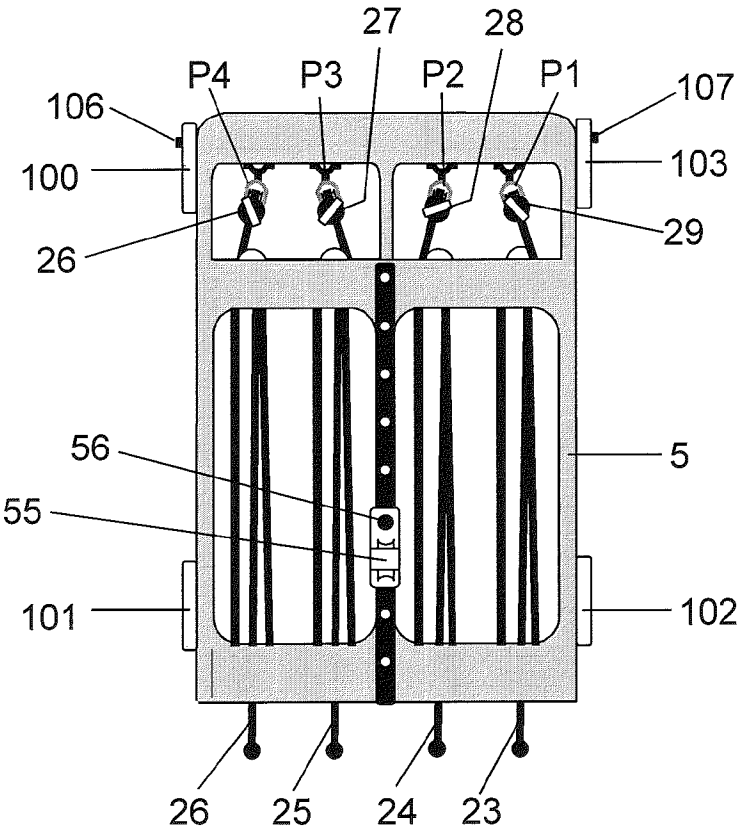
FIG. 10 is a rear view of a power module assembly of the present disclosure.

FIGS. 8, 9 and 10 illustrate the side, front and rear views of the power module assemblies according to the present invention. With reference to FIGS. 8, 9 and 10, the power module assembly 5 comprises a rigid frame that carries a plurality of pulley housing assemblies 52, 53 routing elastic members 23-26 from cam assemblies 54A-54D through the hanging pulley assemblies P1-P4. Each of the pulley housing assemblies 52, 53 includes one or more stacked pulleys. The pulley housing assemblies 52, 53 thus provide a path for routing the elastic members therebetween so that an elastic member many times the distance between corresponding housing assemblies may be utilized. It is also envisioned that a plurality of the training modules disclosed in co-pending U.S. patent application Ser. No. 10/892,568, the contents of which are incorporated by reference herein, may be used in place of the pulley housing assemblies 52, 53.

The hanging pulley assemblies P1-P4 are adaptable to rotate and tilt so that the elastic members 23-26 track smoothly on the hanging pulley assemblies P1-P4 through the entire range of motion of the body portion of the trainee. The power module assembly 5 is identical and interchangeable with power module assembly 6; thus, reference will be made only to the power module assembly 5 and components thereof.

The power module assembly 5 includes a retracting assembly comprising a retracting mechanism 105 operable to retract the locking pins 106, 107. The locking pins 106, 107 may be operably connected to the retracting mechanism 105 via a linkage or spring loaded mechanism to thereby lock the power module assembly 5 in a selected vertical position in the tower assembly 3. A suitable retracting mechanism 105 may be a handle whereby the trainee pulls the handle to retract at least one of the locking pins 106, 107. A further suitable retracting mechanism 105 may also be adaptable to turn clockwise or counter clockwise to retract at least one pin 106, 107. When the retracting mechanism 105 is released, the pins 106, 107 are protracted thereby locking the power module assembly 5 into a selected vertical position in the tower assembly 3. The tracking assemblies 100-103 are mounted on the lateral sides of the power module assembly 5 in contact with the tower assembly 3. The tracking assemblies 100-103 slideably guide the vertical motion of the power module assembly 5 within the confines of the tower assembly 3.

With reference to FIGS. 8 and 10, a movable pulley assembly 55 may be fixed on at least one surface of the power module assembly 5 allowing its position to be set anywhere along a rail 57 as illustrated by arrows F and G. The rail 57 is slotted so that the movable pulley assembly 55 may be positioned along the length of the rail 57. The movable pulley assembly 55 may be fixed at positions along the rail 57 by a suitable locking mechanism 56 such as a spring loaded locking mechanism or other suitable locking means commonly used in the industry. The movable pulley assembly 55 may rotate 360 degrees and tilt+1-90 degrees in any direction so that any one of the elastic members 23-26 tracks smoothly on the movable pulley assembly 55 through the entire range of motion of the body portion of the trainee. It should be noted that multiple movable pulley assemblies may be provided on the rail 57. Furthermore, a plurality of rails and corresponding movable pulley assemblies may be provided on the rigid frame of the power module assembly 5 to vary the point of origin of the training vector provided by any of the elastic members 23-26. Thus, the plane and point of origin of the training vectors provided by the elastic members may be changed independently of the vertical position of the power assembly module 5 in the tower assembly 3. Cam assemblies 54A-54D may be mounted on the pulley housing assemblies 52 to provide a cleating means to adjust lengths of the elastic members 23-26 for the purposes of altering the resistance of the elastic members 23-26. This may be accomplished by extracting or retracting the distal ends 23D-26D of the respective elastic members 23-26 through the cam assemblies 54A-54D. Thus, the magnitude of the training vector will vary with the effective length of the elastic member. Connectors (not shown) may be attached to the elastic members 23-26 whereby the connectors may be connected to harnesses (not shown) worn on body portions of the trainee.

Figure 12:
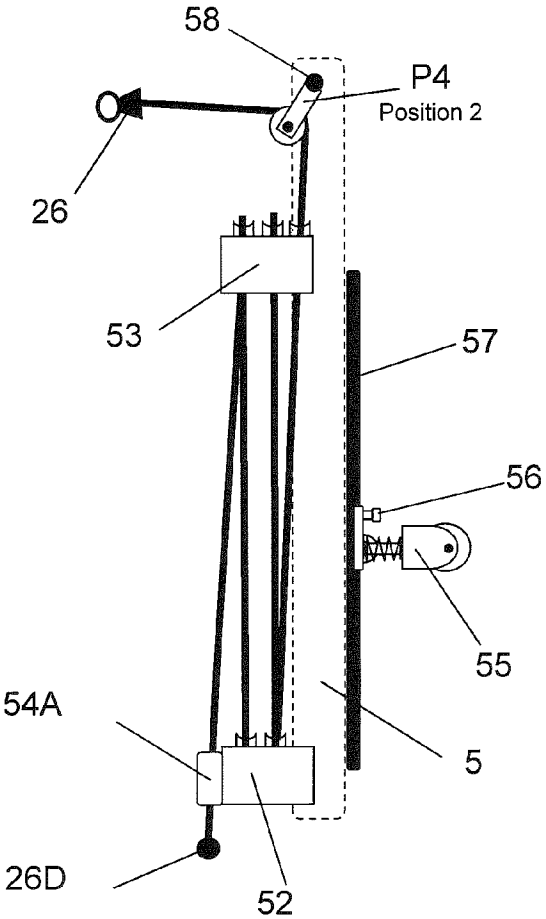
FIGS. 11 and 12 are pictorial views illustrating the rotational capability of an embodiment of a hanging pulley assembly of the present disclosure.
Figure 11:
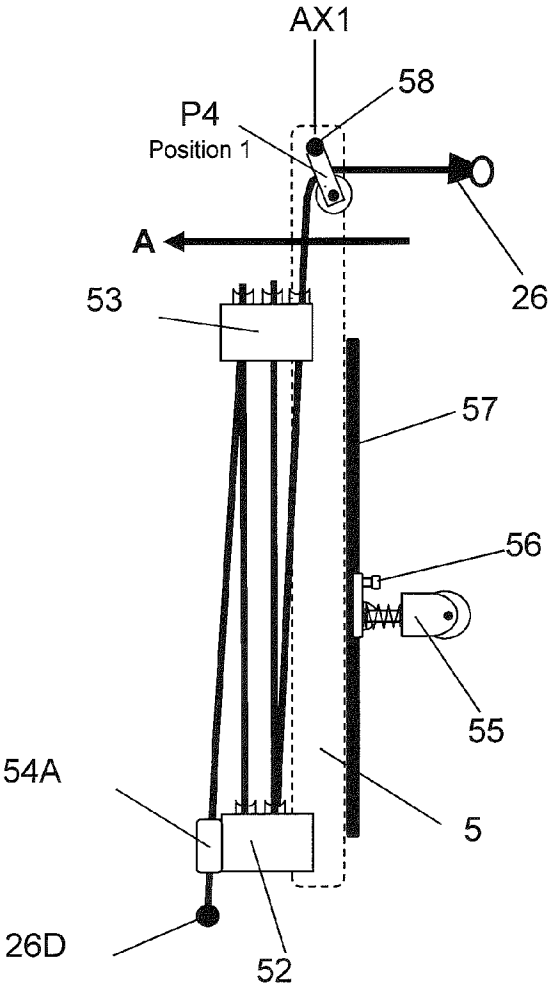

FIGS. 11 and 12 are pictorial views further illustrating the rotational capability of the hanging pulley assemblies P1-P4 shown in FIGS. 9 and 10. The hanging pulley assembly P4 is shown in FIGS. 11 and 12 for demonstrative purposes only and such is not intended to limit the scope of the invention. The hanging pulley assembly P4 is adaptable to pivot on three axes about a point 58. With reference to FIG. 11, the position of the hanging pulley assembly P4 is illustrated when a trainee is training on the exercise area 2 and utilizing the training vector provided by the elastic member 26. If a second trainee, positioned outside the base 1 and lateral to the respective tower assembly 3, desires to utilize the training vector provided by the elastic member 26, the elastic member 26 would be fed under the hanging pulley assembly P4 in the direction illustrated by the arrow A. Upon pulling the elastic member 26 in the direction illustrated by the arrow A, the hanging pulley assembly P4 will rotate 180 degrees about vertical axis AX1 and rotate about an axis perpendicular to the page defined by the point 58. It should also be noted that the hanging pulley assembly P4 may also rotate about an axis normal to AX1 and the axis defined by the point 58.

With reference to FIG. 12, the position of the hanging pulley assembly P4 is shown after the 180 degree rotation about axis AX1 and approximately 60 degree rotation about the axis defined by point 58 has occurred. The hanging pulley assembly P4 is adaptable to rotate about the axis defined by point 58 by more than 60 degrees and thus, the 60 degree rotation denoted above is illustrative only and is not intended to limit the scope of the invention. Thus, the rotational capabilities of the hanging pulley assemblies P1-P4 and P5-P8 allow a trainee to access and extract elastic members 23-30 from either side of the respective power module assemblies 5, 6.

Figure 13:
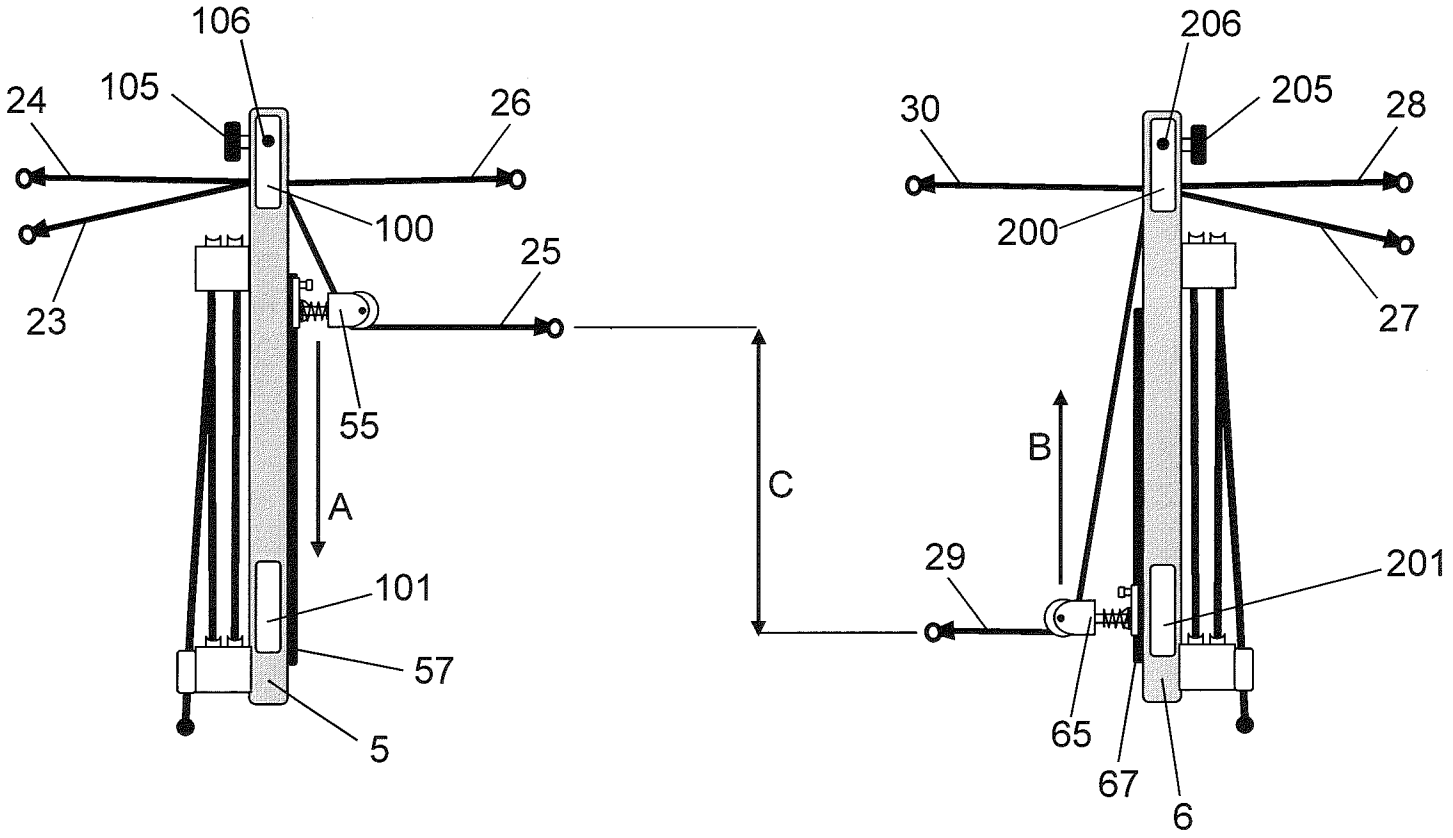
FIG. 13 is side view of a power module assembly of the present disclosure.

FIG. 13 is a side view of the power module assemblies 5, 6 illustrating the vertical adjustment range of movable pulley assemblies 55, 65. With reference to FIG. 13, the movable pulley assembly 55 is positioned at the upper range of elevation adjustment on the rail 57, and the movable pulley assembly 65 is positioned at the lower range of elevation adjustment on the rail 67. Elevation adjustments to the movable pulley assemblies 55, 65 may be made in the directions illustrated by arrows A and B. As a result, any of the elastic members 23-26 and 27-30 may be routed through the movable pulley assemblies 55, 65, respectively, and have their vector origin fixed anywhere along the elevation path illustrated by arrow C without changing the position of the power module assemblies 5, 6.

Figure 14:
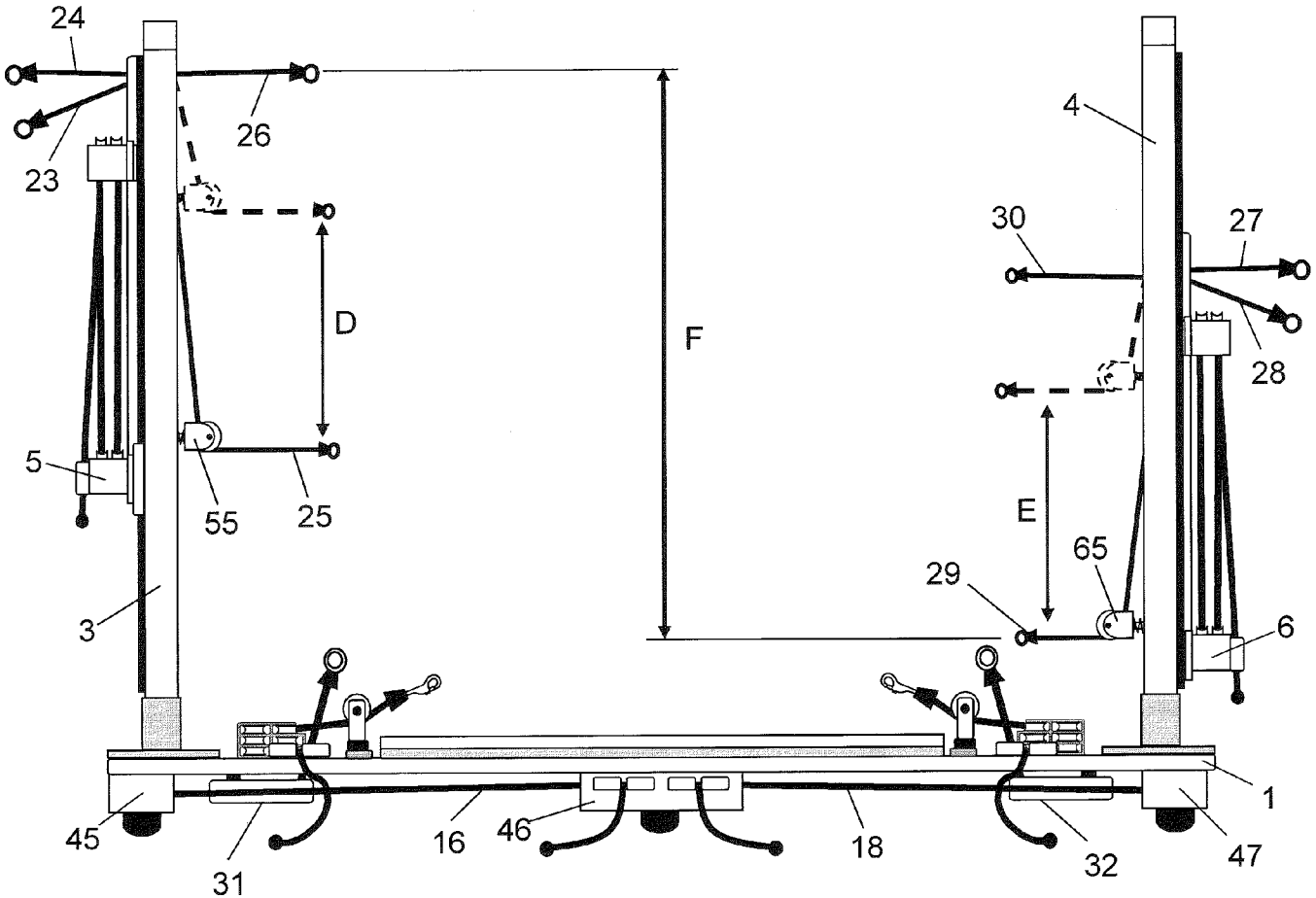
FIG. 14 is a front view of an embodiment of the present disclosure for providing a plurality of training vectors having points of origin variable by direction and elevation to a trainee.
Figure 15:
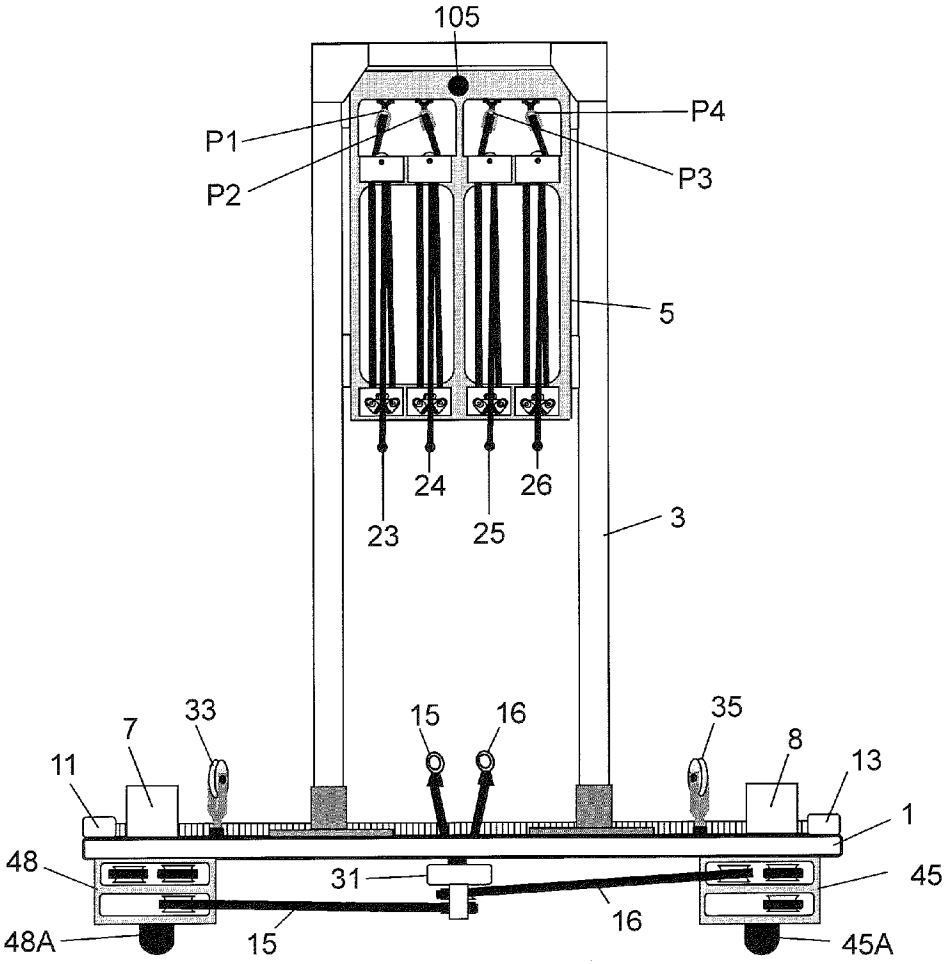
FIGS. 15 and 16 are side views of the embodiment of FIG. 14.
Figure 16:
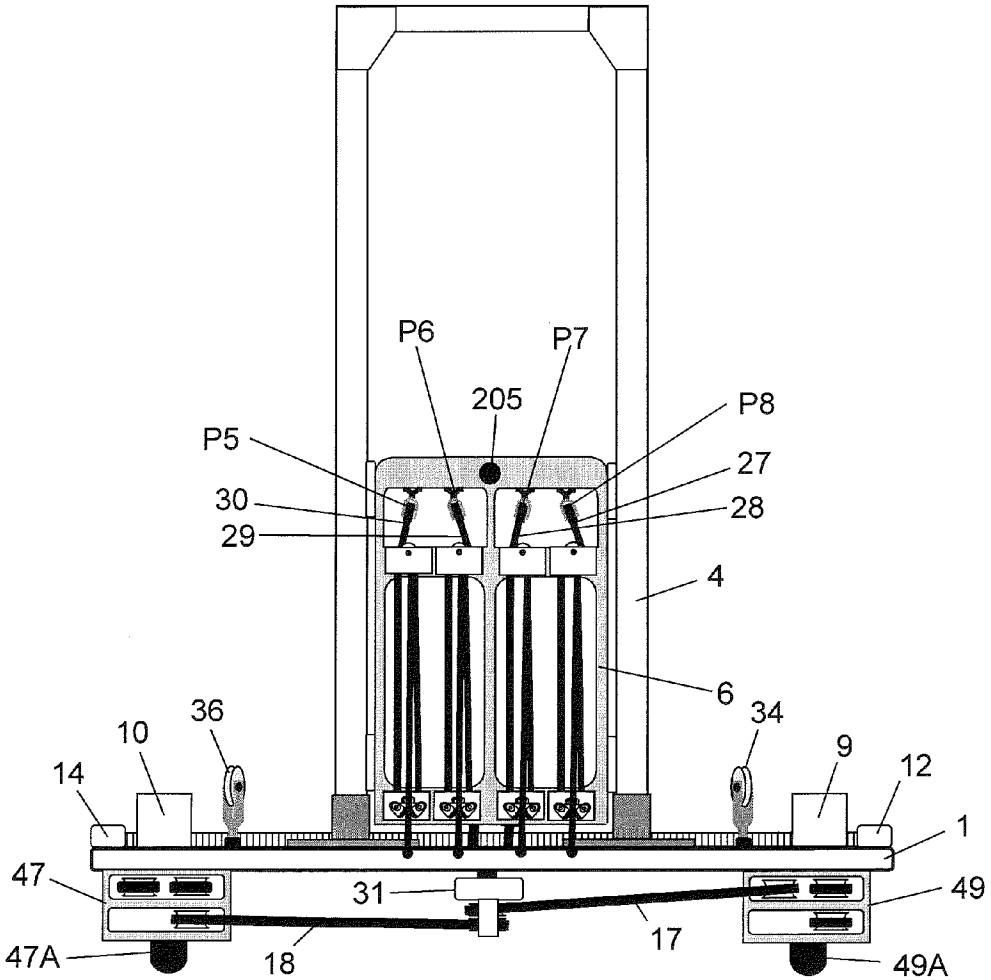

FIGS. 14, 15 and 16 are illustrations of an embodiment of the present disclosure illustrating the full range of elevation adjustments for training vectors provided by the elastic members 23-30. With reference to FIGS. 14, 15, and 16, the power module assembly 5 housed by tower assembly 3 is shown at its highest vertical position. Accordingly, the position of the power module assembly 5 may be the changed to its lowest vertical position as illustrated by the position of the power module assembly 6. The movable pulley assemblies 55, 65 may be positioned at any elevation independent of the position of the power module assemblies 5, 6 as illustrated by arrows D and E. Thus, by vertically positioning power module assemblies 5, 6 in their respective tower assemblies 3, 4 and utilizing the adjustment range D, E of the movable pulley assemblies, 55, 65, the origin of any of the training vectors provided by the elastic members 23-30 may be placed along the elevation range illustrated by the arrow F.

Figure 17:
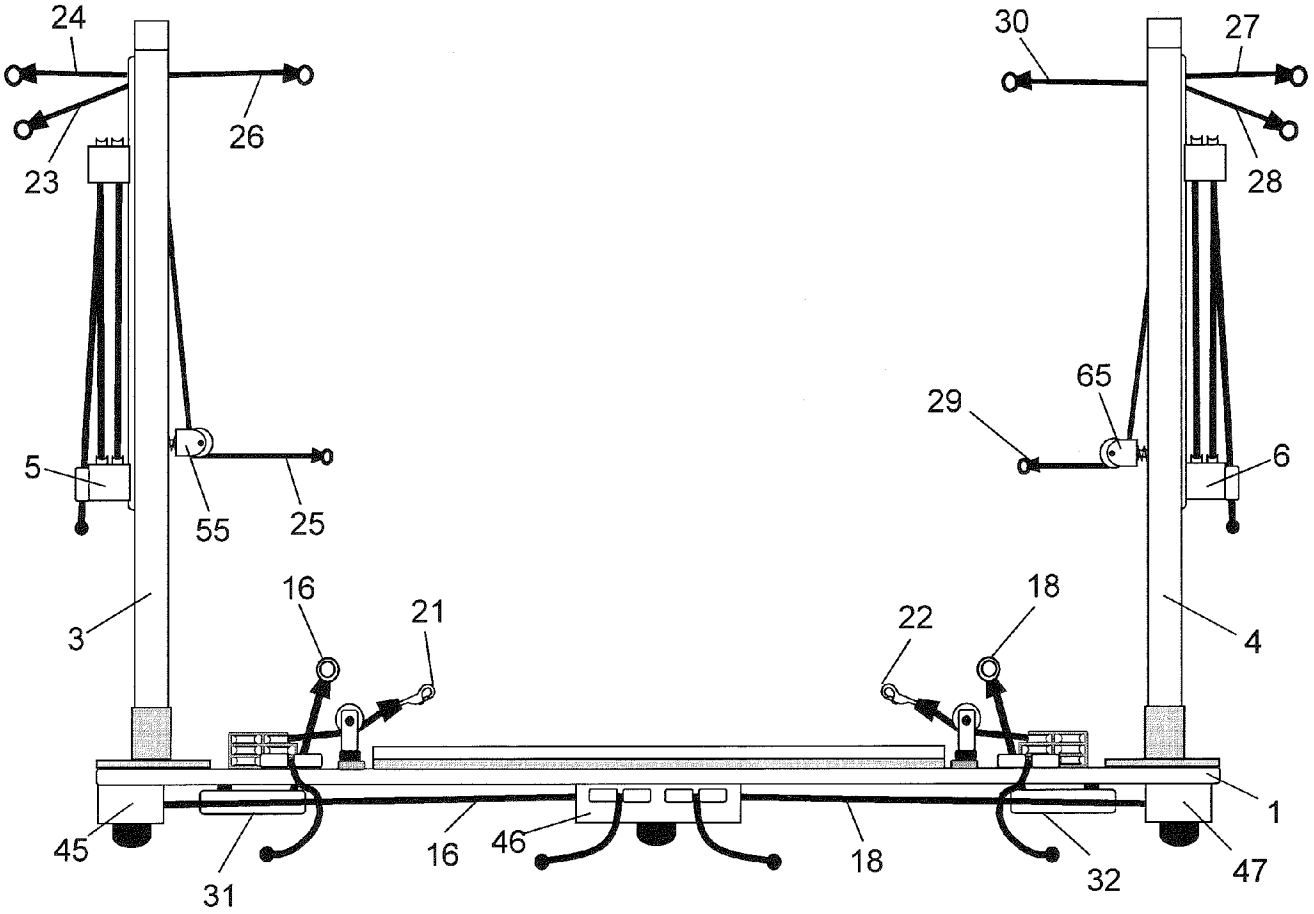
FIG. 17 is a front view of an embodiment of the present disclosure for providing a plurality of training vectors having points of origin variable by direction and elevation to a trainee.

FIG. 17 is a front view of another embodiment of the present disclosure for providing a plurality of training vectors having points of origin variable by direction and elevation to a trainee. With reference to FIG. 17, the power module assemblies 5, 6 housed by the tower assemblies 3, 4 are illustrated at each module's highest vertical position. The movable pulley assemblies 55, 65 are positioned at the lowest elevation independent of the position of the power module assemblies 5, 6. It should be noted that the elastic members utilized in FIG. 17 are for demonstrative purposes only and any of the elastic members of the present invention may be utilized to provide training vectors to any body portion selected by a trainee.

Figure 18:
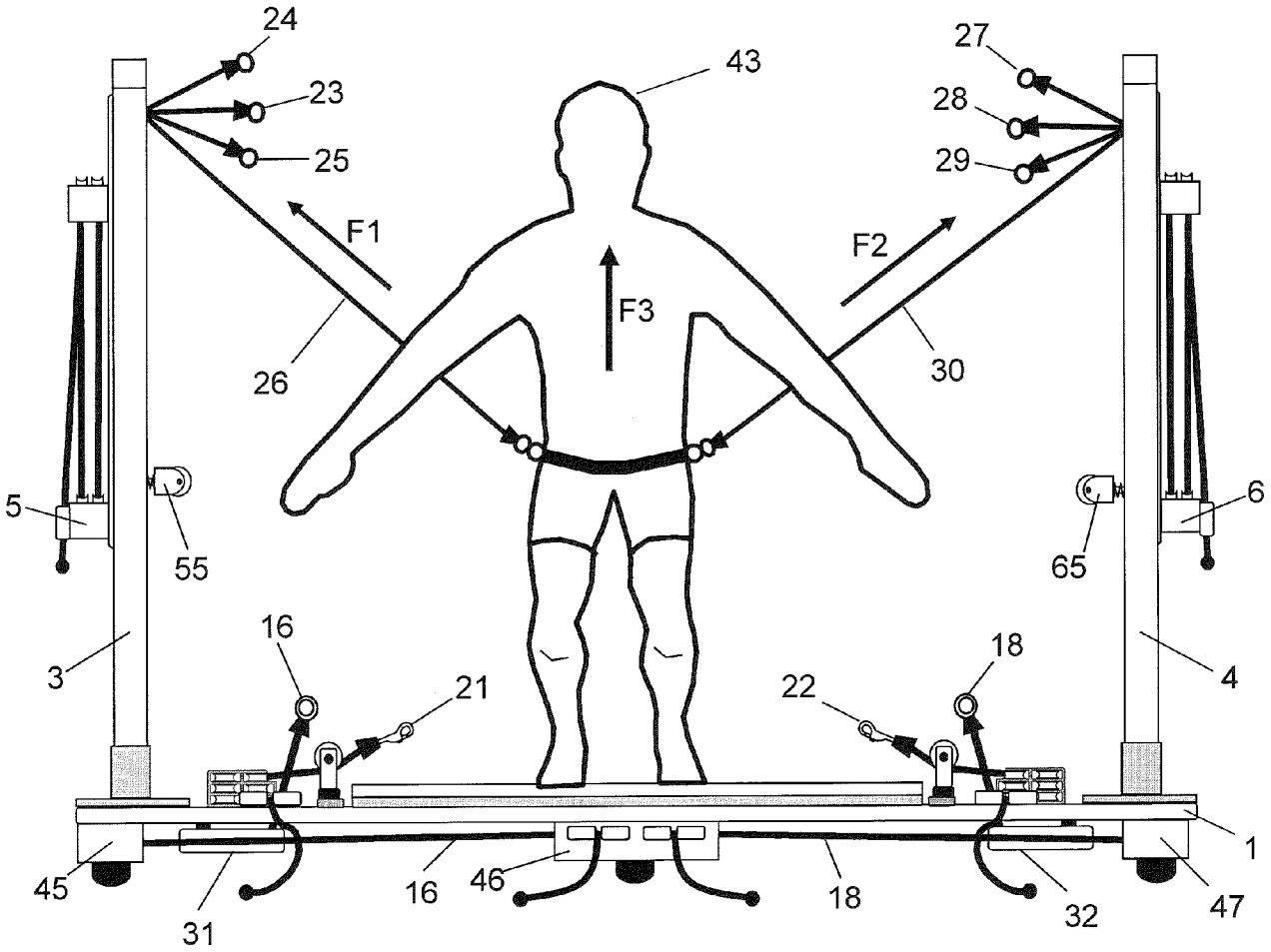
FIG. 18 is an illustration of the training vectors associated with an embodiment of the present disclosure showing a trainee in a crouched position.
Figure 19:
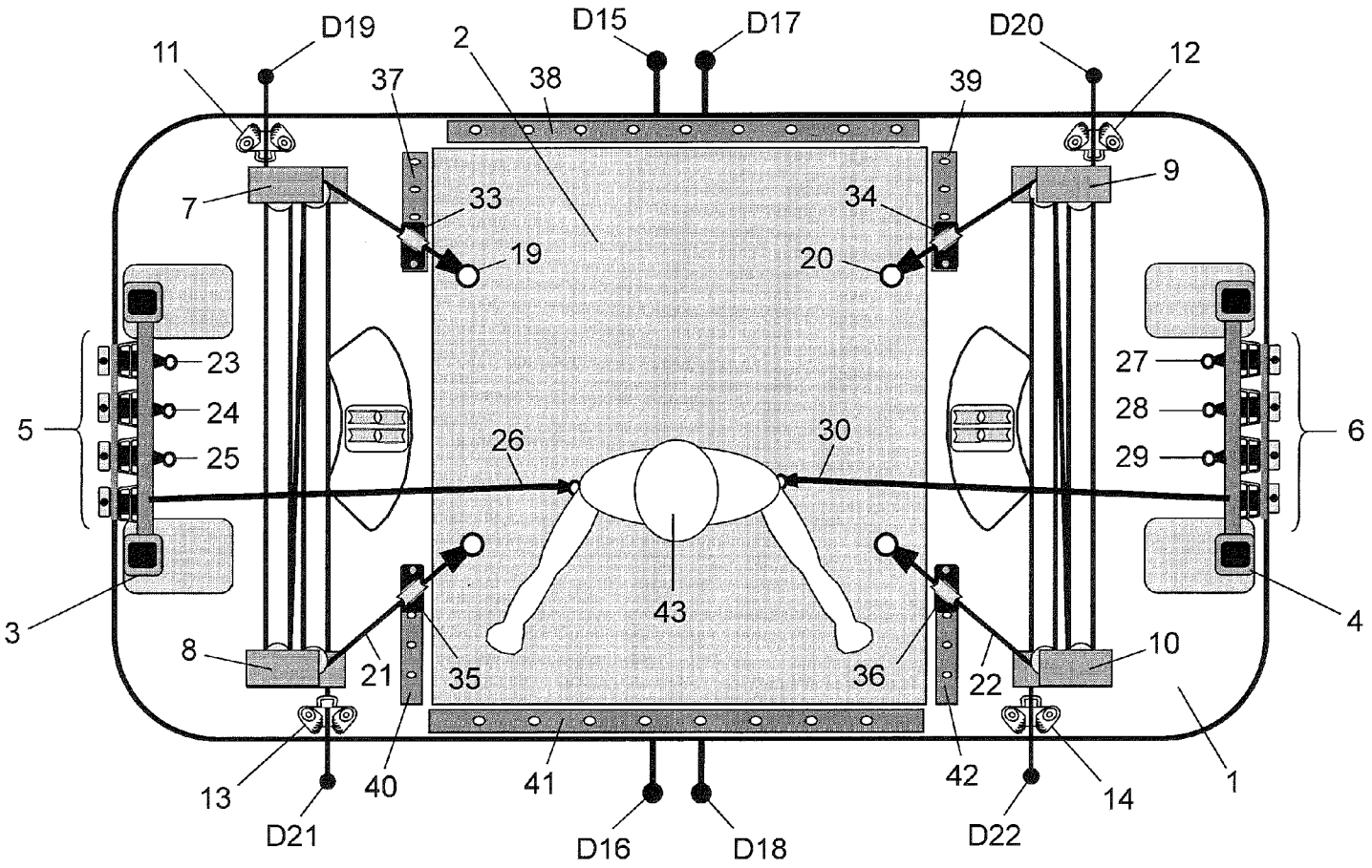
FIG. 19 is a top plan view of the embodiment of FIG. 18.

FIGS. 18 and 19 illustrate front and top plan views of one embodiment of the physical training apparatus for providing training vectors to a trainee. With reference to FIGS. 18 and 19, training vectors F1 and F2 provided by the elastic members 26, 30 are applied to the waist of the trainee 43. Since the training vectors F1 and F2 possess an origin at the highest elevation of the respective power module assemblies 5, 6, the training vectors F1 and F2 act to provide a net lifting force vector F3 to the waist of the trainee 43.

Figure 20:
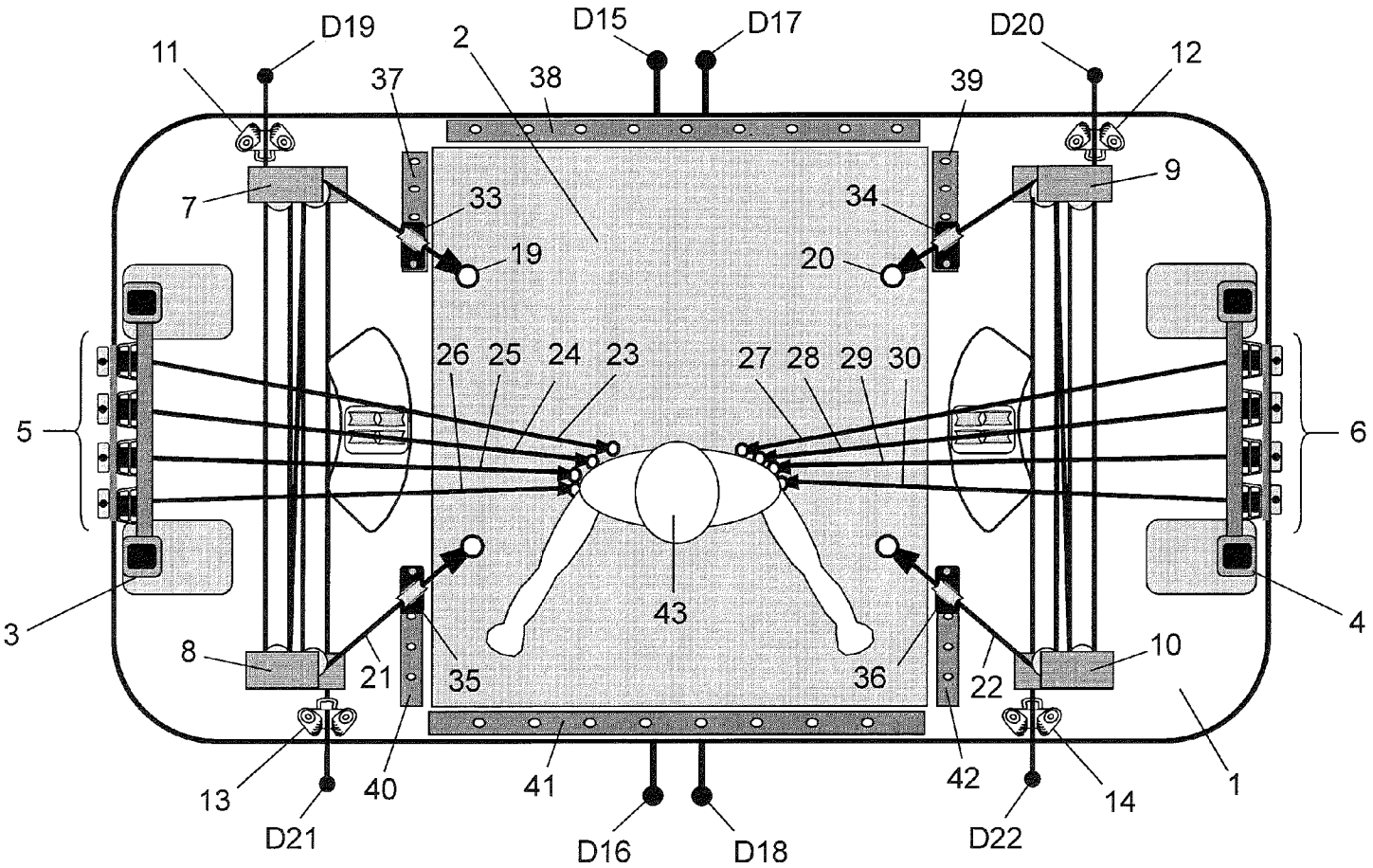
FIG. 20 is a top plan view of an embodiment of the present disclosure providing eight training vectors to a trainee.

FIG. 20 illustrates a top plan view of a further embodiment of the physical training apparatus for providing training vectors to a trainee. With reference to FIG. 20, each of the elastic members 23-26 originating from the power module assembly 5 and each of the elastic members 27-30 originating from the power module assembly 6 are attached to the waist of the trainee 43 to thereby maximize the upward lifting force vector F3 illustrated in FIG. 18. Thus, as each additional elastic member is connected to the waist harness of the trainee 43, the loading on the trainee's legs will decrease proportionally by the amount of resistance applied by the elastic member. Accordingly, the magnitude of the lifting force vector F3 may be altered by varying the effective length of the elastic members 23-30 or by adding resistance training vectors by the elastic members 15-22.

Figure 21:
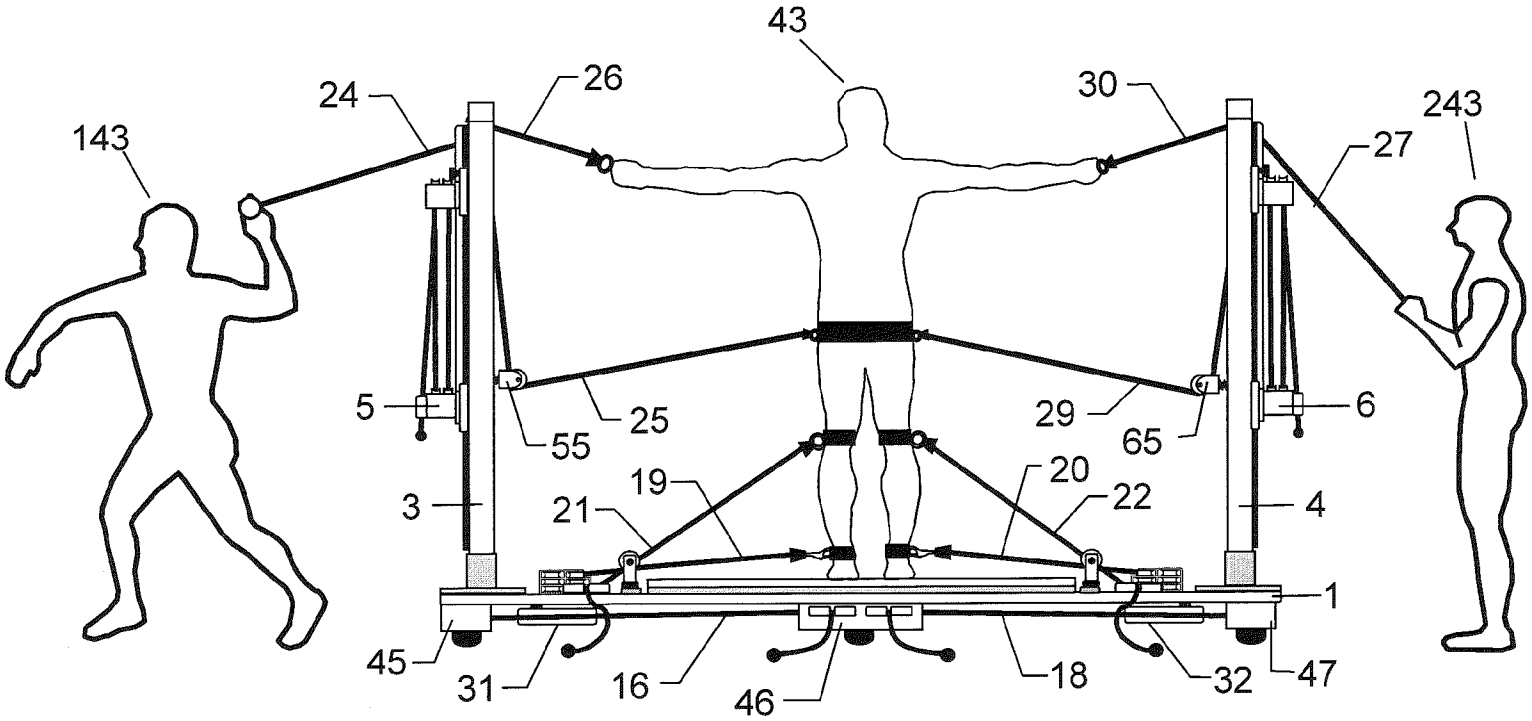
FIG. 21 is front view of an embodiment of the present disclosure providing eight training vectors having points of origin variable by direction and elevation to one trainee and providing training vectors to two other trainees simultaneously.

FIGS. 21-25 illustrate embodiments of the physical training apparatus of the present invention for providing a plurality of training vectors having points of origin variable by direction and elevation to at least one trainee. With reference to FIG. 21, an embodiment of the present invention is illustrated providing eight training vectors having points of origin variable by direction and elevation to one trainee and providing training vectors to two other trainees simultaneously. As illustrated in FIG. 21, the elastic members 21, 22 are attached to the knees of the trainee 43 and the elastic members 19, 20 are attached to the ankles of the trainee 43. The elastic members 25, 29 are routed through the power module assemblies 5, 6 and through the movable pulley assemblies 55, 65 and attached to the waist of the trainee 43 and the elastic members 26, 30 are routed through the power modules assemblies 5, 6 and attached to the hands of the trainee 43. While the trainee 43 is conducting his or her training or therapeutic exercises, a second trainee 143, exercising off the base 1, may be performing another independent exercise. In this illustration, the elastic member 24 has been attached to a ball and thereby provides a resistance training vector to the second trainee 143 conducting a throwing motion. A third trainee 243, exercising off the base 1, may also be performing another independent exercise. With reference to FIG. 21, a training vector is provided to the trainee 243 by the elastic member 27 while he or she is performing a triceps exercise.

While not shown, the trainee 43 may utilize any of the remaining training vectors provided by unused elastic members having a point of origin from the base 1 or from the tower assemblies 3, 4. Furthermore, the second trainee 143 may utilize any of the remaining training vectors provided by unused elastic members having a point of origin from the tower assembly 3, and the third trainee 243 may utilize any of the remaining training vectors provided by unused elastic members having a point of origin from the tower assembly 4. It should be noted that the magnitude of each of the training vectors supplied by the present invention may be independently varied with the effective length of the corresponding elastic member.

Figure 22:
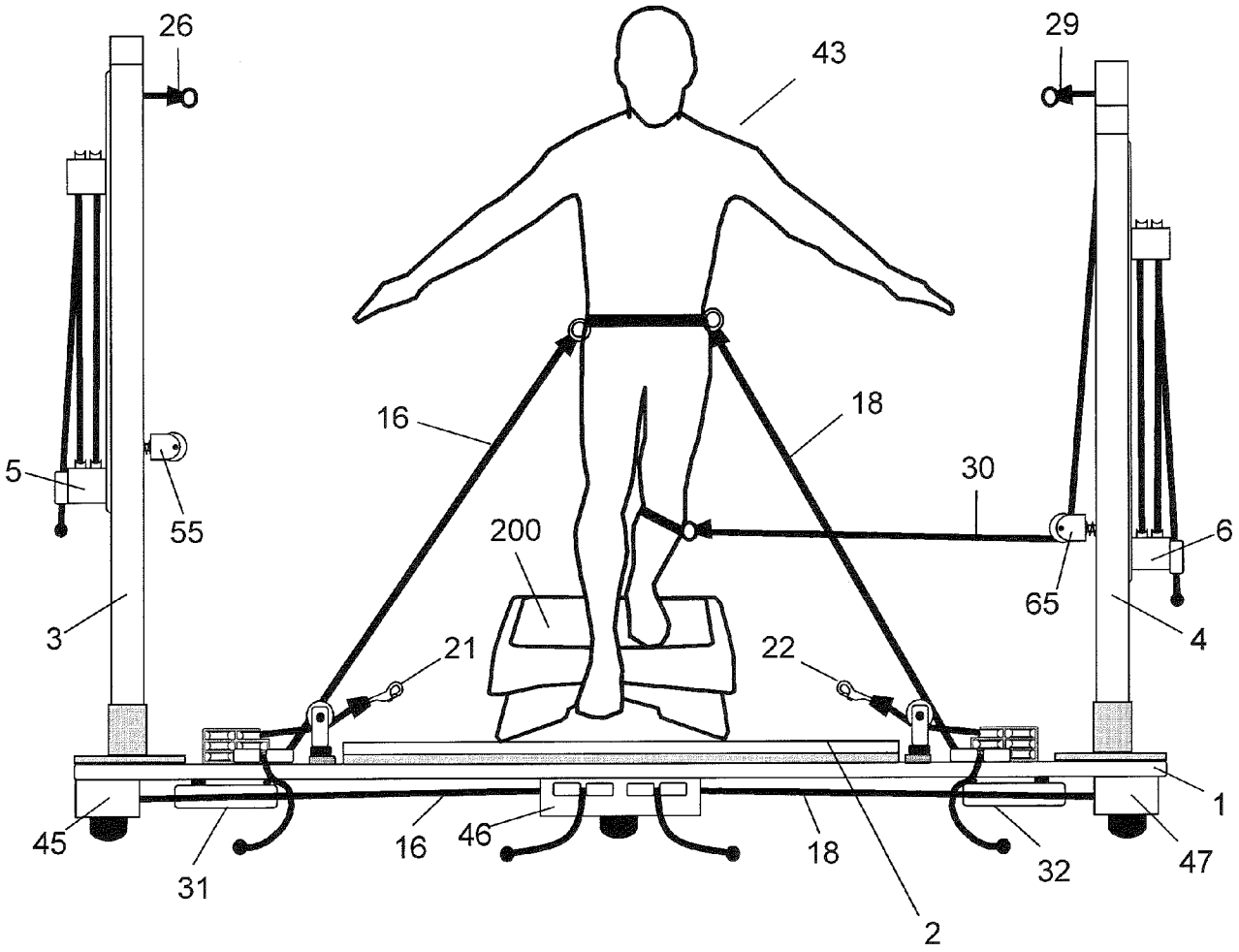
FIG. 22 is front view of an embodiment of the present disclosure providing an unbalanced loading comprising at least three training vectors to a trainee.

With reference to FIG. 22, a further embodiment of the present invention is illustrated providing three training vectors having points of origin variable by direction and elevation to a trainee. An unbalanced training vector configuration is illustrated in FIG. 22 whereby an unbalanced resistance may be applied to a trainee 43 to exercise specialized muscle groups that would otherwise not be challenged during an exercise motion with any prior art exercise apparatuses. With reference to FIG. 22, a trainee 43 is shown performing a stepping exercise. Training vectors are applied to the waist or hips of the trainee 43 by the elastic members 16, 18 while a third training vector is applied to the trainee's left knee. In this instance, as the trainee's left knee bends to allow the right foot to make contact with the exercise area 2, the training vector supplied by the elastic member 30 will activate muscles on the inside of the trainee's left leg that are not normally activated when stepping down.

Figure 23:
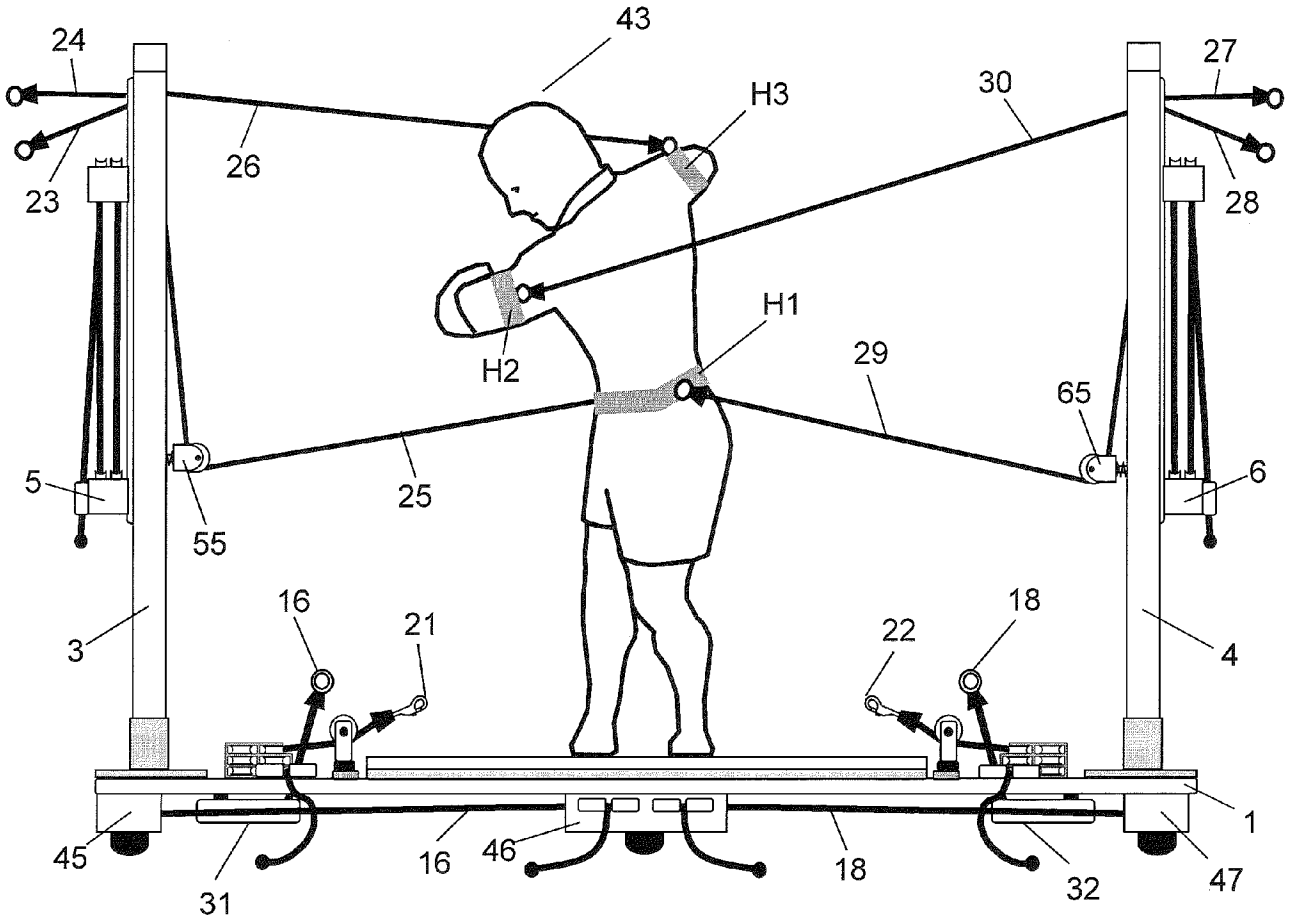
FIG. 23 is a front view of an embodiment of the present disclosure with a trainee performing a swinging exercise.

With reference to FIG. 23, an embodiment of the present disclosure is shown with a trainee performing a swinging motion. FIG. 23 illustrates the ability of the present invention to apply balanced torque at multiple planes to a trainee. The application of such balanced torque is helpful towards strengthening muscles associated with swinging a golf club, baseball bat, or tennis racket. For example, the elastic members 25, 29 are attached to the right and left hips of the trainee 43 by a harness H1. The elastic member 30 is attached to the left shoulder of the trainee 43 by a harness H2 and the elastic member 26 is attached to the right shoulder of the trainee 43 by a harness H3. As the trainee 43 rotates to a back swing position, all of the elastic members 25, 26, 29, 30 provide resistance training vectors into the back swing or coiled position while assisting the swinging motion of the trainee 43 from the back swing position through the mid-swing and follow-through positions. The application of the training vectors provided by the elastic members 25, 26, 29, 30 thus strengthen all the muscles associated with a back swing in this manner.

If the trainee 43 rotates to his or her left 180 degrees and then coils to a back swing position, the elastic members 25, 26, 29, 30 assist the back swing or coiled position while resisting the swinging motion of the trainee 43 from the back swing position through the mid-swing and follow-through positions. The application of the training vectors provided by the elastic members 25, 26, 29, 30 thus strengthen all the muscles associated with the down swing in this manner. Accordingly, a trainee 43 may reposition the elastic members 25, 26, 29 30 such that the elastic member 26 is attached to the left shoulder, the elastic member 30 is attached to the right shoulder, and the elastic members 25, 29 are attached to the left and right hips, respectively, of the trainee 43. Thus, the training vectors provided by the elastic members 25, 26, 29, 30 will assist the trainee into a backswing or coiled position and provide resistance training vectors through the mid-swing and follow-through positions. In this manner, if the trainee 43 rotates to his or her left 180 degrees and then rotates to a back swing position, the elastic members 25, 26, 29, 30 will resist the back swing or coiled position while assisting the swinging motion of the trainee 43 from the back swing position through the mid-swing and follow-through positions.

The magnitude of each of the training vectors may be varied with the effective length of the respective elastic members. For example, the elastic members 25 and 29 may have sufficient length so that the magnitude of the training vectors provided to the hips of the trainee is greater than the magnitude of the training vectors provided to the shoulders of the trainee via the elastic members 26 and 30. In a further embodiment of the present disclosure, elastic members having different diameters may be utilized for providing a wider range of resistive force. It is also envisioned that the training modules disclosed in co-pending U.S. patent application Ser. No. 10/892,568, the contents of which are incorporated by reference herein, may be utilized, stacked or combined to increase the useful resistance force range.

Figure 24:
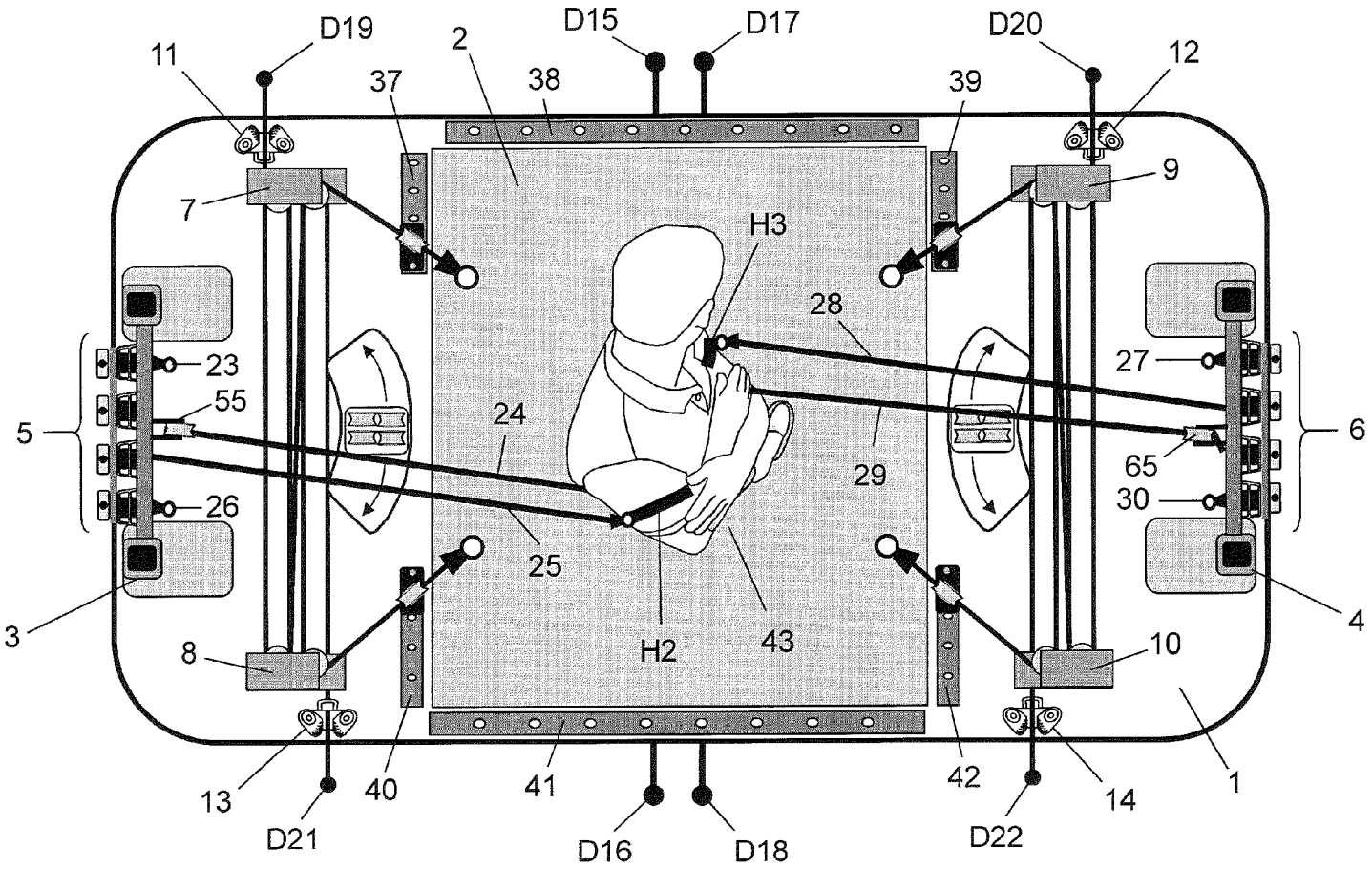
FIG. 24 is a top plan view of an embodiment of the present disclosure with a trainee performing a swinging exercise.

With reference to FIG. 24, another embodiment of the present disclosure is shown with a trainee performing a swinging motion. FIG. 24 further illustrates the ability of the present invention to apply balanced torque on multiple planes to a trainee. In the embodiment shown, the elastic members 24, 25, 28, 29 are utilized to exercise specific muscle groups of the trainee while performing a swinging motion. The elastic member 28 is attached to the left arm by the harness H3 and the elastic member 25 is attached to the right arm by the harness H2. The elastic member 29 is attached to the left hip with the harness H1 (not shown) and the elastic member 24 is attached to the right hip with the harness H1 (not shown). The movable pulley assemblies 55, 65 lower the elevation of the elastic members 24, 29 to thereby change the point and plane of origin of the training vectors provided by the elastic members 24, 29. In such a configuration, elastic members apply clockwise torque at the hips and shoulders thus helping the trainee 43 coil in the clockwise direction. When the trainee performs a swinging motion and uncoils in the counter-clockwise direction, the elastic members 24, 25, 28, 29 provide resistance training vectors. Thus, the trainee 43 will be working against the torque applied by the elastic members 24, 25, 28, 29 through the complete counter-clockwise motion. If the trainee 43 reverses his or her position and faces the rail 41, the torque applied to his or her body will reverse. Thus, the elastic members 24, 25, 28, 29 provide resistance training vectors to the clockwise rotation or back swing motion of the trainee 43 and act to assist counter-clockwise rotation or down swing and follow through motion of the trainee 43.

Figure 25:
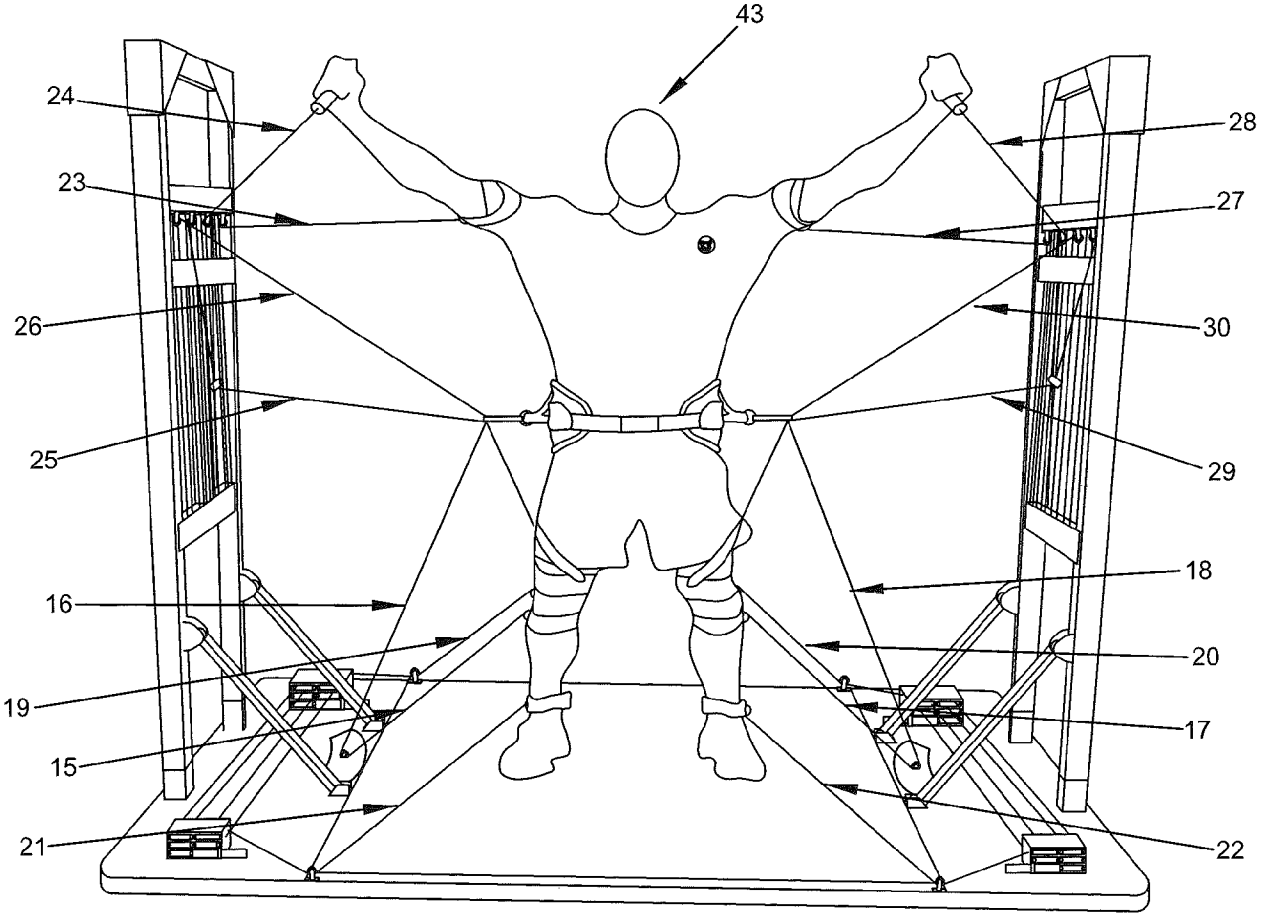
FIG. 25 is an isometric view of an embodiment of the present disclosure providing sixteen training vectors having points of origin variable by direction and elevation to one trainee.

With reference to FIG. 25, yet another embodiment of the present invention is illustrated providing sixteen training vectors having points of origin variable by direction and elevation to one trainee. For example, FIG. 25 illustrates the trainee 43 utilizing a plurality of training vectors applied to the upper torso area by four elastic members 23, 24, 27, 28, to the waist by six elastic members 16, 18, 25, 26, 29, 30, and to the lower extremities of the trainee 43 by six elastic members 15, 17, 19-22. The magnitude of each of the training vectors may be independently adjusted relative to the magnitude of the other training vectors. It should be noted that any of the elastic members 15-30 may be utilized alone or in any of a multitude of combinations by the trainee 43 to thereby exercise specific muscle groups of the trainee 43 throughout an entire range of motion.

Figure 26:
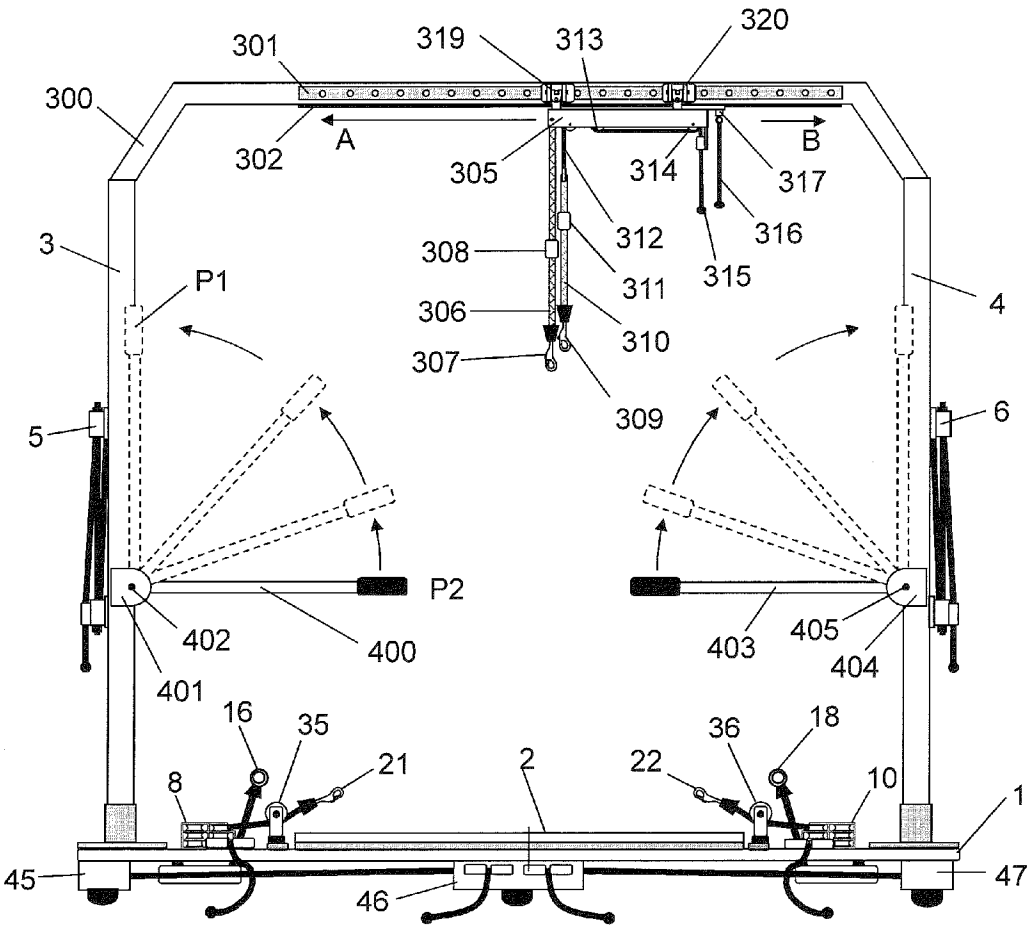
FIG. 26 is a front view of an embodiment of the present disclosure providing training vectors having points of origin variable by direction and elevation to one trainee further providing an overhead support structure.
Figure 27:
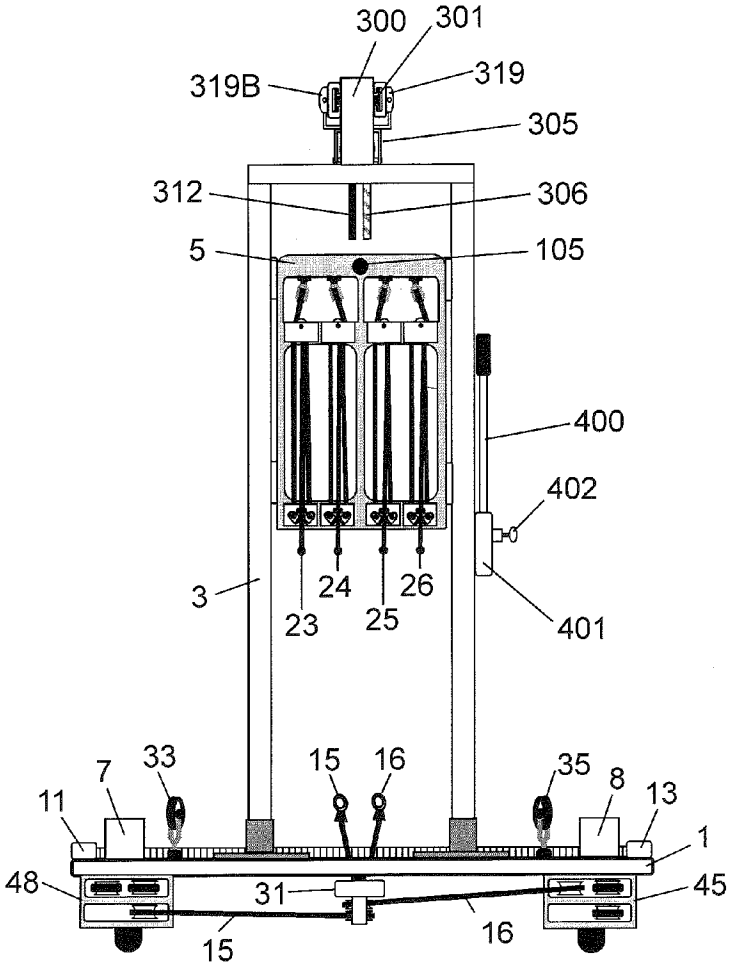
FIG. 27 is a side view of the embodiment of FIG. 26.

FIGS. 26 and 27 illustrate a further embodiment of the present disclosure providing training vectors having points of origin variable by direction and elevation to one trainee and further providing an overhead support structure to provide support for patients or trainees who cannot fully support their own body weight. With reference to FIG. 26, an overhead support structure 300 extends between and is securely mounted to the crown of both tower assemblies 3, 4. The overhead support structure 300 may be adaptable to be easily removed by a trainee or therapist. A trolley assembly 305 is slideably mounted to the overhead support structure 300 by a plurality of sliding guides 319, 320 and 319B, 320B (not shown). The sliding guides 319, 319B, 320, 320B slide on rails 301, 301B, 302 affixed to the overhead support structure 300. The rails 301, 301B, 302 are slotted so that the trolley assembly 305 may be positioned along the length of the rails 301, 301B, 302 in the directions illustrated by arrows A and B. The trolley assembly 305 may also be adaptable to lock in place on the rails 301, 301B, 302 by any suitable locking means such as spring loaded locking mechanisms. One suitable locking means is a locking member 316 operably attached to a locking pin 317. When the locking member 316 is pulled, the trolley assembly 305 is allowed to freely slide along the rails 301, 301B, 302. When the locking member 316 is released, the locking pin 317 engages at least one rail and locks the trolley assembly 305 in place. The trolley assembly 305 further comprises a plurality of tracking mechanisms 325 which route a retraction cable 312 from a gliding assembly (not shown) to a hoisting member 310 having a connector 309 attached thereto for attaching to a harness (not shown) worn by a trainee or patient. A hoisting cable 315 is affixed at one end to the gliding assembly (not shown) via tracking mechanisms 313, 314. The trolley assembly 305 further comprises a safety member 306 having a suitable connector 307 at the distal end thereof for attachment to a trainee or patient.

The tracking mechanisms preferably comprise a combination of fixed pulley assemblies 314, 325 and slidable pulley assemblies 313 which, when the hoisting cable 315 is operated, act to lift a trainee or patient attached to the hoisting member 310 for therapeutic exercises. Adjustment buckles 308, 311 are provided on the safety member 306 and hoisting member 310, respectively, allowing for length adjustment thereof. At least two rotating support structures 400, 403 may be mounted to the tower assemblies 3, 4 to provide balance and support for patients of varying height. The rotating support structures 400, 403 are adaptable to lock at several different angles. Patients or trainees may utilize the support structures 400, 403 to help balance themselves while the hoisting and safety members are being attached to their bodies, or the patients or trainees may utilize the support structures during athletic or therapeutic exercises. The support structures 400, 403 are rotatably mounted to support bases 401, 404 affixed to the tower assemblies 3, 4. The support bases 401, 404 further comprise a locking means 402, 405 to thereby lock the structures 400, 403 in many positions ranging from a horizontal position P2 to a vertical stow position P1. Any suitable locking means 402, 405 such as spring loaded locking mechanisms or pins may be utilized to lock the support structures 400, 403.

Figure 28:
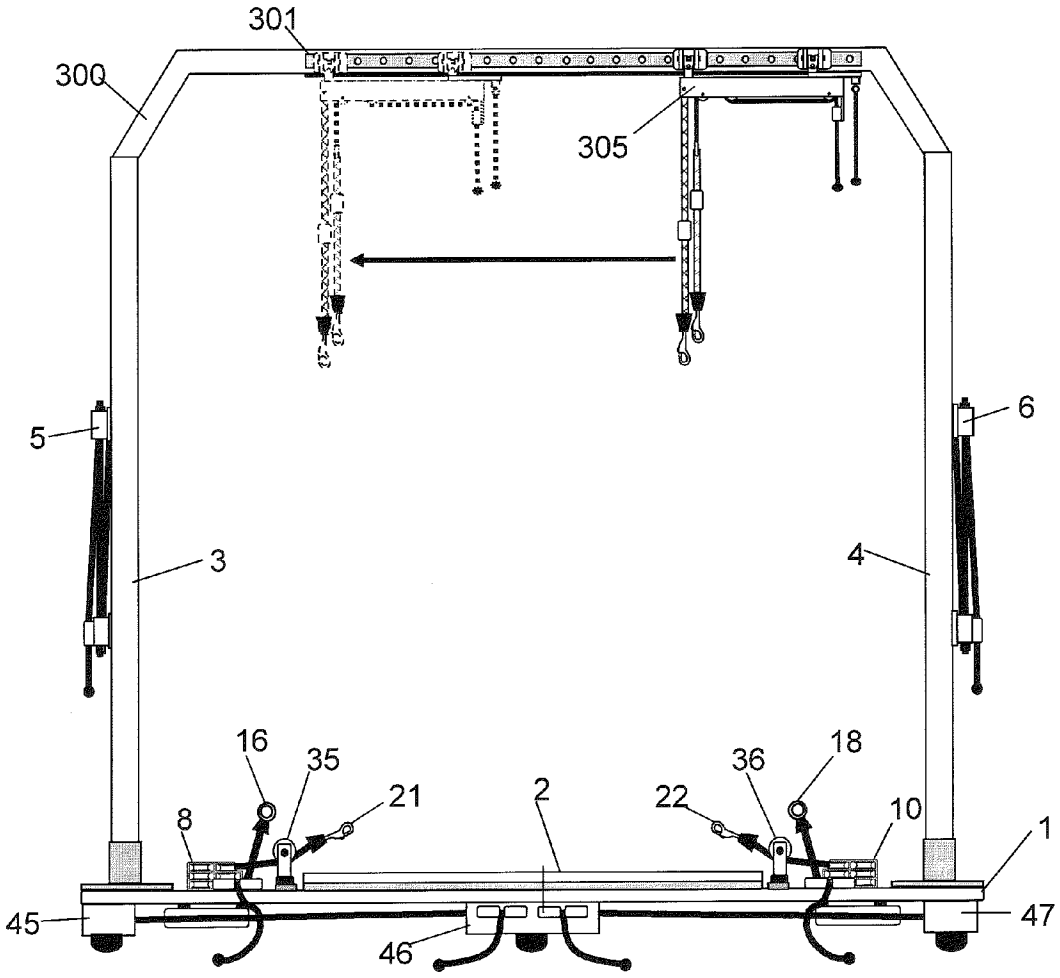
FIG. 28 is a front view the embodiment of FIG. 26 illustrating the sliding range of a trolley assembly of the present disclosure.

FIG. 28 is a front view the embodiment of FIG. 26 illustrating the sliding range of the trolley assembly 305. It should be noted that the range of the safety and hoist members 306, 310 may correspond to the lateral edges of the exercise area 2. However, the orientation of the trolley assembly 305 may be changed ninety degrees on a vertical axis to thereby allow for a greater range of travel on the rails 301, 301B, 302.

Figure 29:
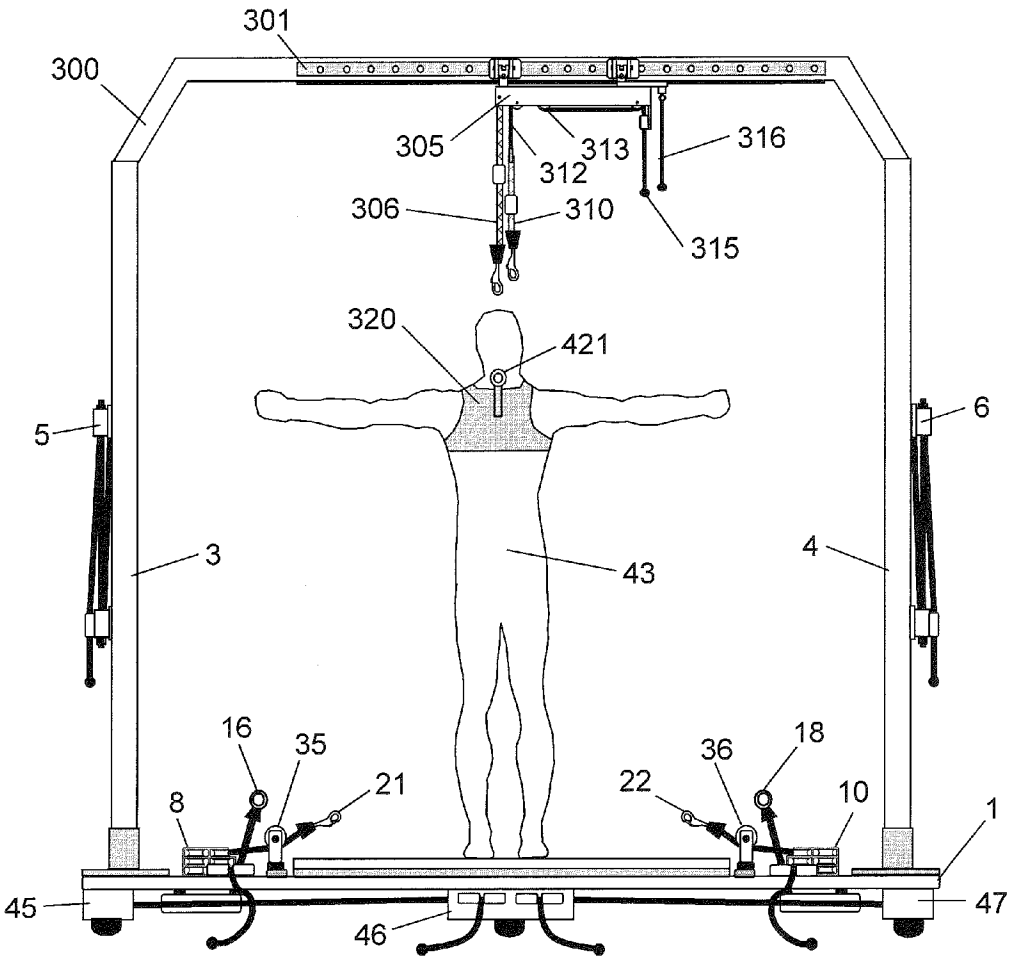
FIG. 29 is a front view of another embodiment of the present disclosure providing training vectors having points of origin variable by direction and elevation to one trainee further providing an overhead support structure.

FIG. 29 is a front view of the embodiment of FIG. 26 illustrating a trainee 43 standing in the exercise area 2. With reference to FIG. 29, the trainee 43 is shown wearing a lift support harness 320 having an attachment means 421 adaptable for attachment to the connector 307, 309 of the safety and hoisting members. The attachment means may comprise any suitable metal ring or rigid structure commonly used in the industry.

Figure 30:
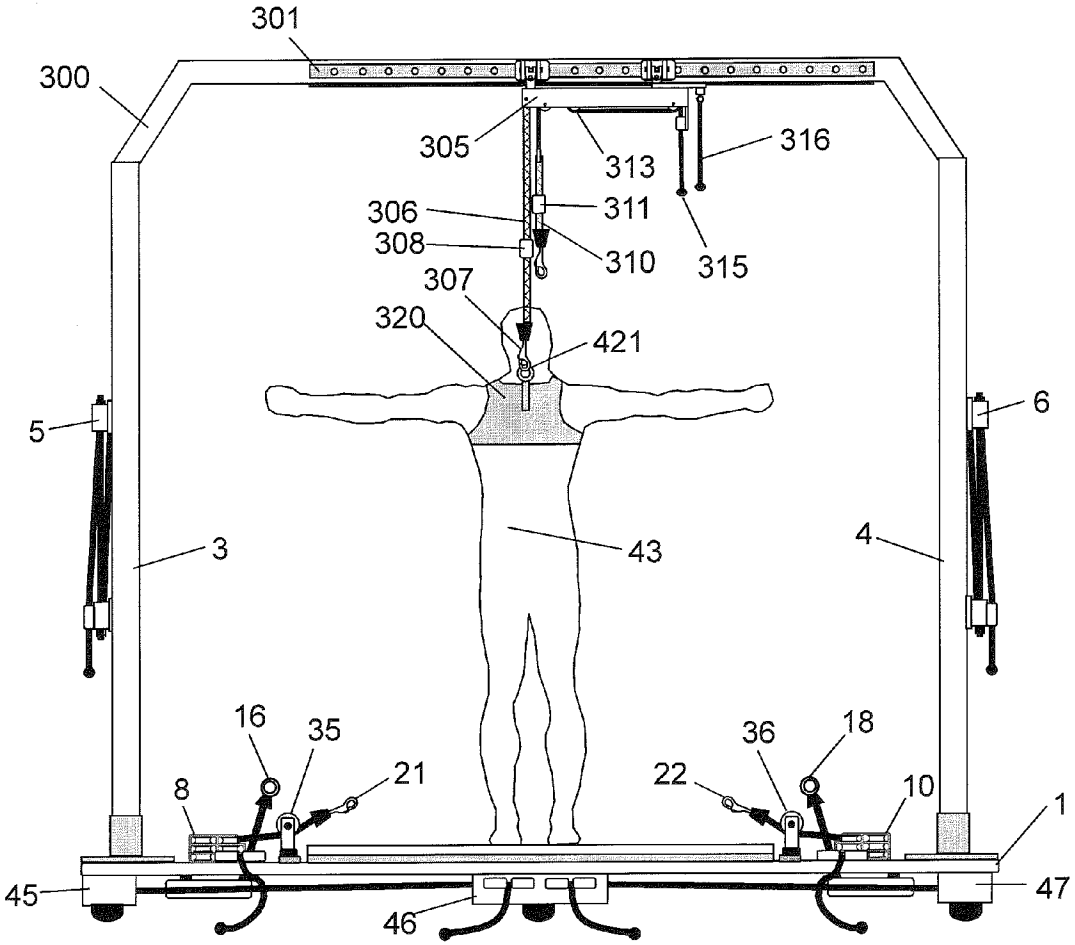
FIGS. 30, 31, 32, and 33 are pictorial illustrations of the attachment, lifting and movement of the trainee to the overhead support structure of the present disclosure.
Figure 31:
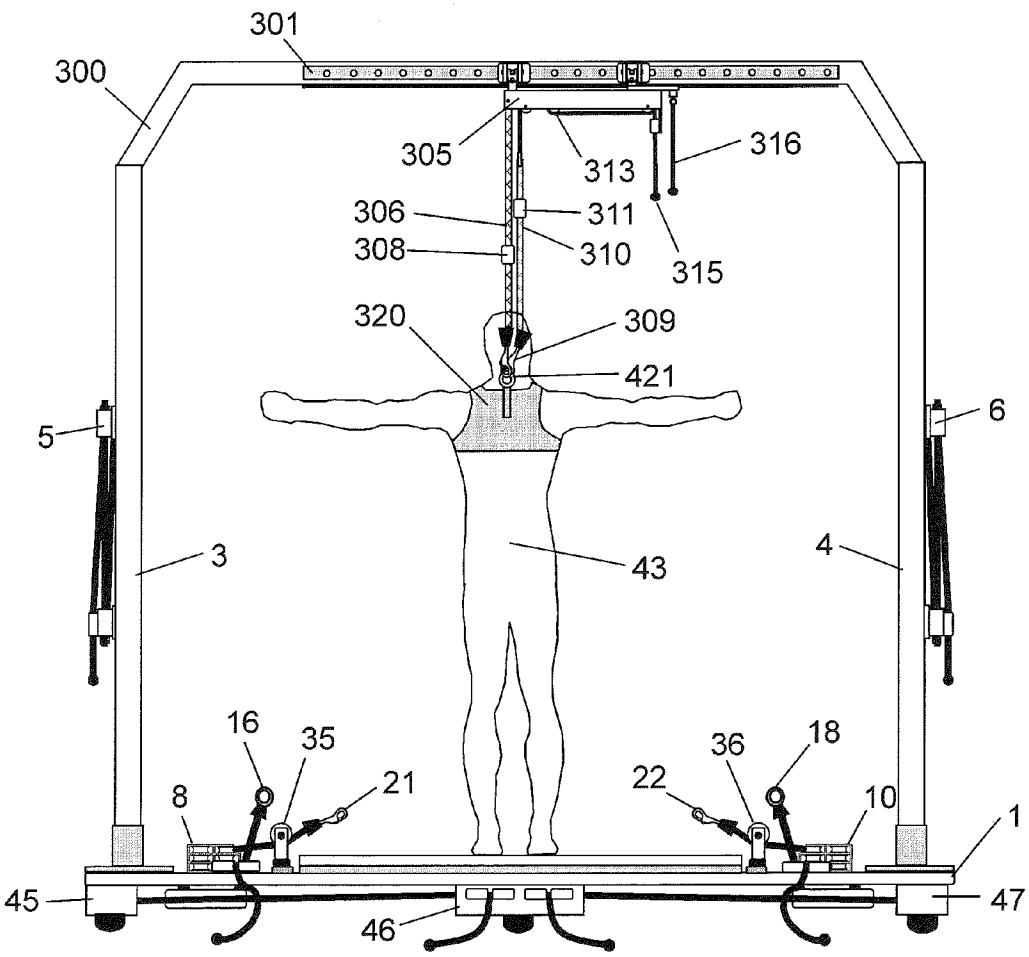

FIGS. 30-33 are pictorial illustrations of the attachment, lifting and movement of the trainee 43 with respect to the overhead support structure 300 of the present disclosure. It should be noted that before any of the safety or hoisting members 306, 310 are attached to the trainee 43, a therapist should lock the trolley assembly 305 in place. With reference to FIG. 30, the safety member 306 is lengthened via the adjustment buckle 308 so that the connector 307 may be connected to the harness attachment means 421. The safety member 306 is then shortened via the buckle 308 until the safety member 306 is taut, thus supporting the trainee 43. With reference to FIG. 31, the hoisting member 310 is then lengthened via the adjustment buckle 311 to allow the connector 309 to connect to the harness attachment means 421. Upon positive connection thereof, the hoisting member 310 is pulled taut via the buckle 311 and a therapist may pull the hoisting cable 315 thus retracting the retracting cable 312 and raising the hoisting member 310.

Figure 32:
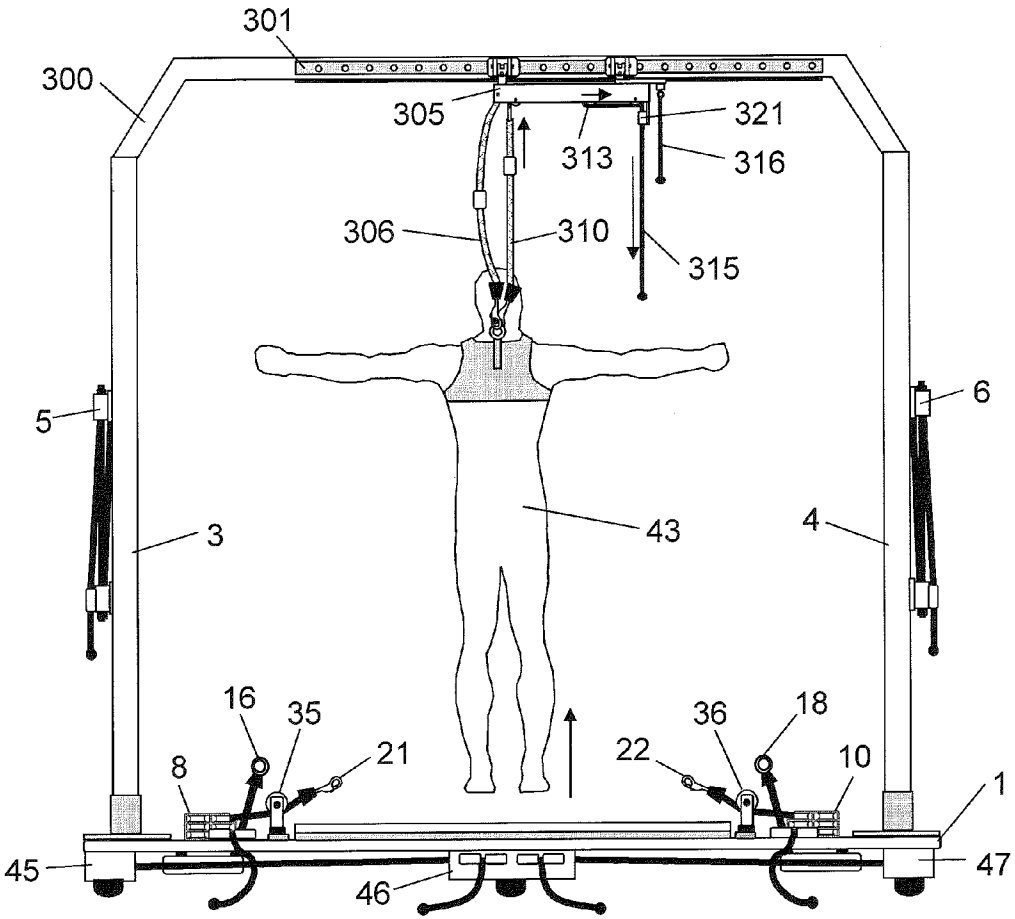
Figure 33:
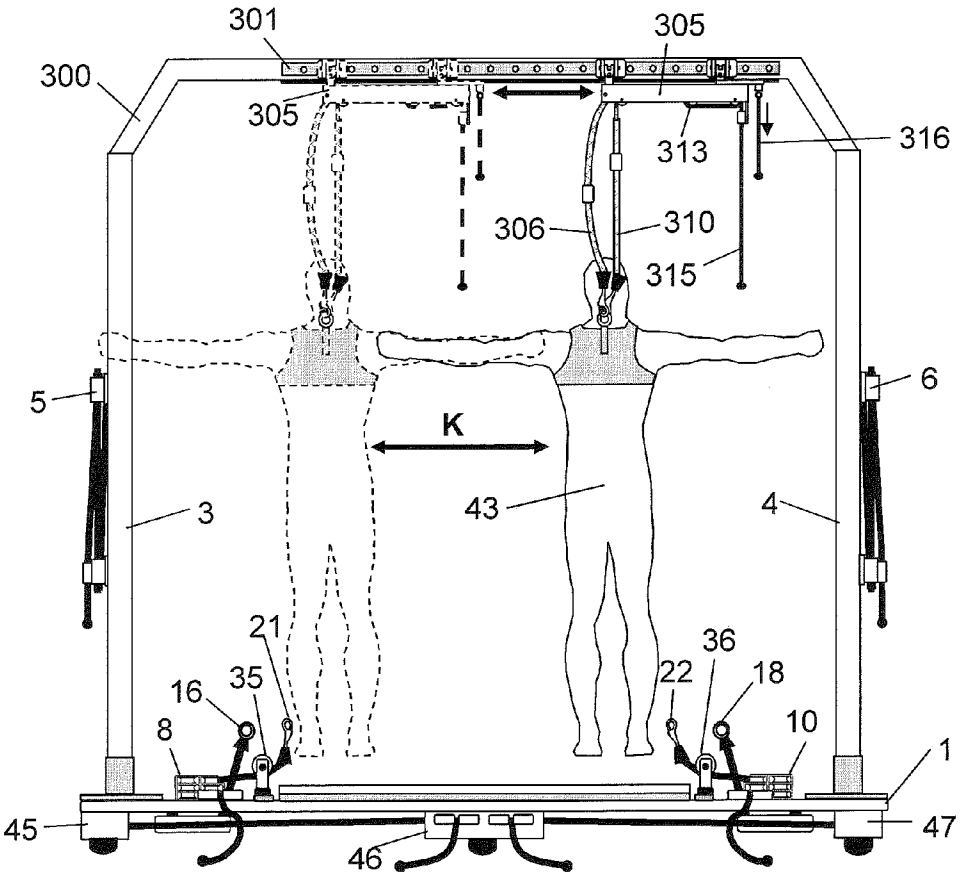

With reference to FIG. 32, once the hoisting member 310 has been attached to the trainee 43 and is taut, the hoisting cable 315 may further be pulled downward thus drawing the sliding pulley assembly 313 to the right and retracting the retracting cable 312 to thereby raise the hoisting member 310 and the trainee 43 connected thereto. The therapist (not shown) may utilize a locking mechanism 321 to secure the hoisting cable 315 once the trainee is lifted to a desired level. As illustrated in FIG. 32, the safety member 306 is slack since the member does not retract into the trolley assembly 305. The therapist, however, has the option of tightening the safety member 306 via the buckle 308. With reference to FIG. 33, a trainee 43, may be moved longitudinally along the rails 301, 301B, 302 in the direction illustrated by the arrow K.

Figure 34:
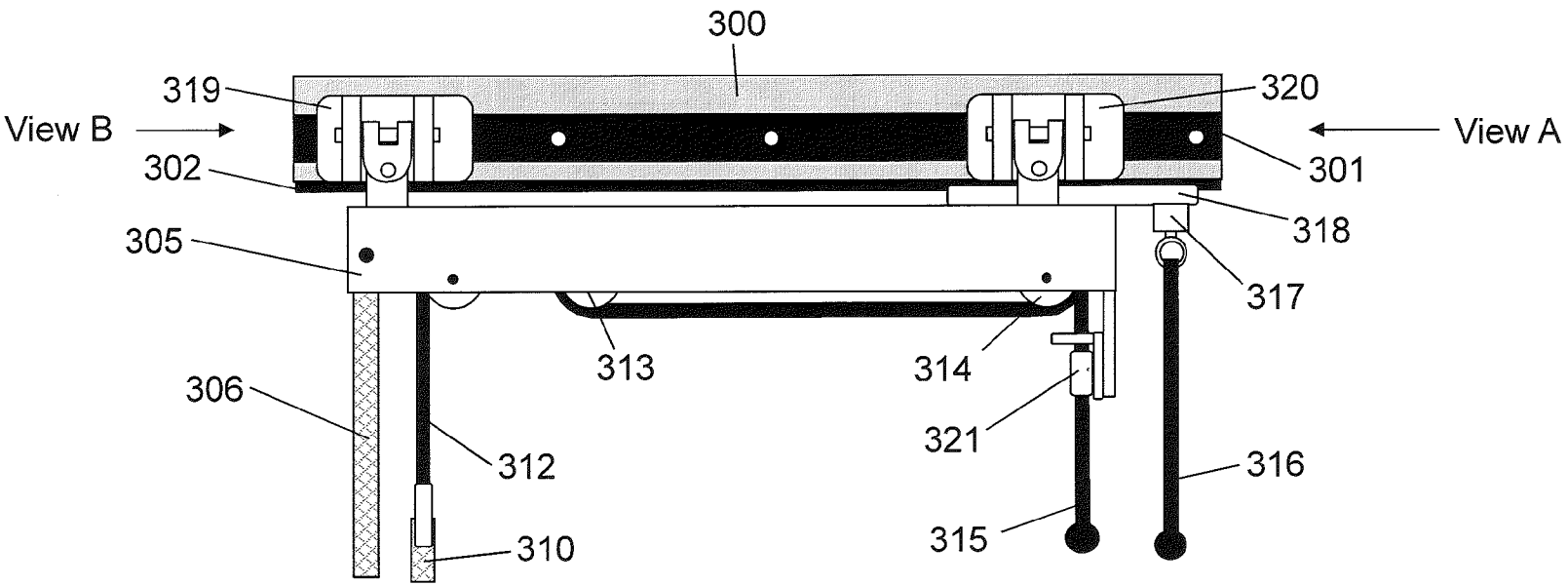
FIG. 34 is a front view of a trolley assembly of the present disclosure.

FIGS. 34-42 illustrate a trolley assembly of the present disclosure. With reference to FIG. 34, the trolley assembly 305 is slideably mounted to the overhead support structure 300 by a plurality of sliding guides 319, 320 and 319B, 320B (not shown). The sliding guides 319, 319B, 320, 320B slide on rails 301, 301B, 302 affixed to the overhead support structure 300. The rails 301, 301B, 302 are slotted so that the trolley assembly 305 may be positioned along the length of the rails 301, 301B, 302. The trolley assembly 305 may also be adaptable to lock in place on the rails 301, 301B, 302 by any suitable locking means such as spring loaded locking mechanisms. One suitable locking means is a locking member 316 operably attached to a locking pin 317. When the locking member 316 is pulled, the trolley assembly 305 is allowed to freely slide along the rails 301, 302. When the locking member 316 is released, the locking pin 317 engages at least one rail and locks the trolley assembly 305 in place. The trolley assembly 305 comprises a fixed pulley assembly 325 which routes a retraction cable 312 from a gliding assembly 323 to a hoisting member 310 having a connector 309 attached thereto for attachment to a harness (not shown) worn by a trainee or patient. A hoisting cable 315 is affixed at one end to the gliding assembly 323 via pulley assemblies 313, 314. An automatic locking means 321 may be utilized to secure movement of the hoisting cable 315 once the trainee 43 has been hoisted to a desired elevation. The locking means 321 may be any suitable type of cam assembly or locking mechanism that securely compresses or grips a member routed therethrough.

Figure 35:
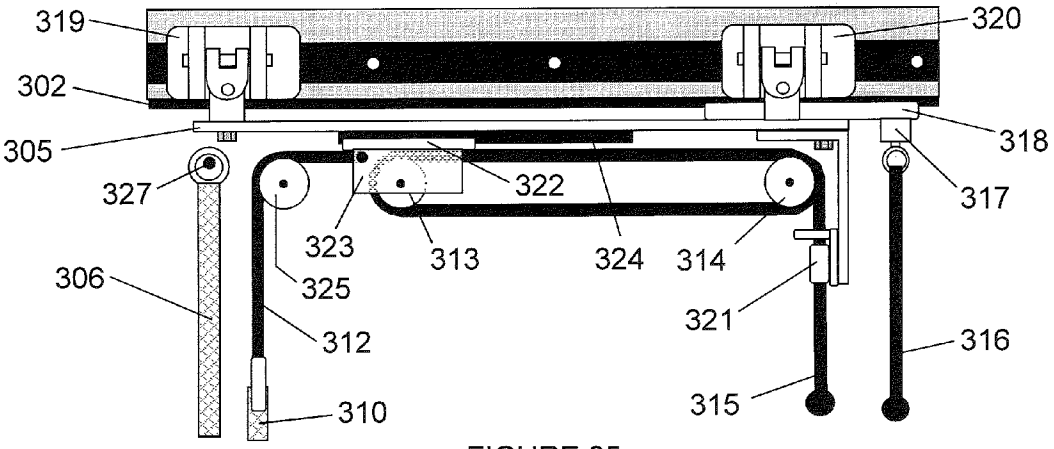
FIGS. 35 and 36 are internal views of the trolley assembly of FIG. 34.
Figure 36:
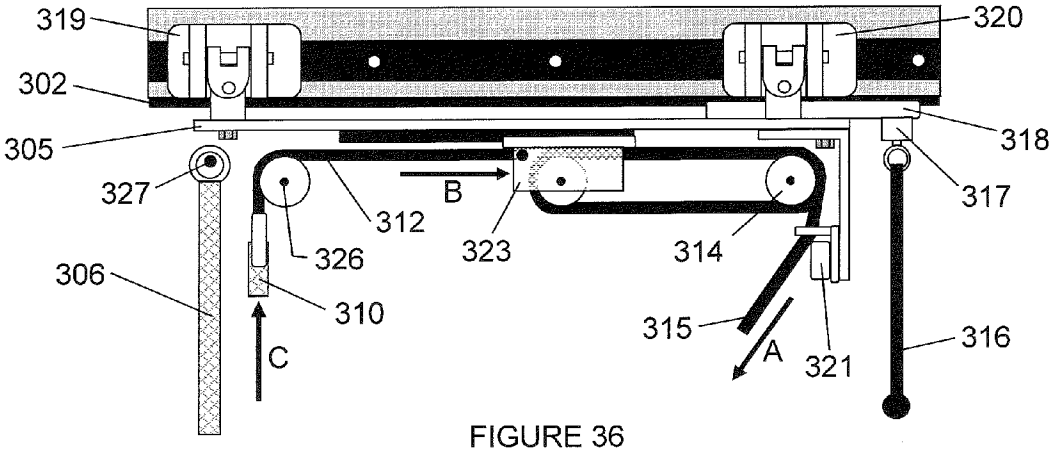

With reference to FIGS. 35 and 36, the outer support cover of the trolley assembly 305 has been removed for illustrative purposes. The safety member 306 is affixed to the trolley assembly 305 via an axle 327. The retractable cable 312 is routed from the hoisting member 310 to the gliding assembly 323 via the fixed pulley assembly 325. The hoisting cable 315 is routed from a distal end thereof to the gliding assembly 323 via the fixed pulley assembly 314 and the slidable pulley assembly 313. The sliding pulley assembly 313 is rotatably mounted to the undercarriage of a gliding assembly 323. The gliding assembly 323 is slidably mounted on a rail 324. The rail 324 is slotted so that the gliding assembly 323 may be linearly positioned along the length of the rail 324 and may be secured in place by a suitable locking mechanism. As illustrated in FIG. 36, a therapist (not shown) may lift a trainee attached to the hoisting member 310 by first disengaging the hoisting cable 315 from the locking mechanism 321 and then pulling the hoisting member 315 in a downward direction illustrated by the arrow A. As the hoisting cable 315 is extracted from the trolley assembly 305, the gliding assembly 323 will move in the direction illustrated by the arrow B, thus approaching the fixed pulley assembly 314. Since the retracting cable 312 is affixed at one end to the gliding assembly 323, the retracting cable will retract the hoisting member 310 in the direction illustrated by the arrow C.

FIG. 37 illustrates a side view of the trolley assembly 305 of FIG. 34 from the aspect identified as view B, and FIG. 38 illustrates a side view of the trolley assembly 305 of FIG. 34 from the aspect identified as view A. With reference to FIGS. 37 and 38, the rails 301, 301B, 302 affixed to the overhead support structure 300 and the sliding glides 319, 319B, 320, 320B which slidably mount the trolley assembly 305 to the overhead support structure 300 are now illustrated.

Figure 39:
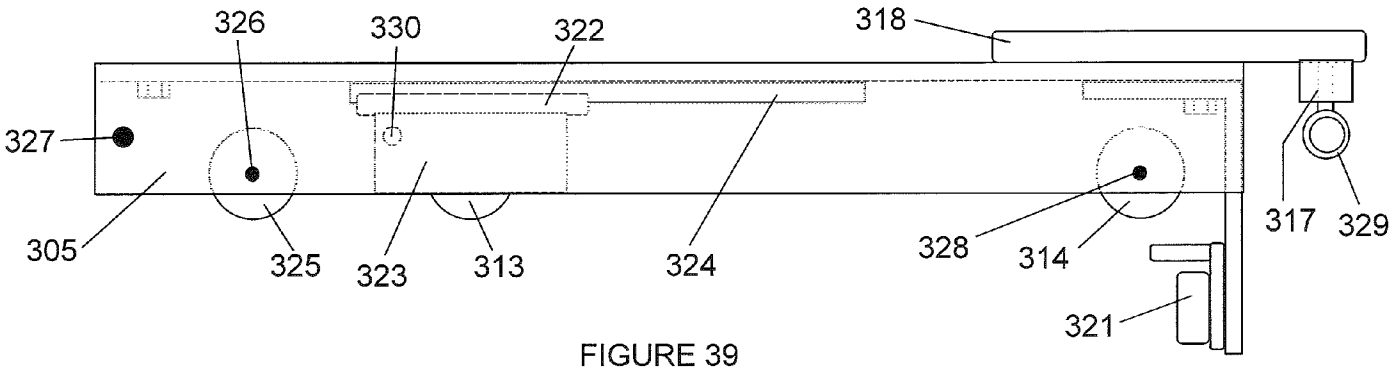
FIG. 39 is another side view of the trolley assembly of FIG. 34.

FIG. 39 is a side view of the trolley assembly 305 having a transparent cover plate for illustrative purposes. With reference to FIG. 39, the axle supports 326-328 for the pulley assemblies 314, 325 and safety member 306 are illustrated. The retracting cable 312 (not shown) may be affixed at one end to the gliding assembly 323 by a rod 330 or other suitable attachment means.

Figure 40:
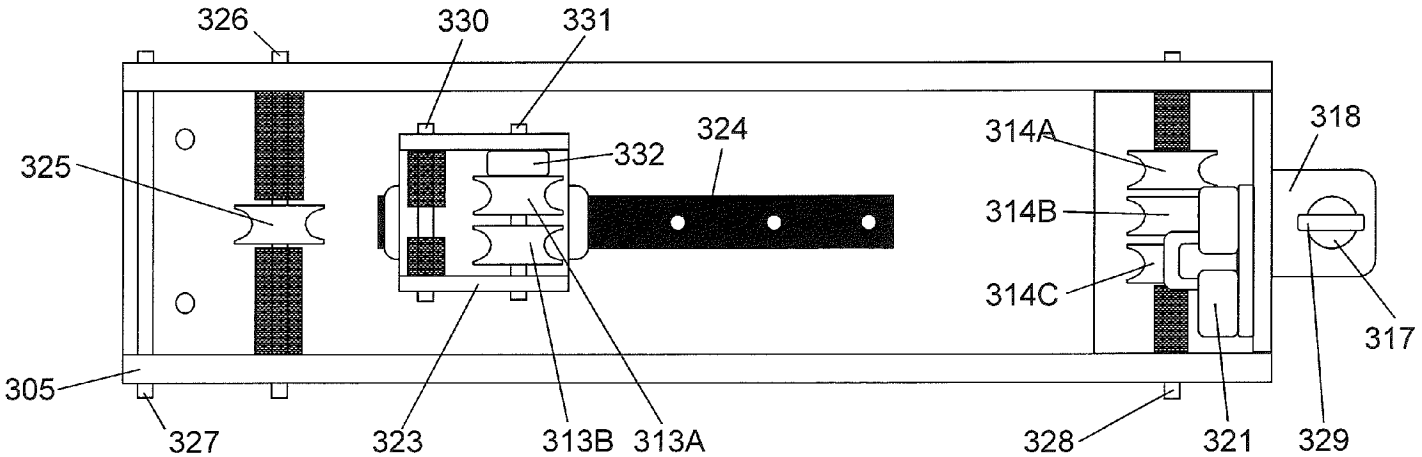
FIGS. 40-42 are a bottom plan views of the trolley assembly of FIG. 34.
Figure 41:
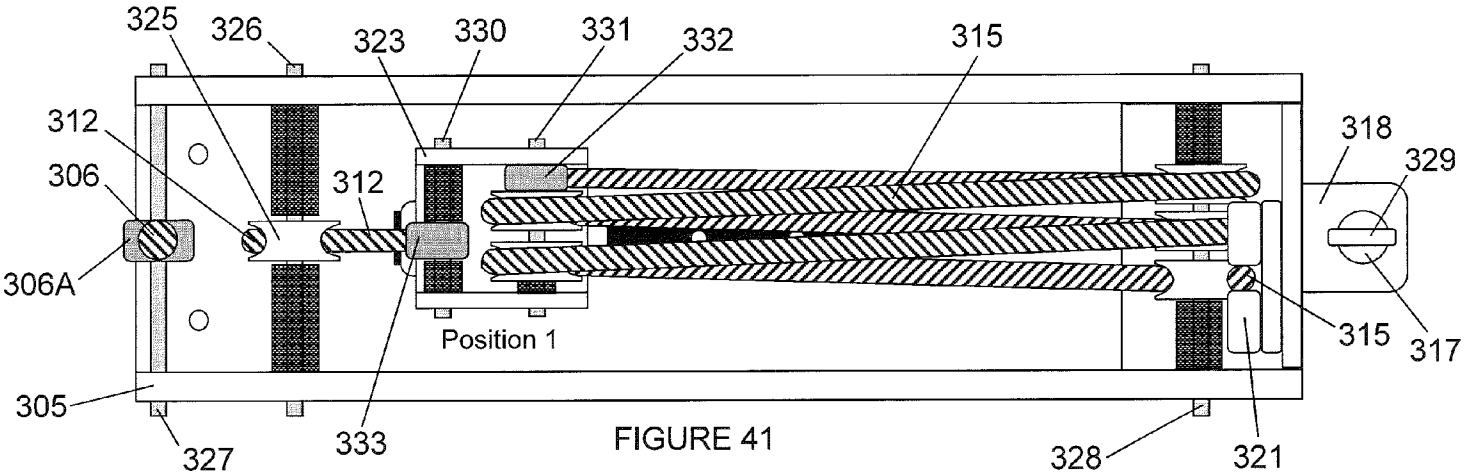
Figure 42:
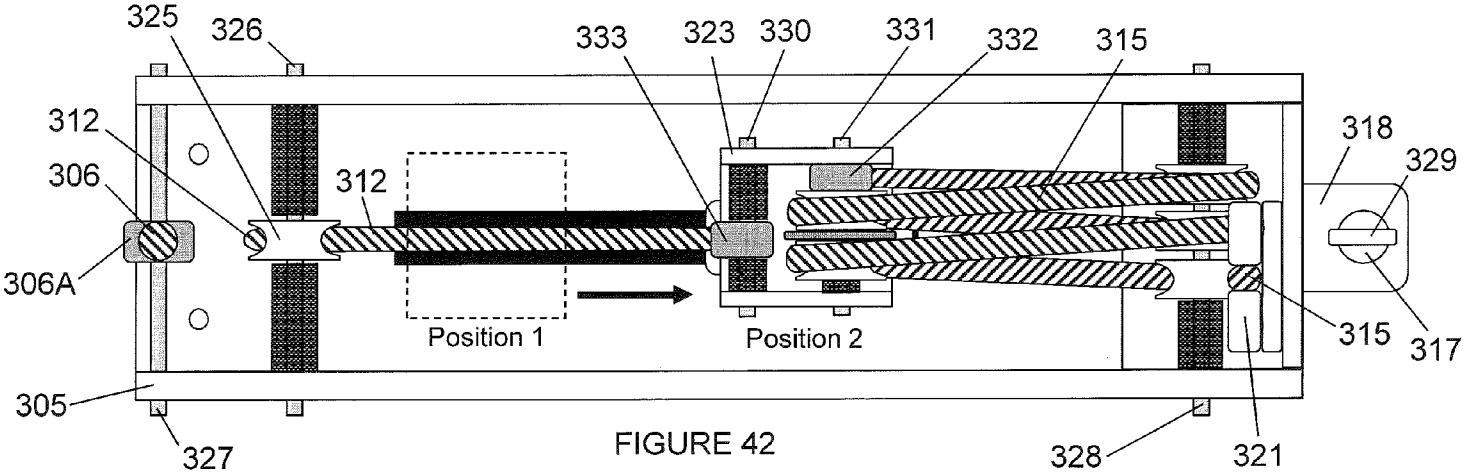

FIGS. 40-42 are bottom plan views of the undercarriage of the trolley assembly 305 of the present invention. With reference to FIGS. 40-42, the slidable pulley assembly is comprised of pulleys 313A, 313B rotatably mounted to the gliding assembly 323 via an axle 331. The gliding assembly 323 further comprises an attachment means 332 for one end of the hoisting cable 315. The fixed pulley assembly 314 may be comprised of pulleys 314A, 314B, 314C rotatably mounted on the trolley assembly 305 via the axle 328. A further view of the locking mechanism 321 for locking the hoisting cable 315 is also illustrated.

With reference to FIGS. 41 and 42, the hoisting cable 315, retracting cable 312 and safety member 306 have been added for illustrative purposes. FIG. 41 illustrates the gliding assembly 323 in a first position with the hoisting cable 315 retracted. FIG. 42 illustrates the gliding assembly 323 in a second position with the hoisting cable 315 extracted. The positions of the gliding assembly 323 shown in FIGS. 41 and 42 are illustrative only and are not intended to limit the scope of the invention. For example, a fully retracted hoisting cable 315 will result in positioning the gliding assembly 323 closer to the fixed pulley assembly 325. Conversely, a fully extracted hoisting cable 315 will result in positioning the gliding assembly 323 closer to the fixed pulley assembly 314. Since the retracting cable 312 is affixed to the gliding assembly 323 via an attachment means 333, operation of the hoisting cable 315, thereby resulting in movement of the gliding assembly 323, will lift a trainee (not shown) attached to the distal end of the hoisting member 310 (not shown). It should be noted that the tracking mechanisms in the trolley assembly 305 may comprise several known pulley configurations capable of providing an increased mechanical advantage to thereby assist a therapist in lifting a heavy load. FIGS. 40-42 illustrate a pulley configuration that provides a 5:1 mechanical advantage. However, there are many obvious configurations that could provide higher or lower mechanical advantages.

According to another aspect of the present disclosure, a physical training apparatus and method are provided for providing training vectors opposing the rotation of the hips and torso of an athlete performing sports specific movements such as swinging a golf club or baseball/softball bat. For example, embodiments of the present subject matter may provide a device with the ability to apply rotational torque to the upper torso or combination of waist and upper torso using resistance members attached to the shoulders, arms, chest, waist or other parts of the body. Additional embodiments may apply a balanced torque to the upper body of a user when standing in the erect position. The direction of the torque in such an embodiment may be set and applied in the clockwise or counter-clockwise direction based on the attachment position of the resistance members. Further embodiments may also allow a user thereof to bend over while torque is applied to the upper body (and waist if desired) without creating a force opposing or aiding the bending motion. This may be accomplished by the embodiment's ability to automatically track a user's upper torso (shoulder position movement) throughout the bending motion and automatically reposition the origin of the resistance elements so they follow the shoulder or torso movement. Another embodiment may also apply torque to the upper torso in a plane parallel to the ground and perpendicular to the spine at shoulder level when the user is standing in the erect position. When the user bends over, the apparatus has the ability to automatically shift the plane of applied torque keeping it perpendicular to the spine at shoulder level at all times. It should be noted that the various configurations and embodiments of the physical training apparatus are illustrated herein with elastic members, however, this should not limit the scope of the claims appended herewith as resistance may be generated by electronic, pneumatic and/or electromechanical means.

Figure 43:
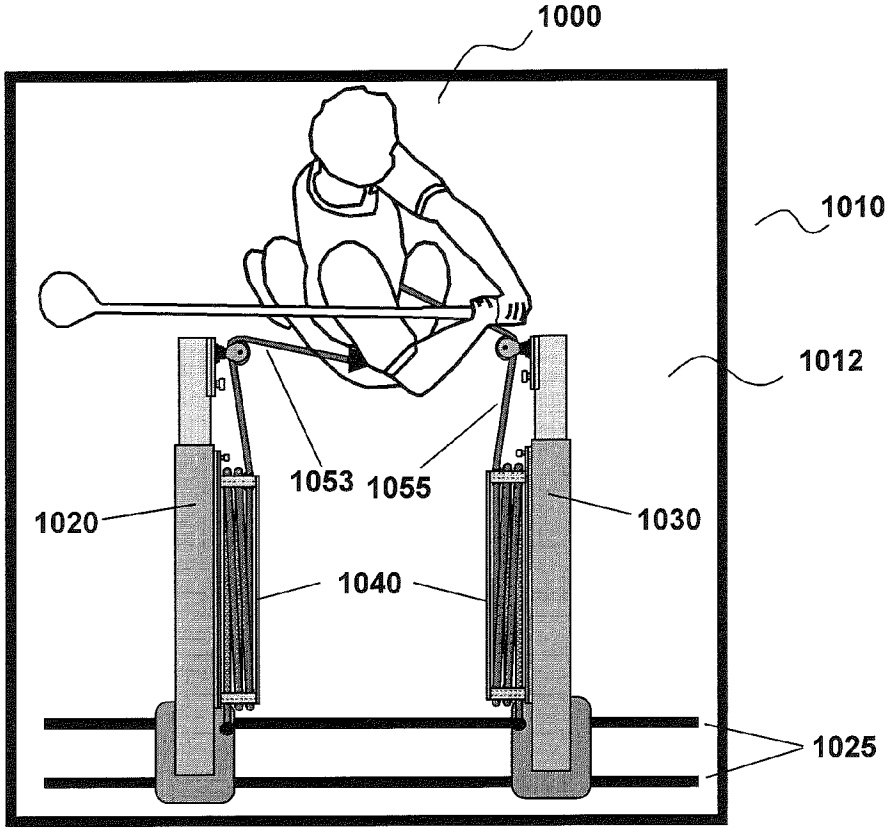
FIG. 43 is a top plan view of an embodiment of the present disclosure with a user performing a golf swing showing a restraining means providing a specified resistance with reference to the user.

With reference to FIG. 43, an embodiment of the present disclosure is shown with a trainee performing a golf swing showing a restraining means providing a specified resistance with reference to the trainee. The physical training apparatus 1010 comprises a platform or base 1012 that forms a training surface on which a trainee 1000 may train. At least two resistance training assemblies 1020, 1030 may be mounted on the base 1012 and provide training vectors that oppose the rotation of the hips of the trainee 1000. The resistance training assemblies 1020, 1030 may also be mounted on rails 1025 affixed to the base 1012 thereby allowing the resistance training assemblies 1020, 1030 to slide linearly to accommodate trainees with various hip widths. The resistance training assemblies 1020, 1030 may also be adaptable to lock in place on the rails 1025. The resistance training assemblies 1020, 1030 include one or more detachable resistance training modules 1040 having an elastic member 1053, 1055. The resistance training assemblies 1020, 1030 may also include telescoping frame members 1024 extending form the distal end of the respective assembly to accommodate user of differing heights. The assembly 1030 provides a training vector to the left hip of the trainee 1000 by attaching the elastic member 1055 to a harness (not shown) worn on the waist of the trainee 1000, and the assembly 1020 provides a training vector to the right hip of the trainee 1000 by attaching the elastic member 1053 to a harness (not shown) worn on the waist of the trainee 1000. Hence, the elastic members 1053, 1055 assist in the rotation of the trainee's hips clockwise into a full coil position just prior to a down swing where counterclockwise uncoiling occurs. As shown in FIG. 43, the elastic members 1053, 1055 aid clockwise movement while resisting counter-clockwise movement. While two rails 1025 have been illustrated, such a depiction should not limit the scope of the claims appended herewith as embodiments may include one rail, no rails, more than two rails, or other suitable means to attach and position the resistance training assemblies 1020, 1030.

Figure 44A:
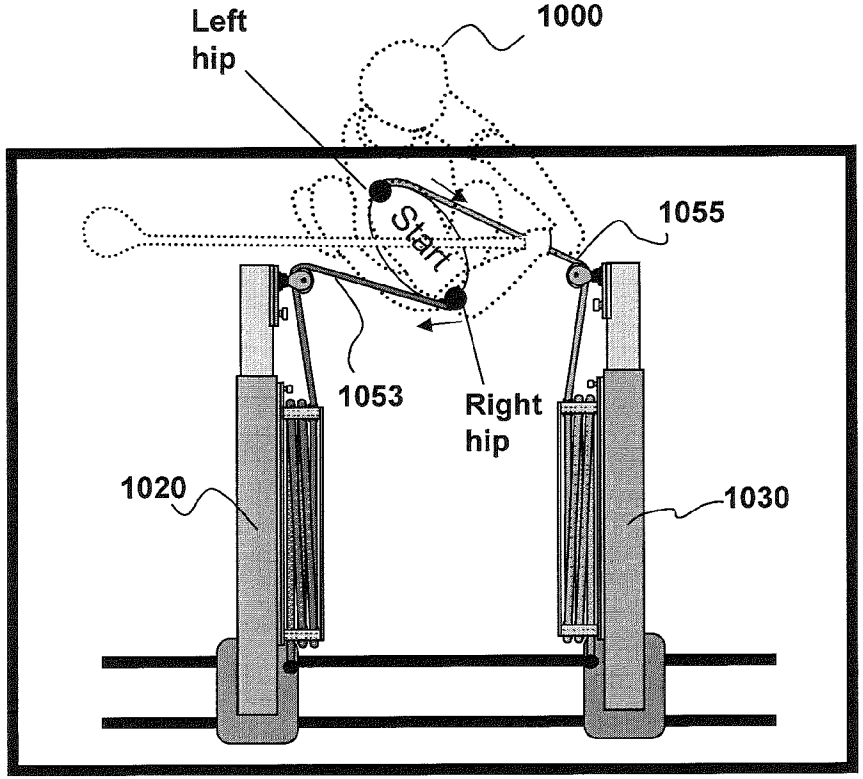
FIGS. 44A and 44B are top plan views of embodiments of the present disclosure with a right-handed user and a left-handed user, respectively, in a backswing position of a golf swing showing a restraining means providing a specified resistance with reference to the user.
Figure 44B:
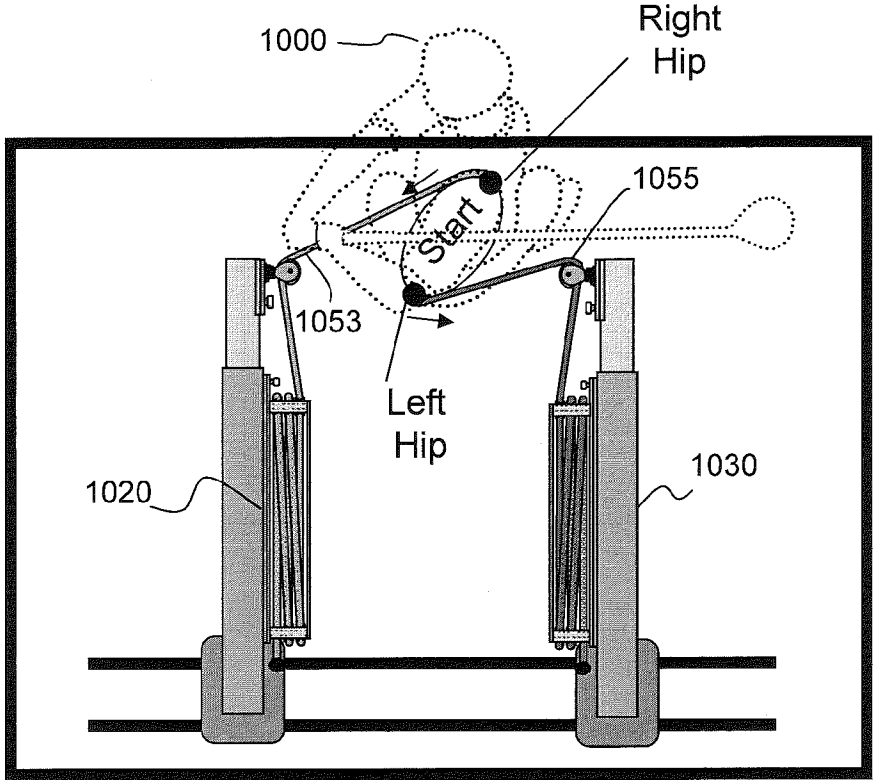
Figure 45:
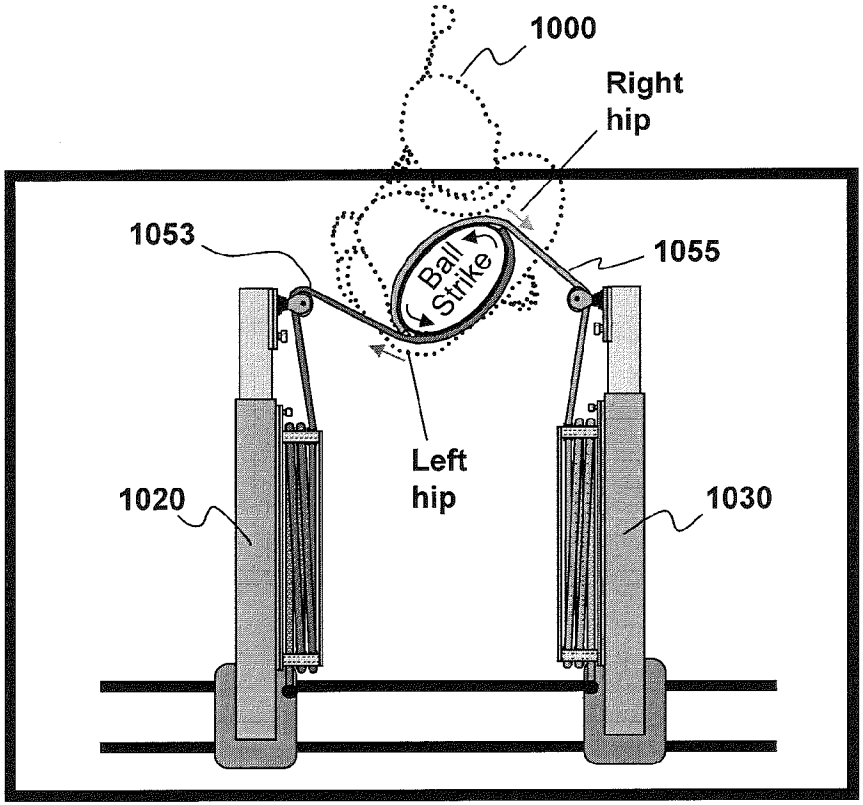
FIG. 45 is a top plan view of an embodiment of the present disclosure with a user in a mid-swing position of a golf swing showing a restraining means providing a specified resistance with reference to the user.
Figure 46:
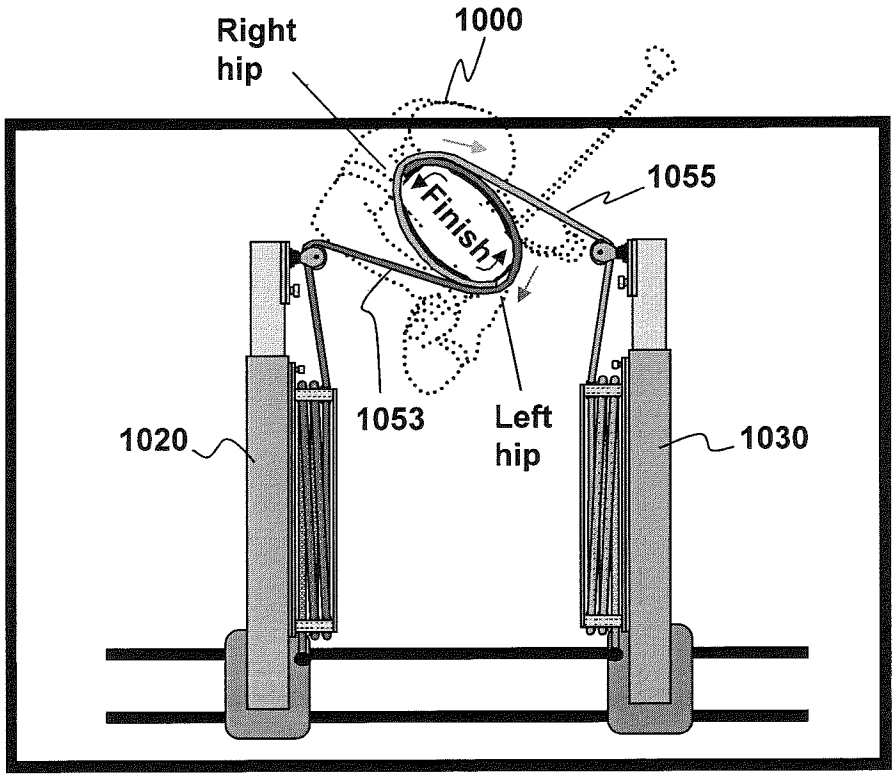
FIG. 46 is a top plan view of an embodiment of the present disclosure with a user in a follow-through position of a golf swing showing a restraining means providing a specified resistance with reference to the user.

FIGS. 44-46 illustrate one embodiment of the physical training apparatus according to the present disclosure providing training vectors to a trainee 1000 at various stages of performing a golf swing. With reference to FIGS. 44-46, the resistance training assemblies 1020, 1030 are positioned so that the assembly 1020 provides a training vector to the right hip of the trainee 1000 by attaching the elastic member 1053 to a harness (not shown) worn on the waist of the trainee 1000. The assembly 1030 provides a training vector to the left hip of the trainee 1000 by attaching the elastic member 1055 to the harness (not shown). As illustrated, the elastic members 1053, 1055 continually apply a force opposing the rotation of the hips of the trainee 1000 from the backswing position of a right-handed user (FIG. 44A) or left-handed user (FIG. 44B) through the mid-swing position (FIG. 45) to the follow-through position (FIG. 46) of a golf swing.

Figure 47:
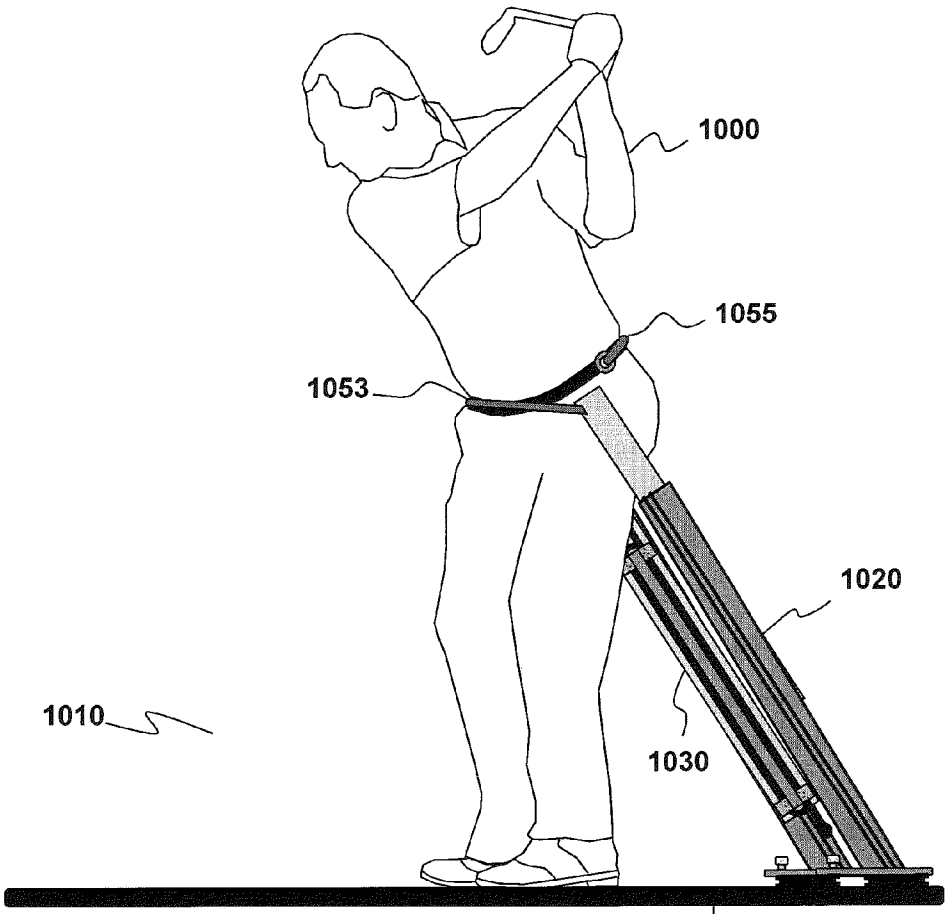
FIG. 47 is a side view of an embodiment of the present disclosure with a user in a backswing position of a golf swing showing a restraining means providing a specified resistance with reference to the user.

FIG. 47 illustrates a side view of the swing training apparatus according to the present disclosure providing training vectors to a trainee 1000 in a backswing position. With reference to FIG. 47, the trainee 1000 is left-handed and the resistance training assemblies 1020, 1030 are positioned so that the assembly 1020 provides a training vector to the right hip of the trainee 1000 by attaching the elastic member 1053 to a harness (not shown) worn on the waist of the trainee 1000. The assembly 1030 provides a training vector to the left hip of the trainee 1000 by attaching the elastic member 1055 to the harness. The elastic members 1053, 1055 may be positioned to assist counter-clockwise movement while resisting clockwise movement.

Figure 48A:
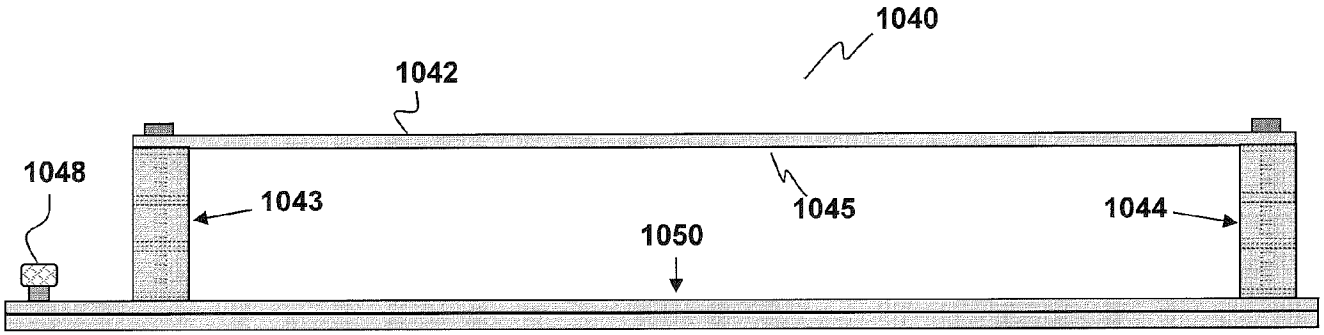
FIGS. 48*a*-48*i* are illustrations of an embodiment of a training module of the present disclosure for providing a training vector to a trainee.
Figure 48C:
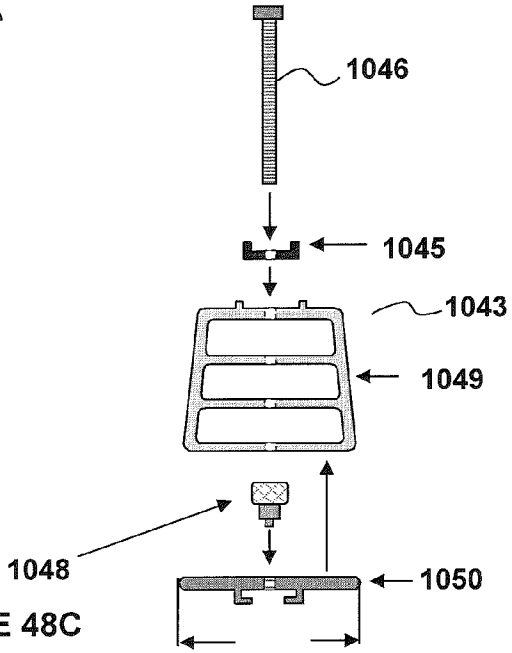
Figure 48B:
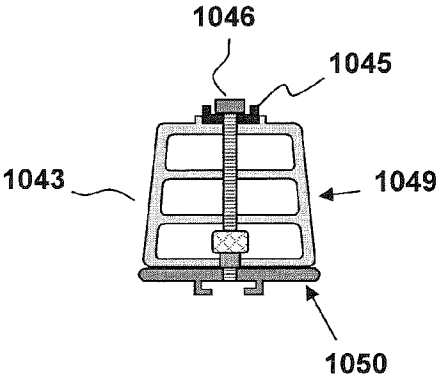
Figure 48D:
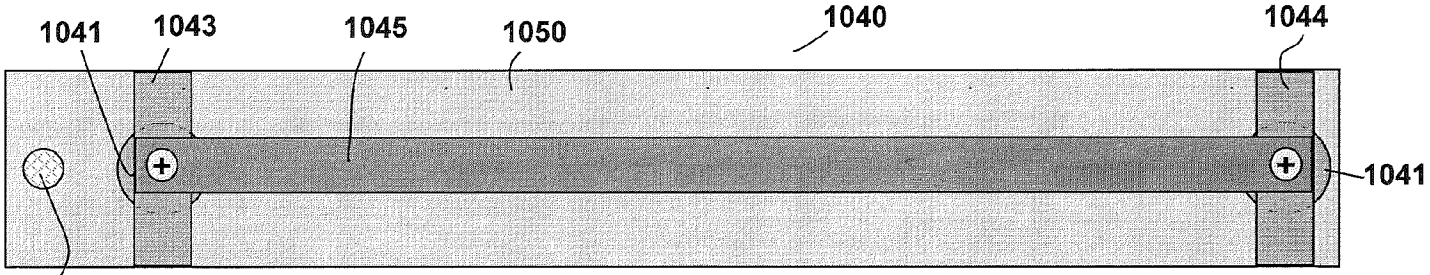
Figure 48E:
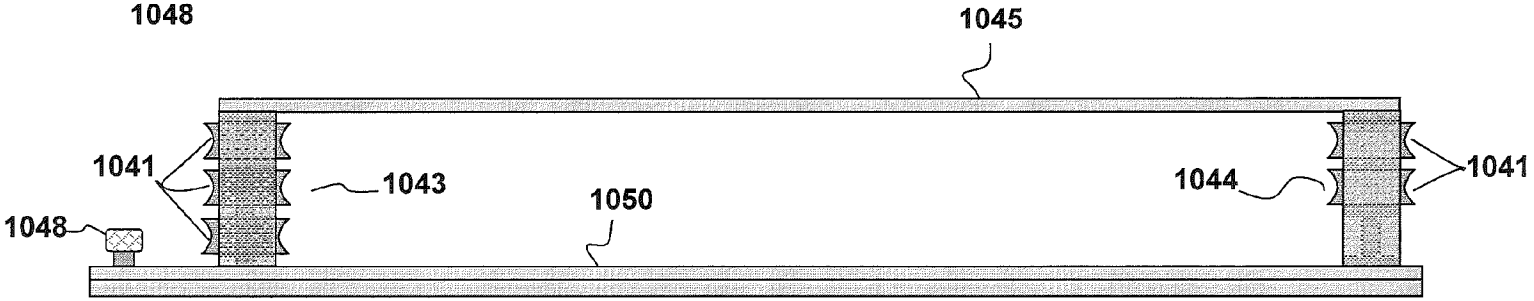
Figure 48F:
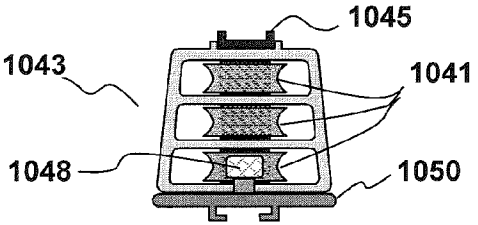
Figure 48G:
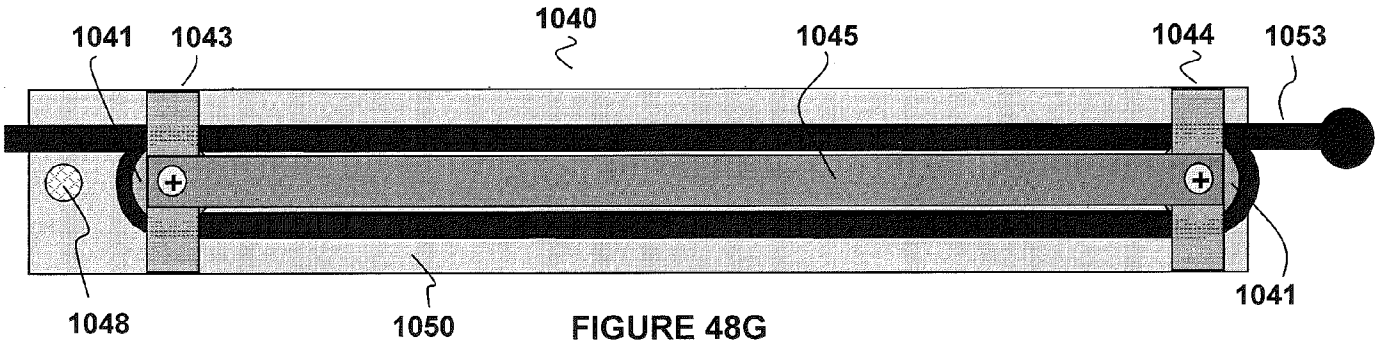
Figure 48H:
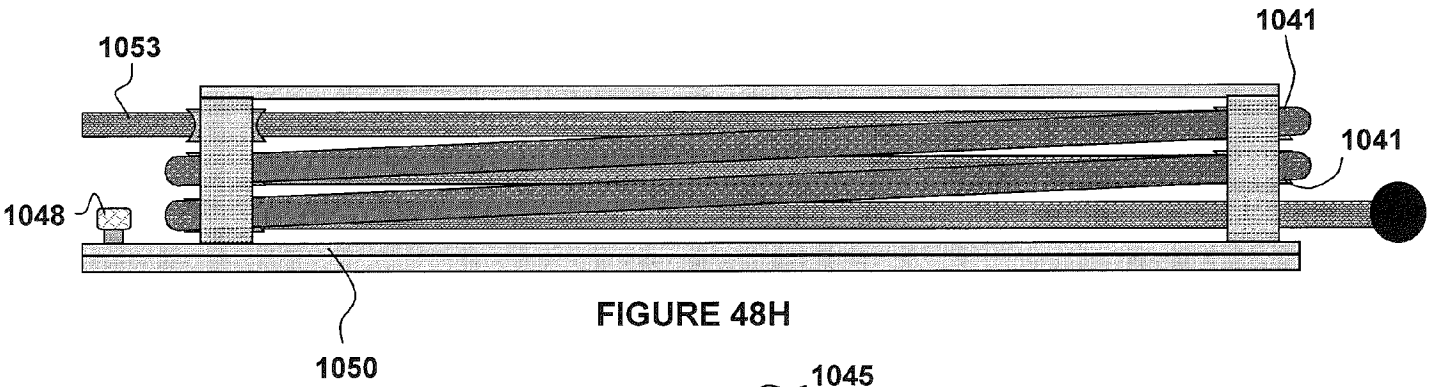
Figure 48I:
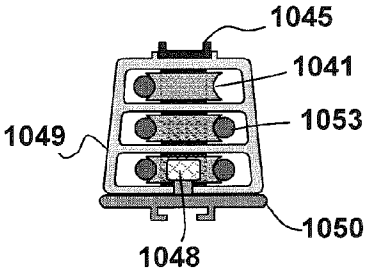

With reference to FIGS. 48*a*-48*i*, the resistance training assemblies 1020, 1030 may include one or more training modules 1040 for providing a training vector. With reference to FIG. 48*a*, the training module 1040 comprises a rigid frame 1042 having an upper elongated member 1045, a support base 1050 and pulley assembly members 1043, 1044. As illustrated in FIGS. 48*b* and 48*c*, each of the pulley assembly members 1043, 1044 includes a securing means such as a securing bolt 1046 to secure a pulley frame 1049 to the support base 1050 and upper elongated member 1045. A spring loaded locking pin 1048 or other type of locking mechanism may be provided to secure the training module 1040 to a resistance training assembly. FIGS. 48*d* and 48*e* illustrate a top and side view, respectively, of the training module 1040 including pulley assemblies 1041. FIG. 48*f* illustrates a pulley assembly member 1043 including pulley assemblies 1041. FIGS. 48*g* and 48*h* illustrate a top and side view, respectively, of the training module 1040 including an elastic member 1053. The pulley assemblies 1041 provide a path for routing the elastic member 1053 therebetween so that an elastic member many times the length of the elongated member 1045 may be contained within the training module 1040. The elastic member 1053 is secured near one end by an anchor (not shown) and may be attached to a connector (not shown) at the opposing end. FIG. 48*i* illustrates a pulley assembly member 1043 including pulley assemblies 1041 and the elastic member 1053.

Suitable anchors such as a cam cleat may be provided to prevent the elastic member 1053 from fully sliding through the training module 1040. Other known methods of anchoring the elastic member 1053 are also envisioned including but not limited to anchor mechanisms mounted on the support base 1050, resistance training assemblies 1020, 1030, or platform 1012 of the of the physical training apparatus 1010. The anchor enables the effective length of the elastic member 1053 in the training module 1040 to be varied to thereby vary the magnitude of the force provided by the elastic member. The range of variance is limited by the diameter of the elastic member. For example, the training module 1040 may include an elastic member with a diameter of ⅜ inches. The effective length of the elastic member may be varied to thereby vary the force provided by the elastic member in the range between about twenty and about forty pounds. By substituting a training module 1040 having an elastic member with a diameter of about 5/16 inches, a useful resistance force range of about four to twenty pounds would be provided. By substituting a training module 1040 having an elastic member with a diameter of about ½ inches, a useful resistance force range of about thirty-five to about sixty pounds would be provided. It is also envisioned that multiple training modules 1040 may be stacked or combined to increase the useful resistance force range.

The effective length of the elastic member 1053, i.e., the length of the member between the anchor and the connector, may be selected by extracting the end of the elastic member 1053 from the training module 1040 proximate to the base 1012 and then securing the elastic member 1053 with the anchor. The magnitude of the training vector will vary with the effective length of the elastic member 1053. The connector may be adapted to be connected to a harness worn around the waist of a trainee. The elastic member 1053 may have sufficient length so that the magnitude of the training vector provided to the trainee wearing the harness varies substantially linearly through the range of motion of the harness. In another embodiment of the present disclosure, a single training module may also include two or more elastic members having different diameters for providing a wider range of resistive force.

Figure 49A:
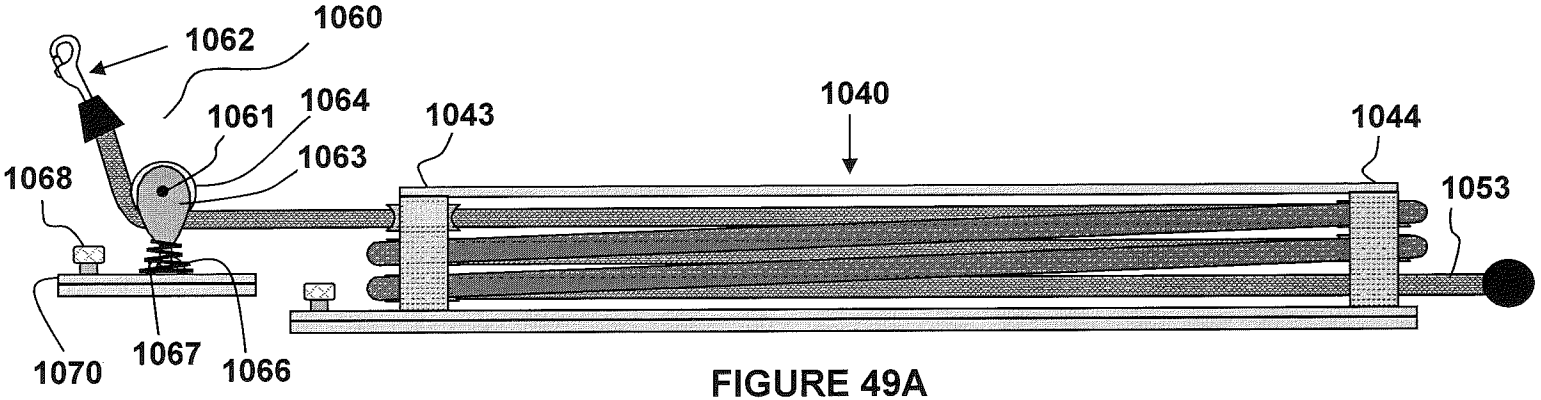
FIGS. 49*a*-49*b* are side and top views, respectively, of the training module of FIGS. 48*a*-48*i* including a redirect pulley assembly.
Figure 49B:
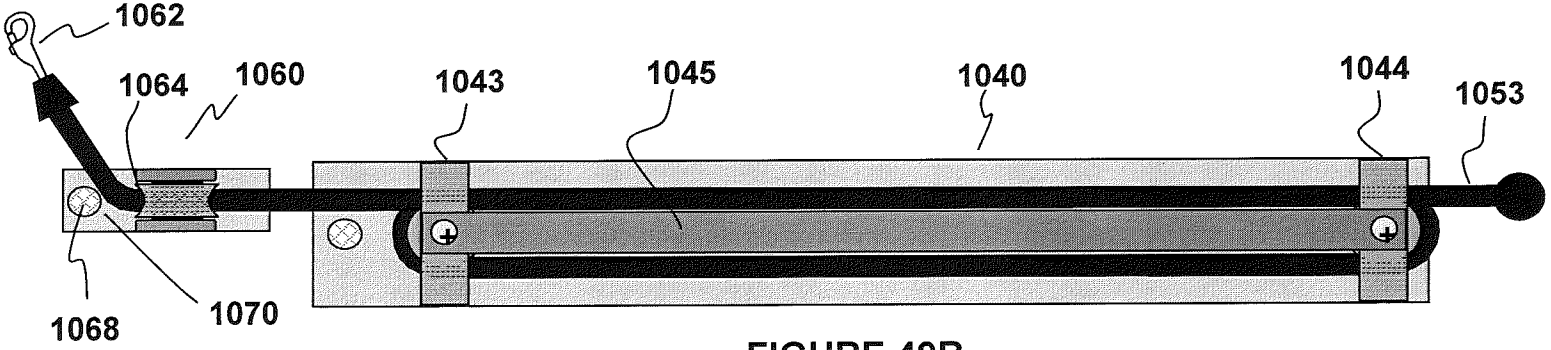

FIGS. 49*a*-49*b* illustrate side and top views, respectively, of the training module 1040 with a redirect pulley assembly 1060. With reference to FIGS. 49*a* and 49*b*, one end of the elastic member 1053 exiting the training module 1040 may be operatively connected to a redirect pulley assembly 1060. The redirect pulley assembly 1060 comprises a pulley 1064 adaptable to rotate about an axis pin 1061 and secured to a mounting bracket 1063 by the pin 1061. The mounting bracket 1063 is connected to a base member 1070 by a suitable connecting means 1066 such as a series of rings or bars securably attached to the base member 1070 and bracket 1063. The connecting means 1066 is surrounded by a spring 1067 which allows for a three-dimensional range of motion for the bracket 1063 and supports an upright or vertical position for the bracket 1063 relative to the base member 1070. The base member 1070 may be secured to a resistance training assembly by a spring loaded locking pin 1068 or other known locking means. The pulley 1064 provides a path for routing the elastic member 1053 from the training module 1040 to a harness worn around the waist or other body portion of a trainee. The elastic member 1053 may be fitted with a connector or spring clasp 1062 adaptable to be connected to the harness. The effective length of the elastic member 1053 may also be varied by changing the relative distance between the redirect pulley assembly 1060 and the respective training module 1040 to thereby vary the magnitude of the training vector provided by the elastic member. Due to the range of motion provided by the redirect pulley assembly 1060, the direction of the training vector will vary depending upon the position of harness worn by the trainee.

Figure 50:
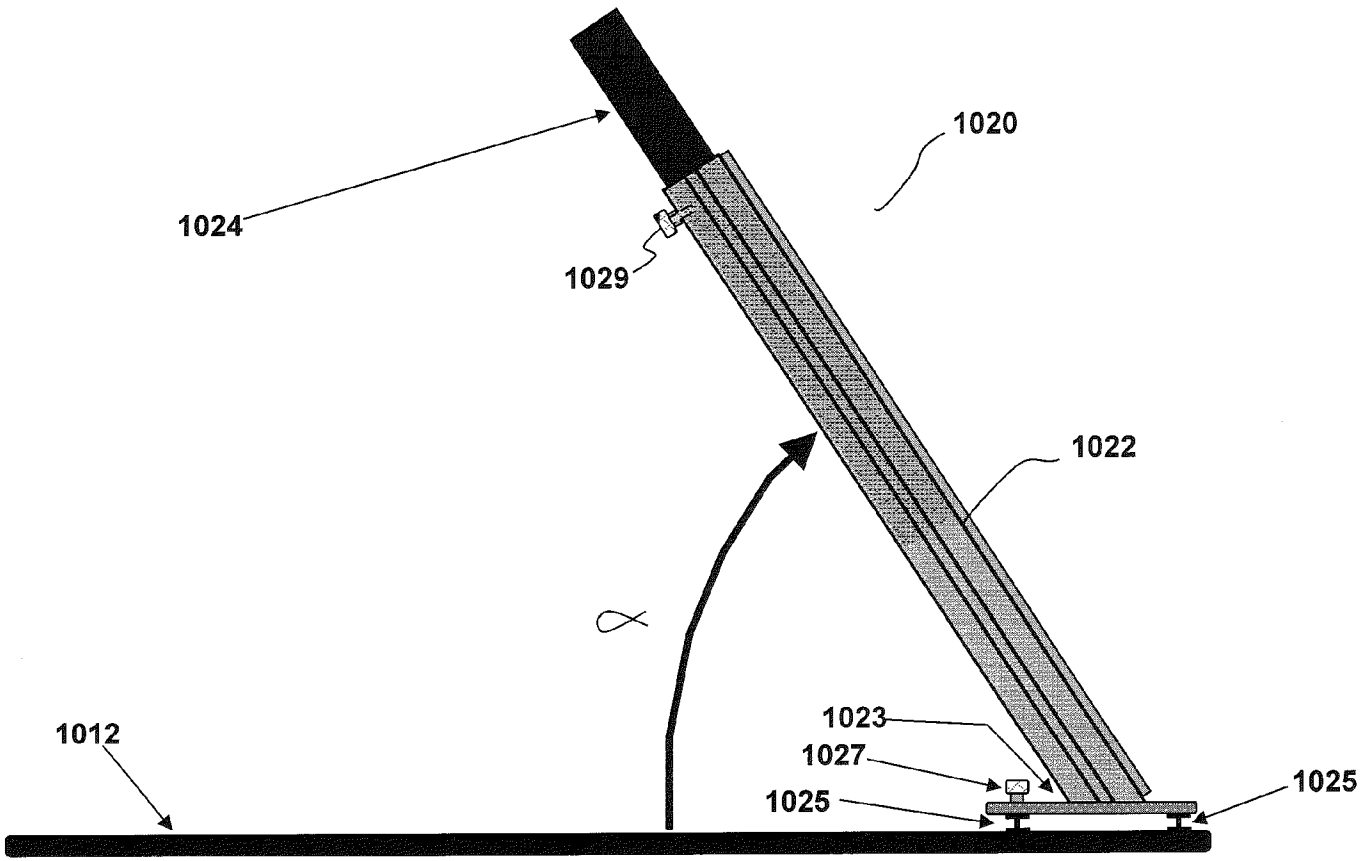
FIG. 50 is a side view of a further embodiment of the physical training apparatus according to the present disclosure.

FIG. 50 illustrates a side view of a further embodiment of the physical training apparatus according to the present disclosure. With reference to FIG. 50, the resistance training assembly 1020 is shown at an angle α with the base 1012. The resistance training assembly 1020 may be formed by mounting a ridged frame member 1022 on a support plate 1023. The position of the telescoping ridged frame member 1022 relative to the base 1012 may be fixed at various positions by known locking means so that the distance between the base 1012 and the ridged frame member 1022 and components thereof may vary. For example, the ridged frame member 1022 includes a telescoping frame member 1024 extending from the distal end of the ridged frame member 1022. Thus, the distal end of the ridged frame member 1022 may be elevated from the base 1012 and secured at an angle α relative to the base 1012. The position of the telescoping frame member 1024 relative to the frame member 1022 may be fixed at various positions with a spring loaded locking pin 1029 or other known locking means so that the distance between the base 1012 and the telescoping frame member 1024 may vary. The support plate 1023 may be operatively connected to rails 1025 affixed to the base 1012 such that the resistance training assembly 1020 slides linearly along the rails 1025 thereby allowing the resistance training assembly 1020 to accommodate trainees with various hip widths. The support plate 1023 may be adaptable to lock in place along the rails 1025 by a spring loaded locking pin 1027 or other known locking means.

Figure 51A:
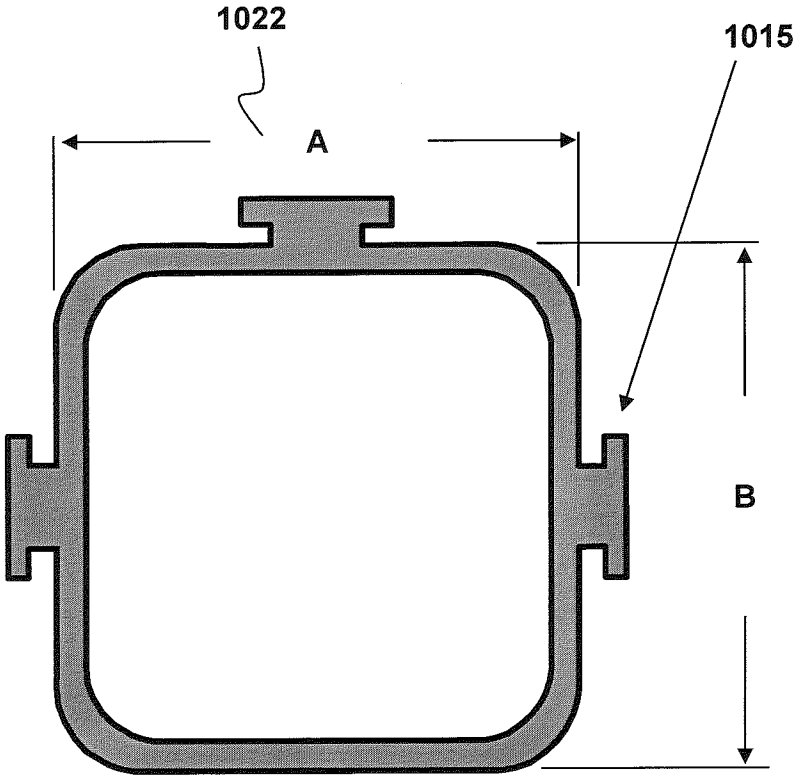
Figure 51B:
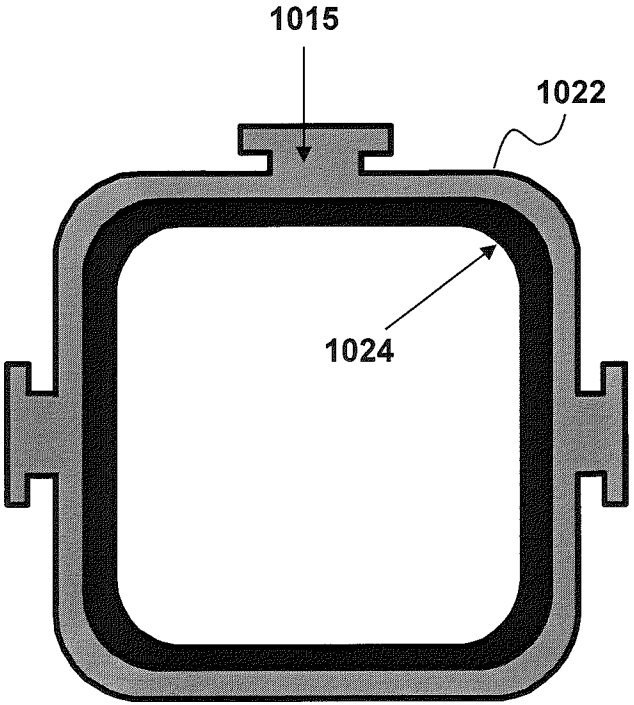

The ridged frame member 1022 may include one or more ridges or tabs 1015 as shown in FIGS. 51*a* and 51*b* upon which a training module 1040 may slide over and lock thereon by a spring loaded locking pin 1048. As illustrated in FIG. 51*a*, the frame member 1022 may have a substantially square cross-section, i.e., the length of side A equals the length of side B. The ridges 1015 extend above the tubular body of the frame member 1022 with sufficient height to allow a training module 1040 to easily slide along the ridge 1015. It is envisioned that multiple training modules may be attached to the frame member 1022. With reference to FIG. 51*b*, the telescoping frame member 1024 has a smaller substantially square cross-section with regard to the ridged frame member 1022.

Figure 52A:
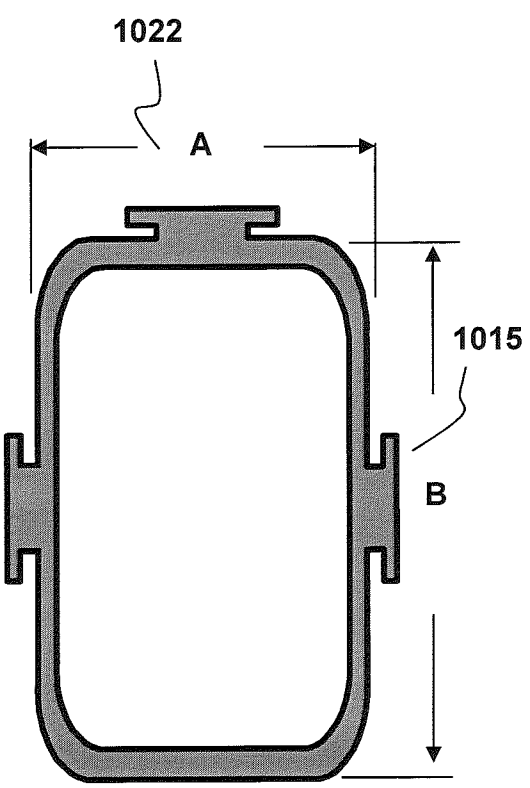
FIGS. 51*a* and 52*a* are cross-sectional views of embodiments of a ridged frame member according to the present disclosure.
Figure 52B:
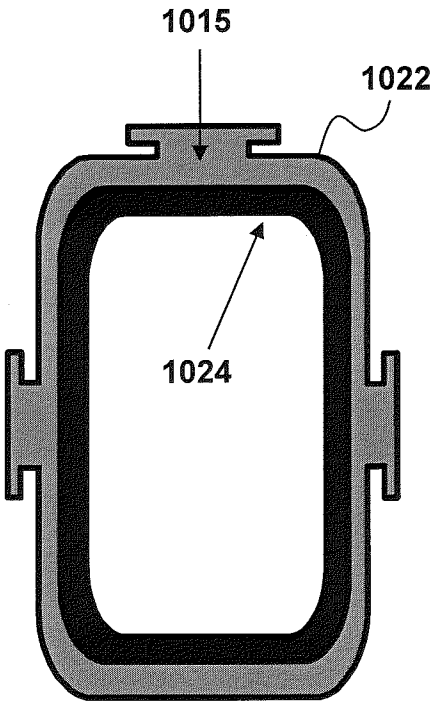
FIGS. 51*b* and 52*b* are cross-sectional views of embodiments of a ridged frame member and telescoping frame member according to the present disclosure.

With reference to FIG. 52*a*, the ridged frame member 1022 may also have a substantially rectangular cross-section, i.e., the length of side A is less than the length of side B. With reference to FIG. 52*b*, the telescoping frame member 1024 has a smaller substantially rectangular cross-section with regard to the ridged frame member 1022. Other geometric cross-sections such as circular, elliptical, and other suitable cross sections are also envisioned for the frame members 1022, 1024.

Figure 53:
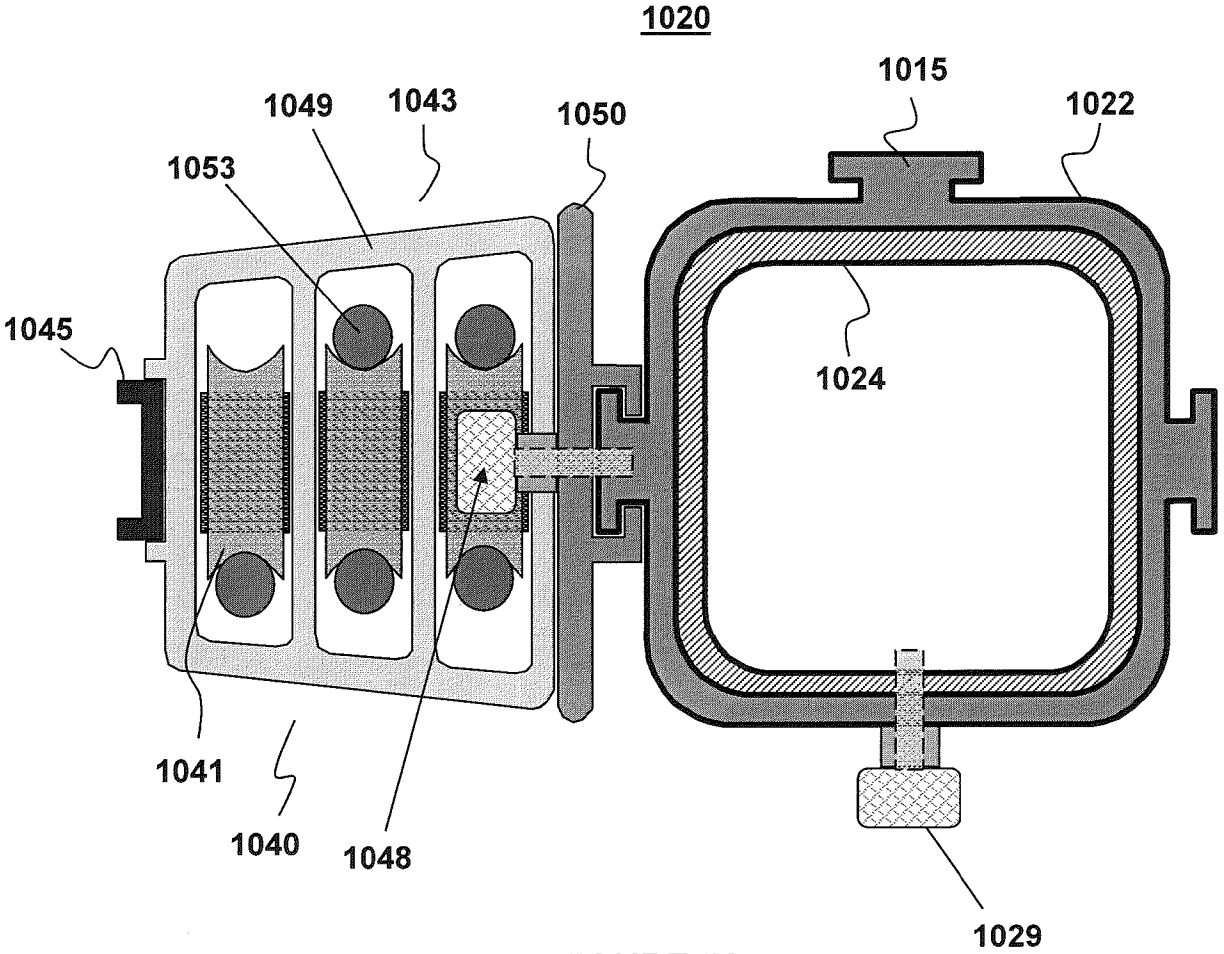
FIG. 53 is a longitudinal view of a resistance training assembly including a training module connected thereon.

FIG. 53 illustrates a longitudinal view of a resistance training assembly 1020 having a training module 1040 connected thereon. With reference to FIG. 53, the resistance training assembly 1020 having a ridged frame member 1022 and a telescoping frame member 1024 may include one or more training modules 1040. The ridged frame member 1022 includes one or more ridges or tabs 1015 for connecting one or more training modules 1040 thereon. The position of the telescoping frame member 1024 relative to the frame member 1022 may be fixed at various positions with the spring loaded locking pin 1029 or other known locking means. The position of the training module 1040 may be fixed at various positions upon the ridged frame member 1022 with the spring loaded locking pin 1048 or other known locking means. As illustrated in FIG. 53, the ridges 1015 extend above the tubular body of the frame member 1022 with sufficient height to allow the training module 40 to easily slide along the ridge 1015 and lock into place.

Figure 54:
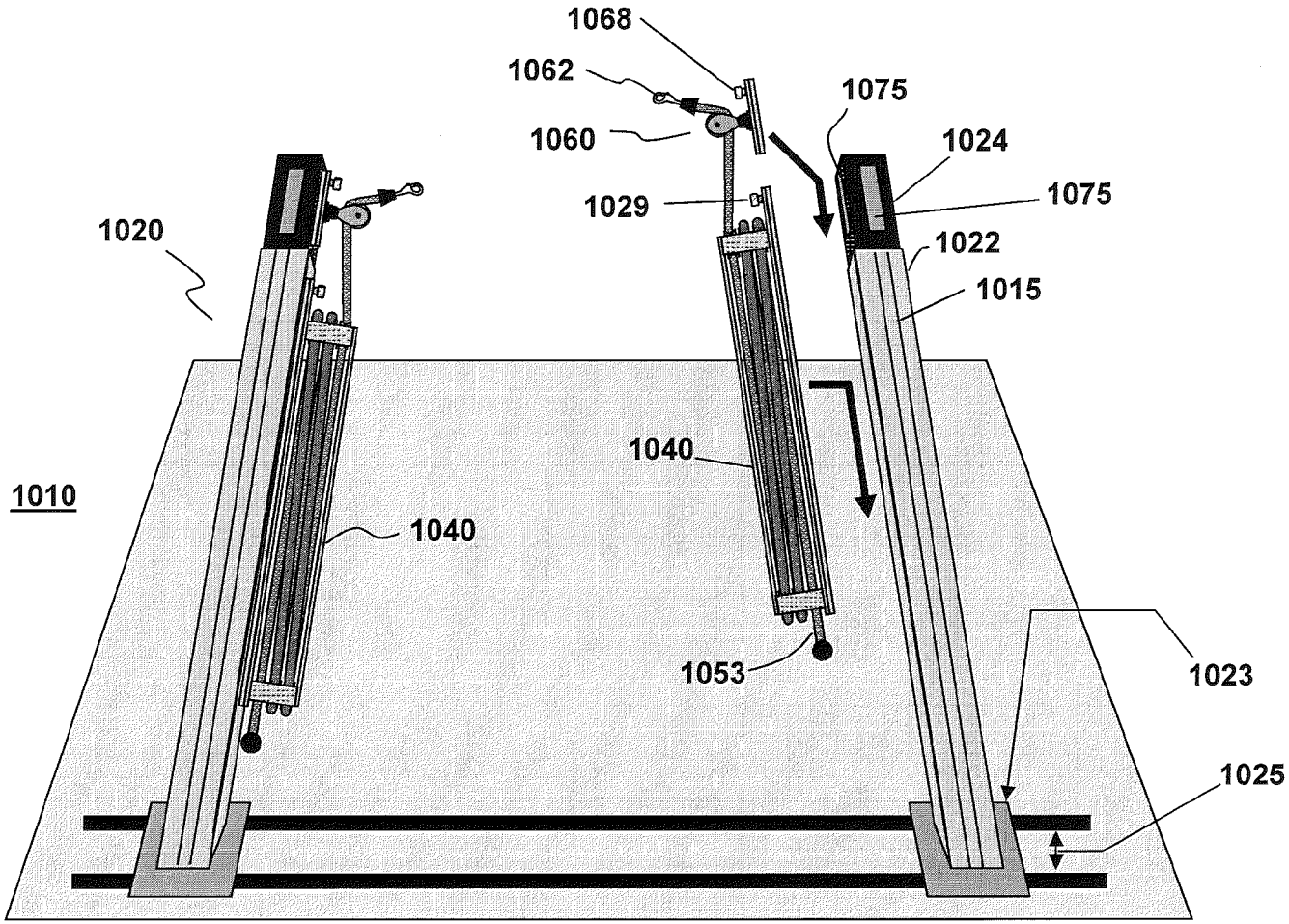
FIG. 54 is an isometric view of an embodiment of the physical training apparatus according to the present disclosure including an attachment means.

FIG. 54 illustrates an isometric view of an embodiment of a physical training apparatus according to the present disclosure including an attachment means so that a training module 1040 may be easily attached or detached to the ridged frame member 1022 and so that a redirect pulley assembly 1060 may be easily attached or detached to the telescoping frame member 1024. With reference to FIG. 54, the telescoping frame member 1024 may be provided with a track 1075 having longitudinal holes (not shown) such that the redirect pulley assembly 1060 may be attached thereon with the spring loaded locking pin 1068 or other known attaching means. The training module 1040 may be affixed to the ridged frame member 1022 by sliding the module 1040 along a ridge 1015 of the frame member 1022 and locking the training module 1040 into place by a locking means such as a spring loaded locking pin 1029. The ridges 1015 of the frame member 1022 may be provided with longitudinal holes (not shown) such that the position of the training module 1040 on the frame member 1022 may be altered thereby changing the effective length of the elastic member 1053, i.e., the length of the member between the anchor (not shown) and the connector 1062, thereby varying the magnitude of the training vector.

Figure 55A:
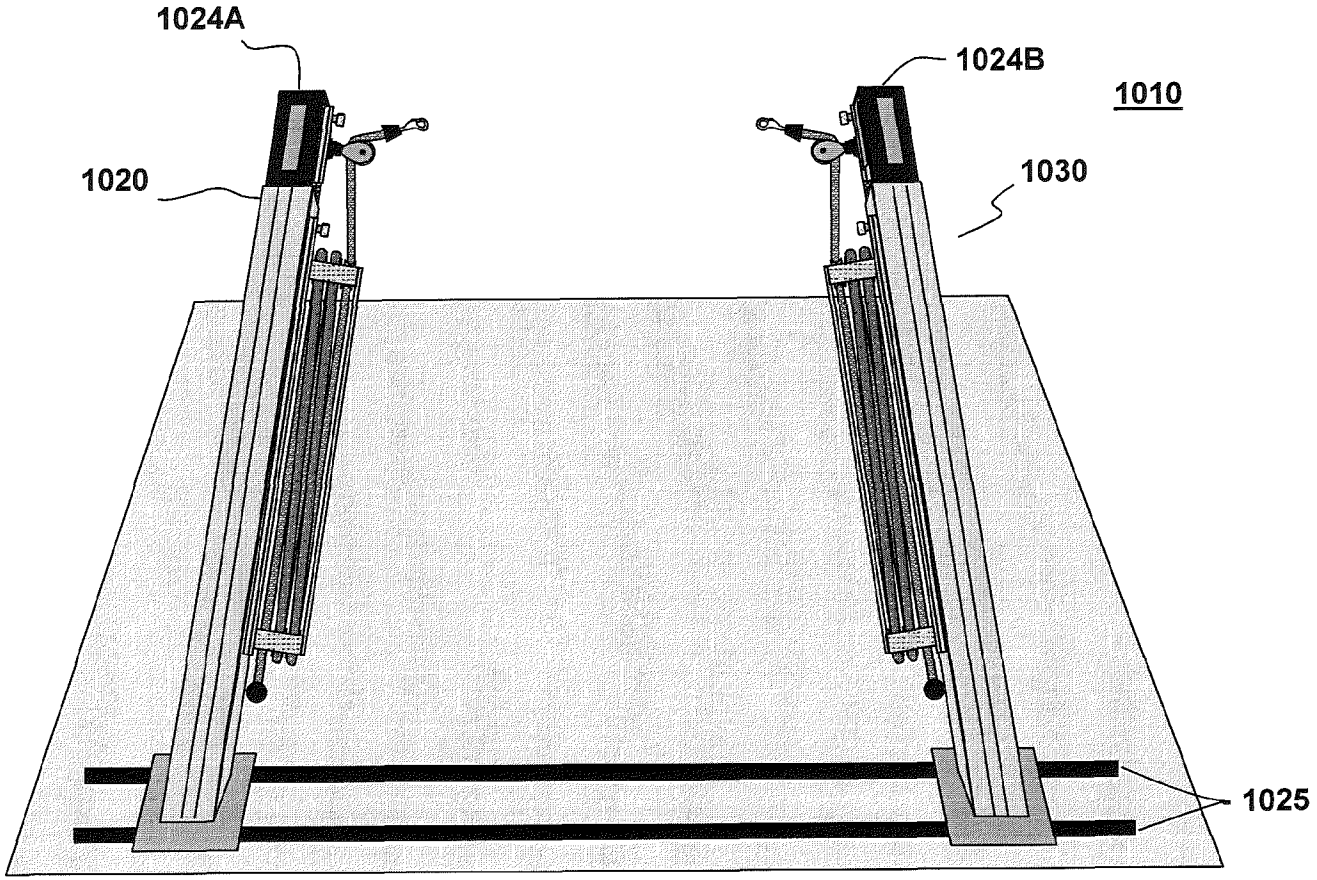
FIGS. 55*a*-55*c* are isometric views of an embodiment of a physical training apparatus according to the present disclosure.
Figure 55C:
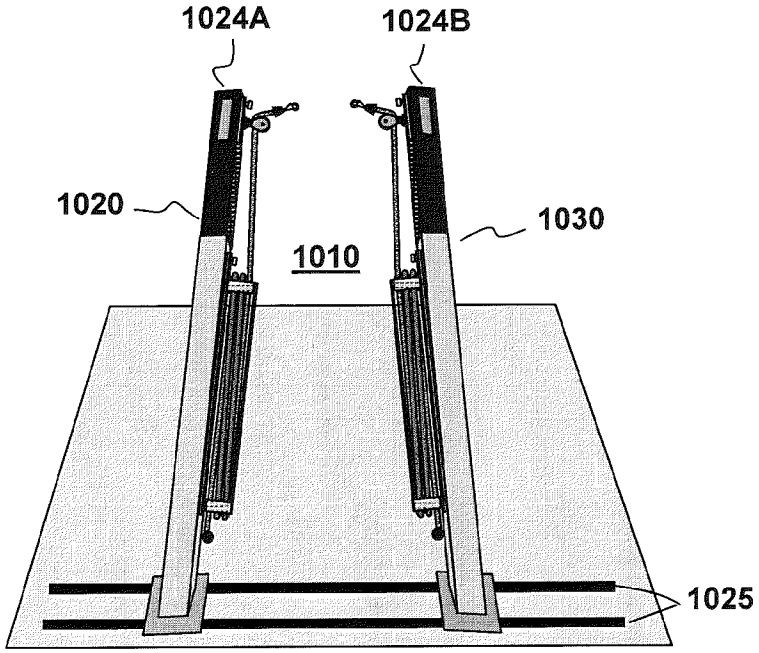
Figure 55B:
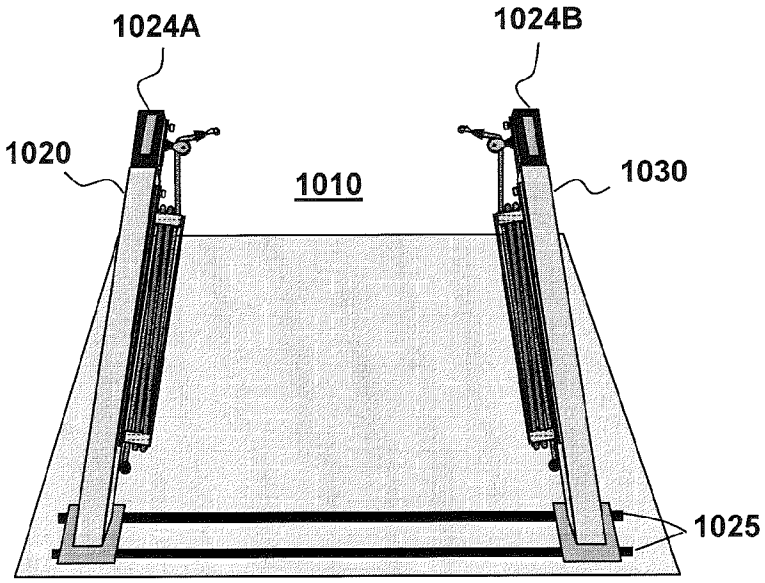

FIGS. 55*a*-55*c* illustrate isometric views of an embodiment of a physical training apparatus according to the present disclosure. With reference to FIG. 55*a*, the resistance training assemblies 1020, 1030 are shown mounted on rails 1025 with the telescoping frame members 1024A and 1024B in a retracted position. FIG. 55*b* shows the resistance training assemblies 1020, 1030 in an extended linear position along the rails 1025 with the telescoping frame members 1024A and 1024B in a retracted position. FIG. 55*c* shows the resistance training assemblies 1020, 1030 in a relatively narrow linear position along the rails 1025 with the telescoping frame members 1024A and 1024B in a telescoped position. The resistance training assemblies 1020, 1030 may be adaptable to lock in place on the rails 1025. Additional support structures (not shown) may be provided to reinforce the resistance training assemblies 1020, 1030 thereby eliminating any substantial instability.

Figures 56A, 56B, 56C, 56D:
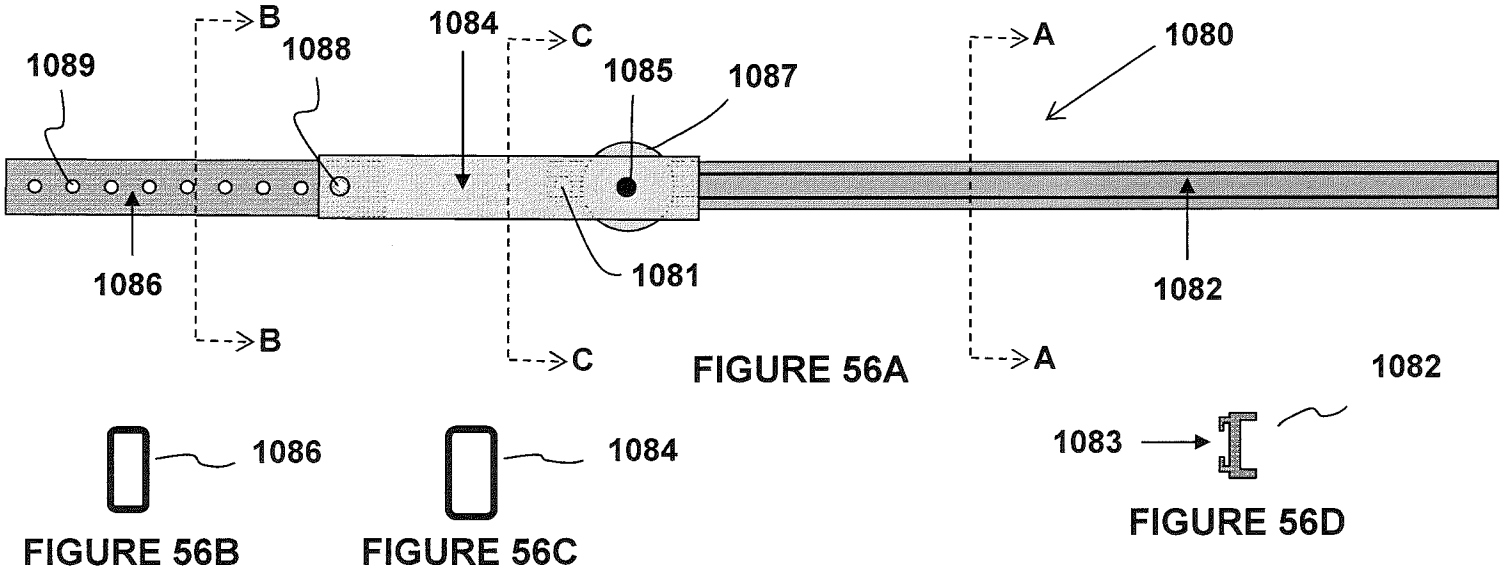
FIG. 56*a* is a side view of an embodiment of a shoulder mast according to the present disclosure.
FIG. 56*b* is a cross-section of a telescoping member along line B-B of the shoulder mast of FIG. 56*a*.
FIG. 56*c* is a cross-section of a second elongated member along line C-C of the shoulder mast of FIG. 56*a*.
FIG. 56*d* is a cross-section of a first elongated member along line A-A of the shoulder mast of FIG. 56*a*.

With reference to FIGS. 56*a*-56*d*, a resistance training assembly may also include a shoulder mast 1080 that allows a trainee to rotationally exercise his or her upper torso when performing various sports motions. FIG. 56*a* illustrates a side view of an embodiment of the shoulder mast 1080 according to the present disclosure. The shoulder mast 1080 includes a first elongated member 1082 that is adaptable to slide on a ridge or tab 1015 of a ridged frame member 1022. The first elongated member 1082 may have an attaching means such as an attachment groove 1083 permitting the first elongated member 1082 to slide on the frame member 1022. FIG. 56*d* illustrates a cross-section of the first elongated member 1082 along line A-A showing the attachment groove 1083. The first elongated member 1082 may be locked to the resistance training assembly 1020 by a spring loaded locking pin 1081 or other known locking means. A second elongated member 1084 having a telescoping elongated member 1086 is connected to the first elongated member 1082 by an axis pin 1085. The axis pin 1085 permits the second elongated member 1084 to rotate about an axis perpendicular to the first elongated member 1082. It may also be desirable to separate the first and second elongated members 1082, 1084 with washers 1087 to thereby prevent excess wear between the members 1082, 1084.

The position of the telescoping elongated member 1086 relative to the second elongated member 1084 may be fixed at various positions by an adjustment means such as a spring loaded locking pin 1088 so that the distance between the distal end of the telescoping member 1086 and the base 1012 of the physical training apparatus 1010 may be adjusted according to the shoulder height of a trainee. Longitudinal holes 1089 may also be provided in the telescoping member 1086 to assist in locking the position of the telescoping member 1086 relative to the second elongated member 1084. FIG. 56*b* illustrates a cross-section of the telescoping member 1086 along line B-B. FIG. 56*c* illustrates a cross-section of the second elongated member 1084 along line C-C. The profiles or cross-sections of the first, second and telescoping members 1082, 1084 and 1086 as illustrated in FIGS. 56*b*-56*d* are shown for illustrative purposes and may be any suitable geometric cross-section.

Figure 57A:
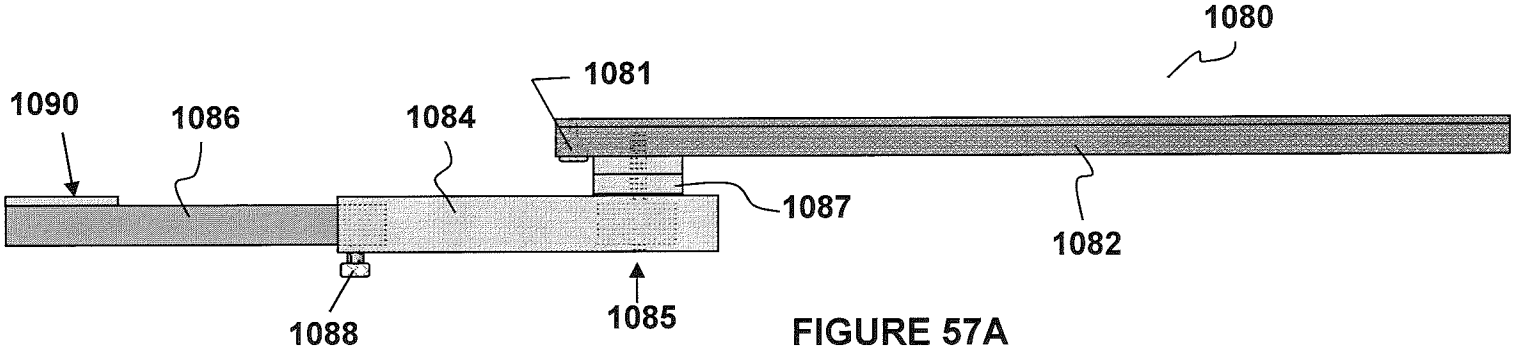
FIGS. 57*a*-57*c* are illustrations of various positions of the shoulder mast of FIG. 56*a* according to the present disclosure.
Figure 57B:
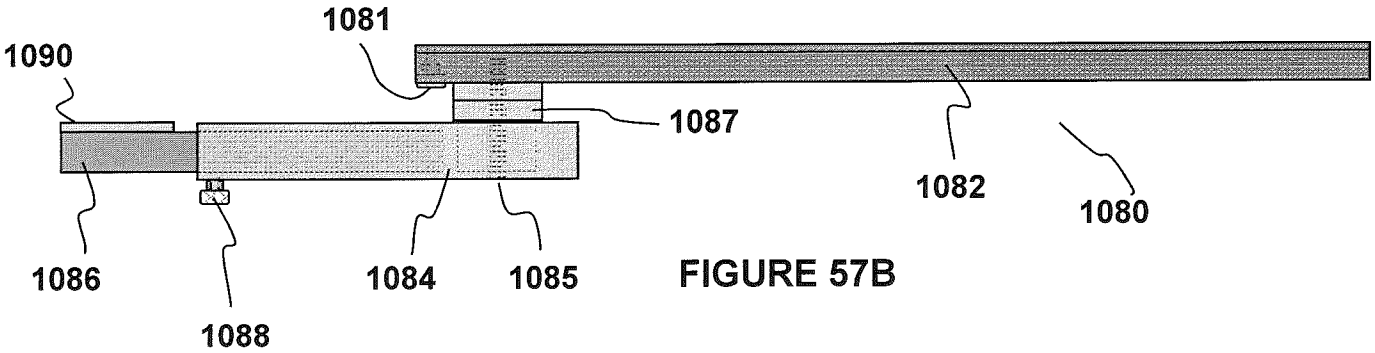
Figure 57C:
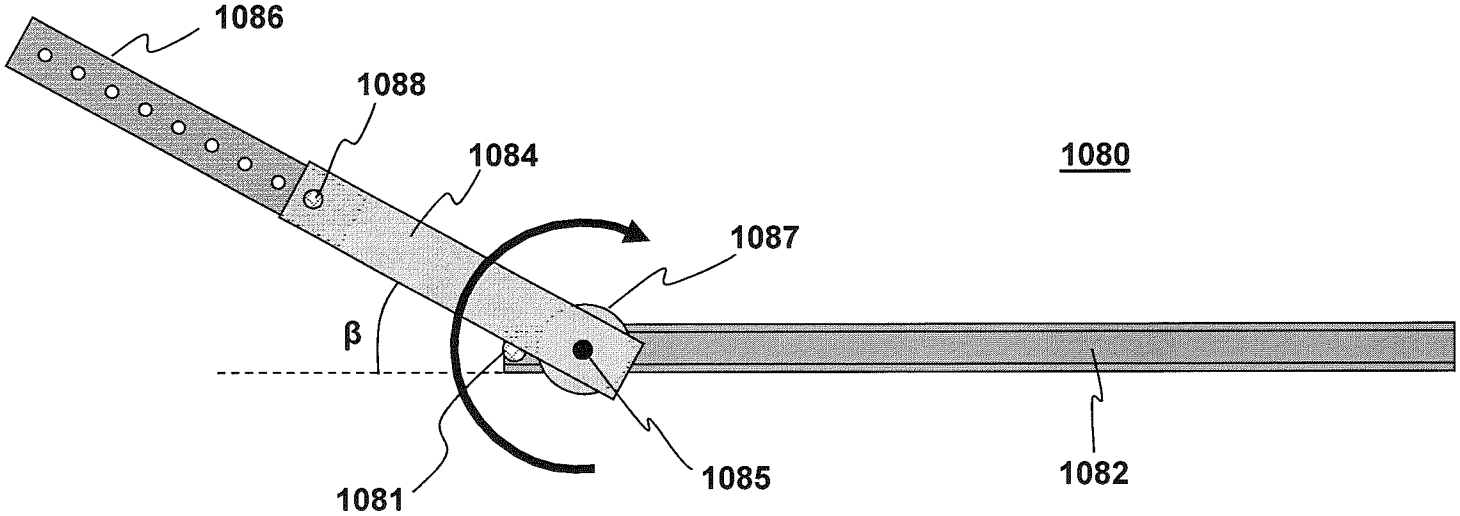

FIGS. 57*a*-57*c* illustrate three of many positions of the shoulder mast 1080 according to the present disclosure. With reference to FIG. 57*a*, the telescoping member 1086 is shown in an extended position relative to the second elongated member 1084. A track 1090 or other known attachment means may be provided on the distal end of the telescoping member 1086 so that a redirect pulley assembly 1060 may be easily attached or detached to the telescoping member 1086. Longitudinal holes (not shown) may also be provided on the track 1090 such that the redirect pulley assembly 1060 may be locked into place with a spring loaded locking pin (not shown) or other known locking means. With reference to FIG. 57*b*, the telescoping member 1086 is shown in a retracted position relative to the second elongated member 1084. With reference to FIG. 57*c*, the telescoping member 1086 and second elongated member 1084 are shown rotated at an angle β relative to the first elongated member 1082. The second and telescoping members 1084, 1086 may rotate about the axis pin 1085 as illustrated thereby providing a wide range of motion for a trainee.

Figure 58:
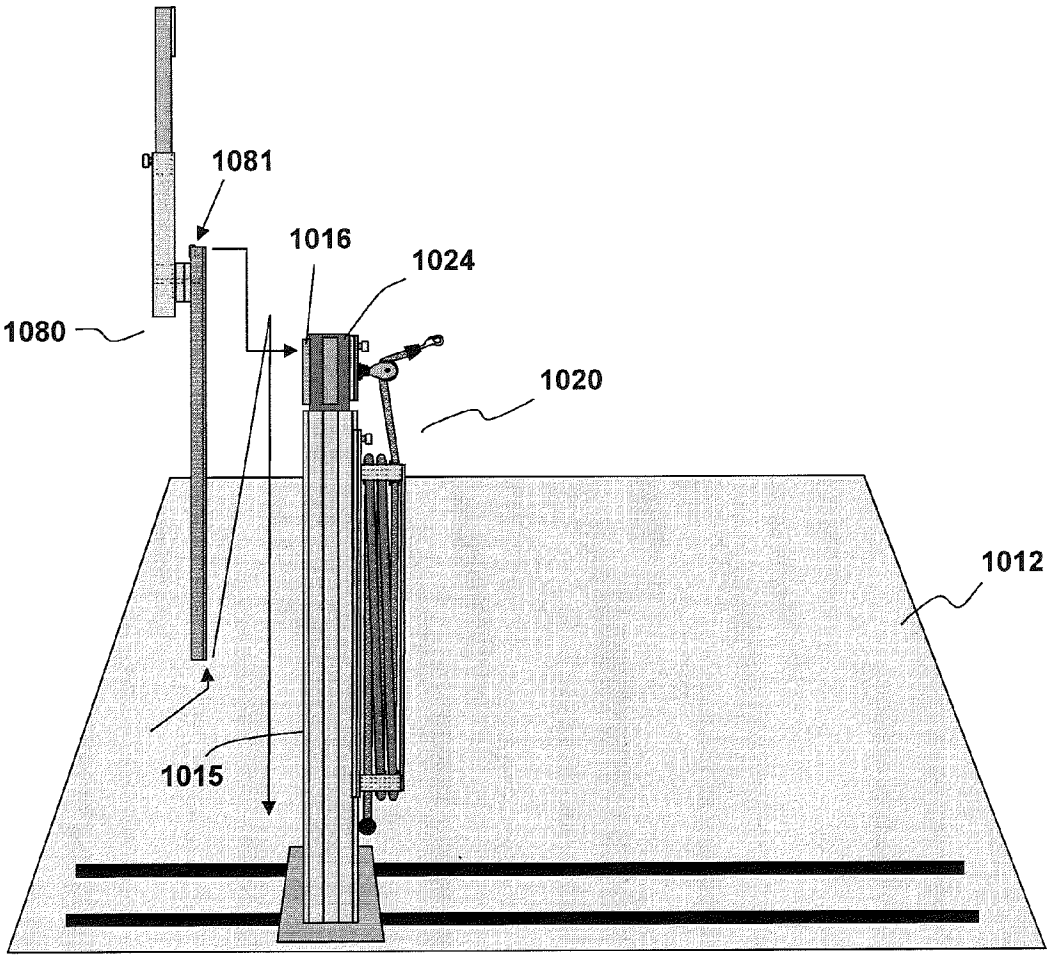
FIG. 58 is an isometric view of an embodiment of the physical training apparatus according to the present disclosure including a shoulder mast.

FIG. 58 illustrates an embodiment of the physical training apparatus according to the present disclosure wherein the shoulder mast 1080 is mounted upon the outboard side of a resistance training assembly 1020. With reference to FIG. 58, the ridge or tab 1015 of the ridged frame member 1022 accepts the groove 1083 of the first elongated member 1082. The shoulder mast 1080 may then be positioned on the resistance training assembly 1020 and locked into place using the spring loaded locking pin 1081 or other known attachment means. A rail 1016 may also be provided on the outboard side of the telescoping frame member 1024 to assist locking the shoulder mast 1080 in a desired position.

Figure 59:
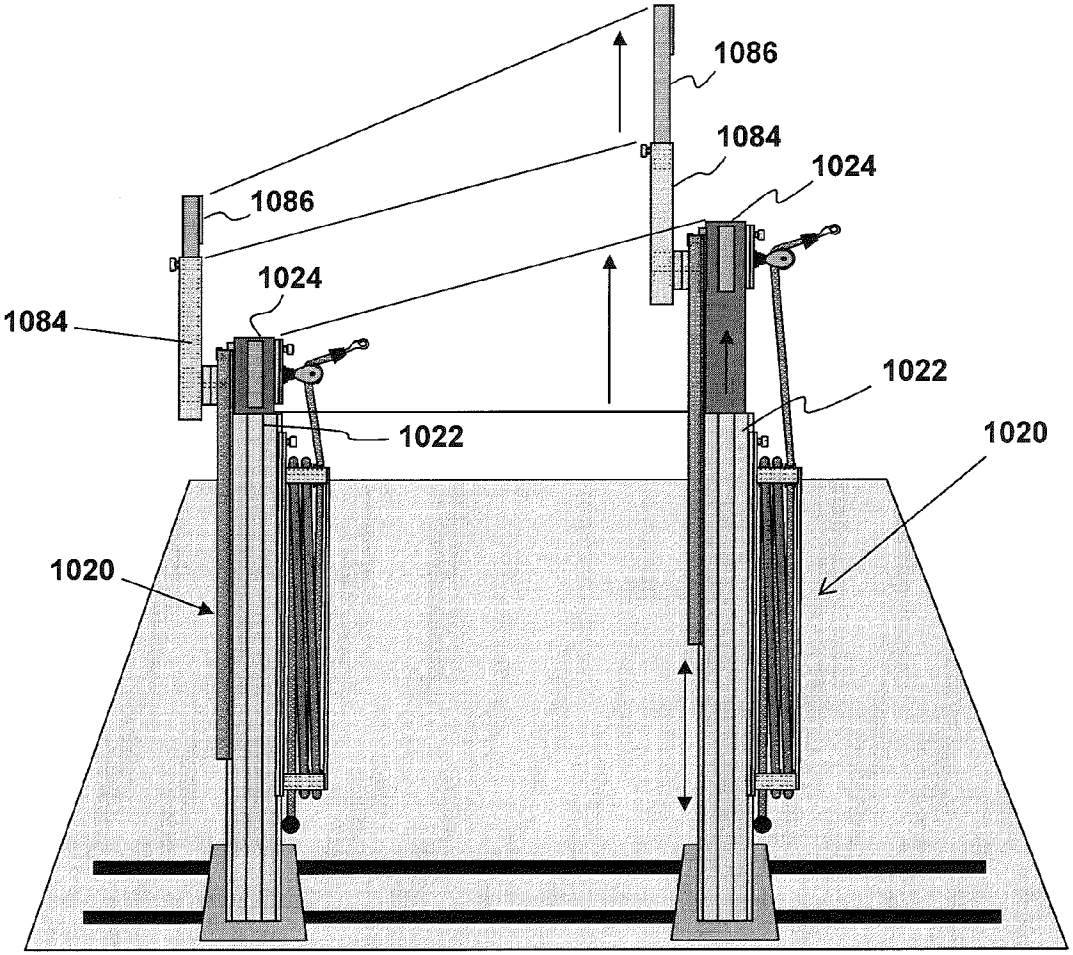
FIG. 59 is an isometric view of the telescoping capabilities of a resistance training assembly according to the present disclosure.

FIG. 59 illustrates the telescoping capabilities of a resistance training assembly 1020. The effective length and height of the assembly 1020 may be increased by telescoping the position of the telescoping members 1024, 1086 relative to the position of the frame members 1022, 1084.

Figure 60:
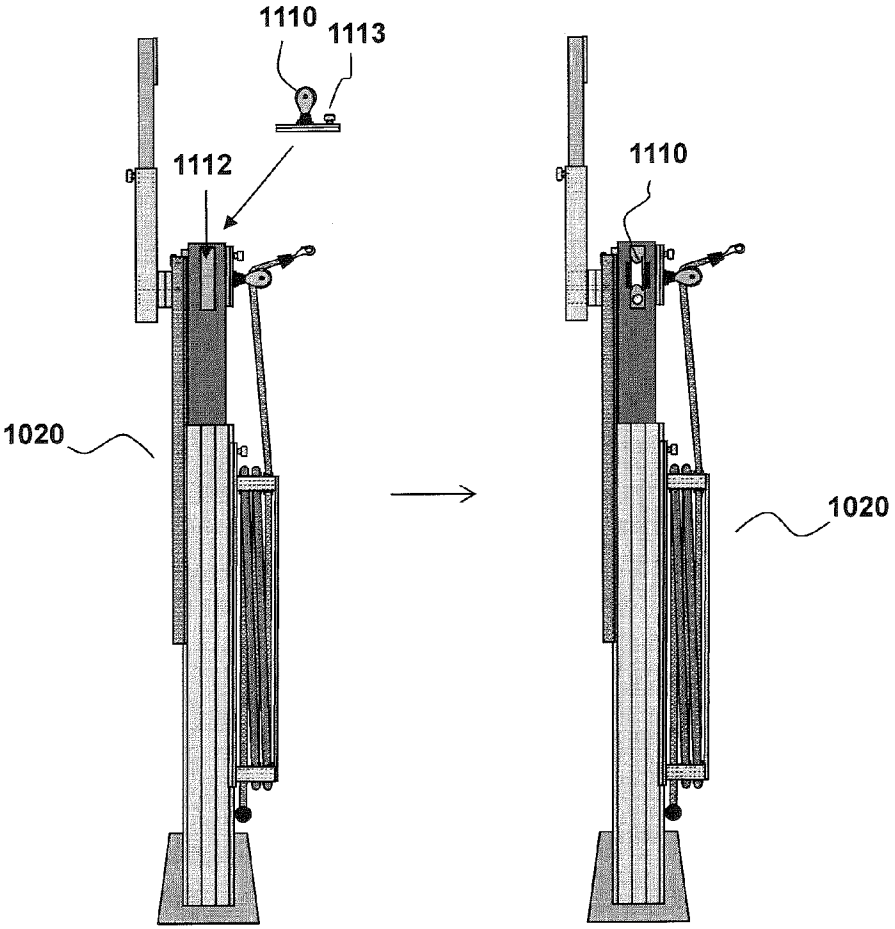
FIG. 60 is an isometric view of another embodiment of the physical training apparatus according to the present disclosure including a second pulley assembly mounted on a resistance training assembly.

FIG. 60 illustrates another embodiment of the physical training apparatus according to the present disclosure wherein a second pulley assembly 1110 may be mounted on a rail 1112 provided on the resistance training assembly 1020 and locked in place by a spring loaded locking pin 1113 or other known locking means.

Figures 61A, 61B:
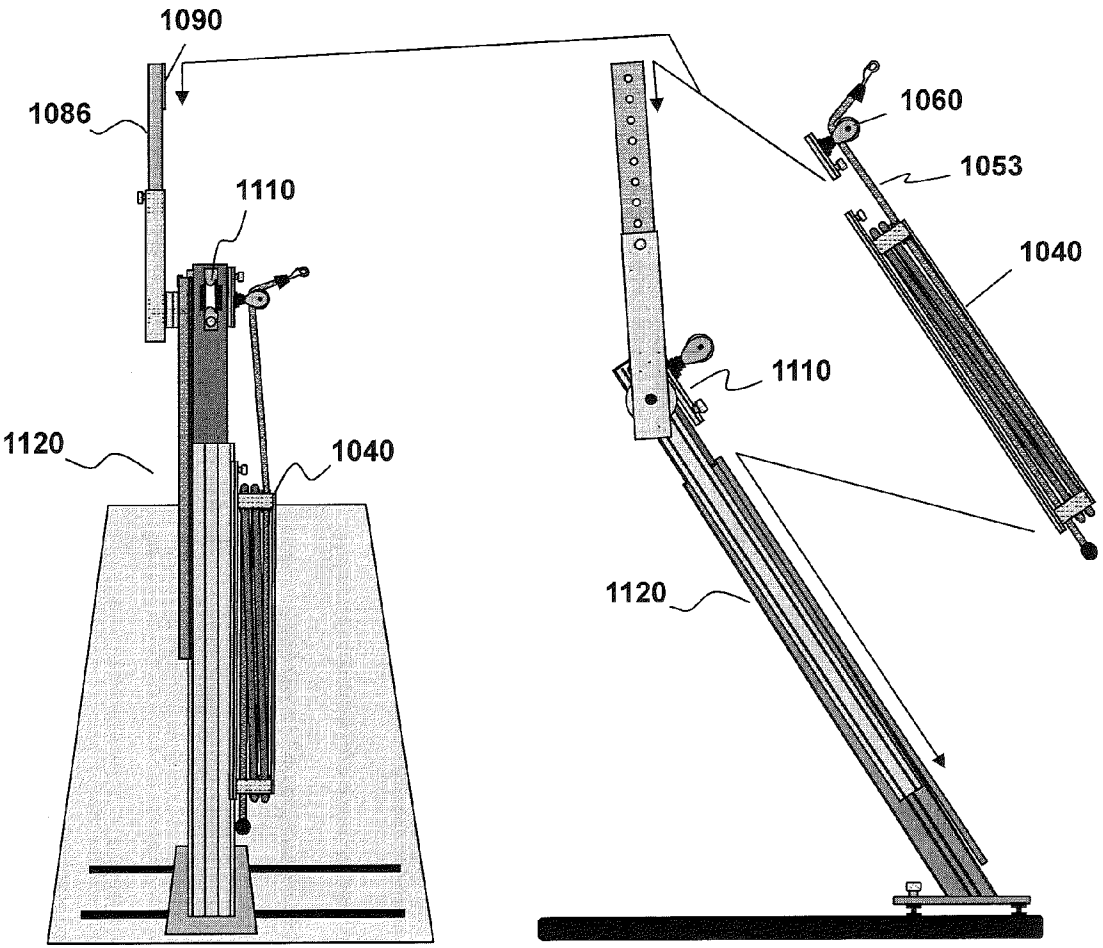
FIGS. 61*a* and 61*b* are illustrations another embodiment of the physical training apparatus according to the present disclosure shown in FIG. 60 for providing training vectors to the hips and shoulders of a trainee.

FIGS. 61*a* and 61*b* illustrate an embodiment of the physical training apparatus according to the present disclosure shown in FIG. 60 for providing training vectors to the hips and shoulders of a trainee. With reference to FIG. 61*a*, the track 1090 provided on the telescoping member 1086 is adaptable to accept a redirect pulley assembly 1060. With reference to FIG. 61*b*, the ridged frame member 1022 is adaptable to accept a second training module 1040 sharing the same elastic member 1053 as the redirect pulley assembly 1060. The positions of the training module 1040 and redirect pulley assembly 1060 may be adjusted and locked accordingly.

Figure 62B:
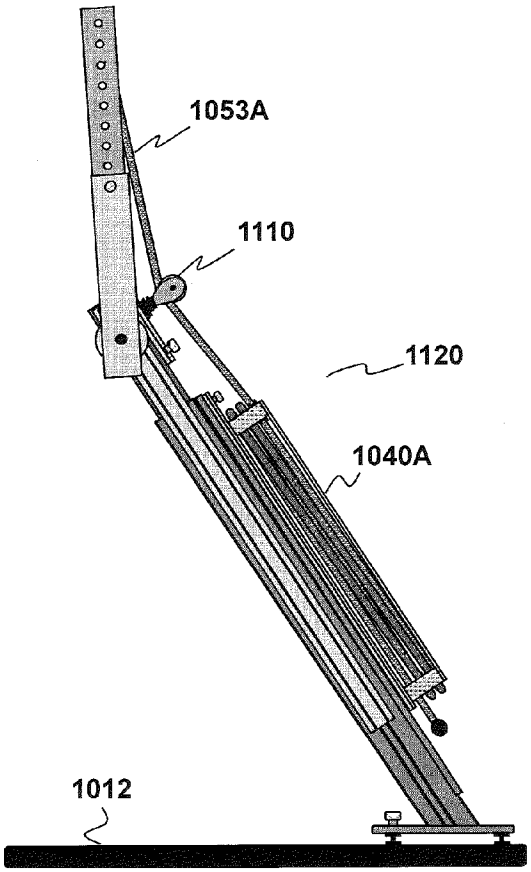
FIGS. 62*a* and 62*b* are an isometric view and side view of an embodiment of the physical training apparatus according to the present disclosure shown in FIGS. 61*a* and 61*b* for providing training vectors to the hips and shoulders of a trainee.
Figure 62A:
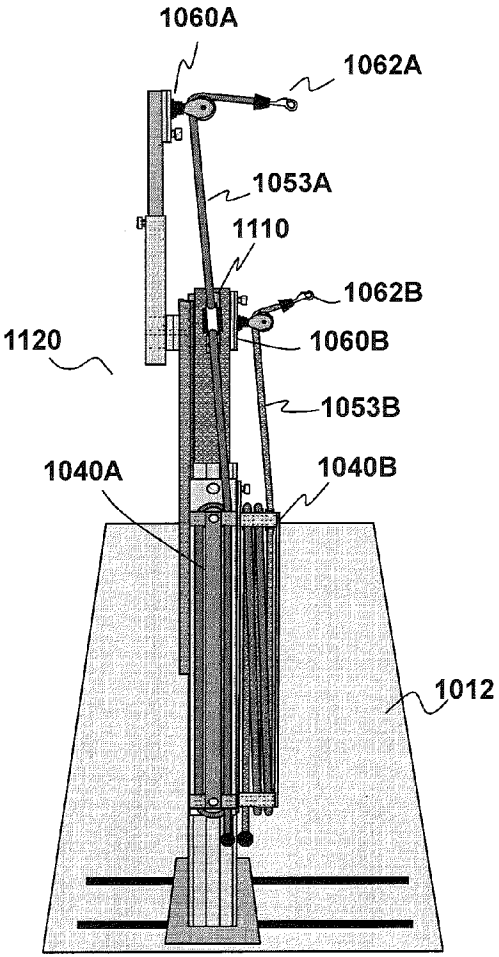

FIGS. 62*a* and 62*b* illustrate an isometric view and side view of the embodiment of the physical training apparatus according to the present disclosure shown in FIGS. 61*a* and 61*b* for providing training vectors to the hips and shoulders of a trainee. With reference to FIGS. 62*a* and 62*b*, the second pulley assembly 1110 and the redirect pulley assembly 1060A provide a path for the elastic member 1053A from the training module 1040A. The elastic member 1053A is attached at the distal end thereof to the connector 1062A for attachment to a harness (not shown) worn on the body of a trainee supported by the base 1012. The redirect pulley assembly 1060B provides a path for the elastic member 1053B from the training module 1040B. The elastic member 1053B is attached at the distal end thereof to the connector 1062B for attachment to a harness (not shown) worn on the body of the trainee.

Figure 63:
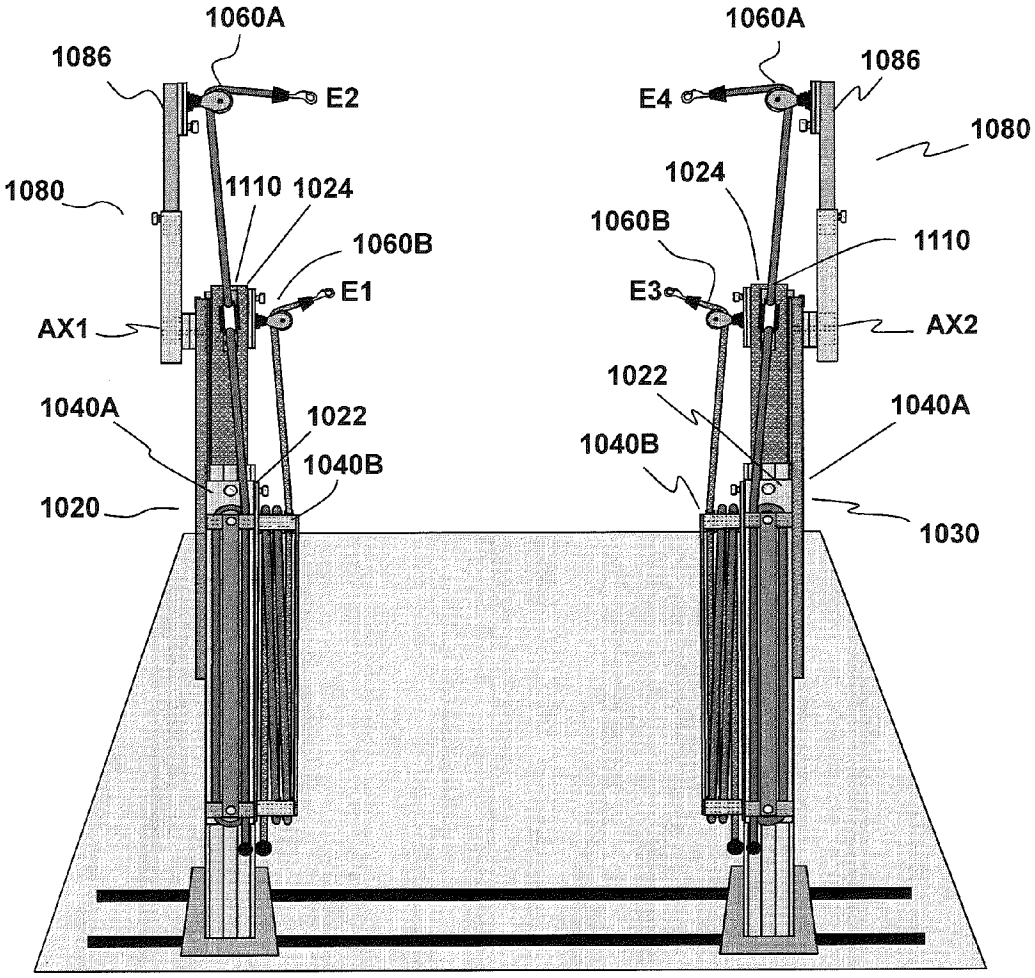
FIG. 63 is an isometric view of an embodiment of the physical training apparatus according to the present disclosure for providing four training vectors to the hips and shoulders of a trainee.

FIG. 63 illustrates an isometric view of a physical training apparatus providing four training vectors by attaching training modules 1040A, 1040B to the ridged frame members 1022 of the resistance training assemblies 1020, 1030. The second pulley assemblies 1110 and redirect pulley assemblies 1060A, 1060B of the resistance training assemblies 1020, 1030 provide a path for elastic members E1, E2, E3, E4. The apparatus provides elastic members E1, E2, E3, E4 for attachment to a trainee so that training vectors may be applied to any number of, e.g., four, points on the trainee at differing or adjustable heights. For example, embodiments providing telescoping frame members 1024 may be adjusted to thereby alter the height of the pulley assemblies 1060A, 1060B and hence the elastic members therefrom. FIG. 63 illustrates an embodiment having shoulder masts 1080 mounted upon the outboard side of respective resistance training assemblies 1020, 1030. As previously described, the position of the shoulder masts 1080 may be adjusted and/or locked into place on the respective assemblies 1020, 1030 (see FIGS. 57, 58). With the combined rotational capability of the shoulder masts 1080 about axes AX1 and AX2 and translational adjustment thereof through the telescoping frame members 1024, telescoping members 1086, and/or adjustment of the shoulder masts 1080 along the assemblies 1020, 1030, the vector origins of elastic members E1, E2, E3, E4 may be adjusted to suit a user's needs or height. Further, the distances between axes AX1, AX2 and the vector origins of the respective elastic members E1, E2, E3, E4 may also be adjusted as needed. The adjustment of the location of vector origins of elastic members E1, E2, E3, E4 may be set manually by a user and automatically and/or dynamically by a computer based upon position sensor data relative to the rotational and/or translational position of the shoulder masts 1080 and components thereof. Such adjustments may also be accomplished via electrical and/or pneumatic means. Further, position sensor data based on user position may also be employed to adjust the position of the vector origins and hence the position of the telescoping frame members 1024, telescoping members 1086, and/or adjustable shoulder masts 1080.

Figure 64A:
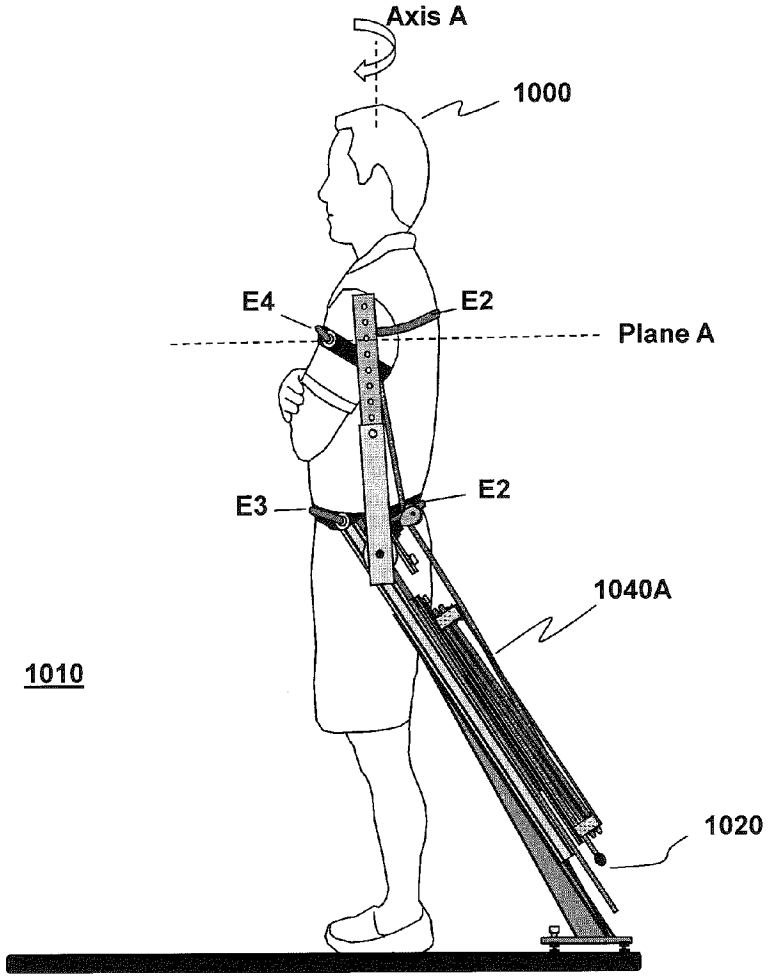
FIGS. 64*a* and 64*b* are side views of the physical training apparatus shown in FIG. 63 for providing four training vectors to a trainee in a standing position showing a restraining means providing a specified resistance with reference to the trainee.
Figure 64B:
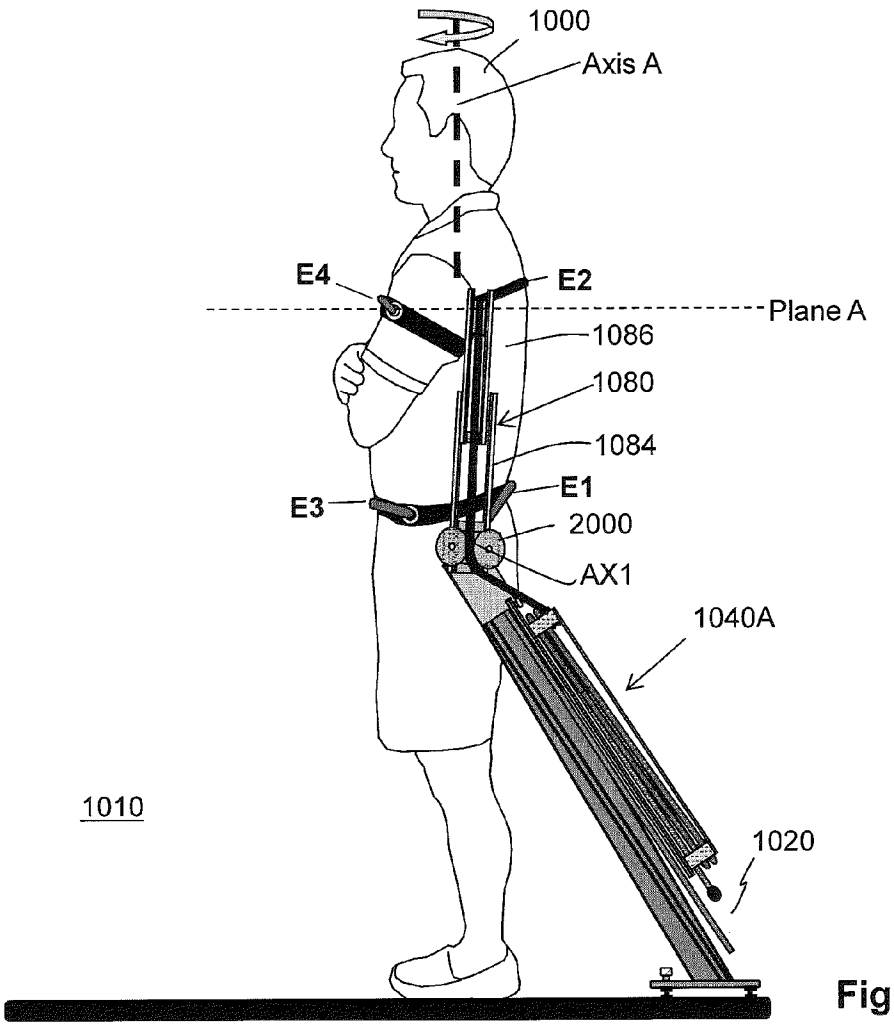

FIGS. 64*a* and 64*b* illustrate a side view of the physical training apparatus shown in FIG. 63 for providing four training vectors to a trainee 1000 in a standing position. With reference to FIGS. 64*a* and 64*b*, the resistance training assembly 1020 provides a training vector to the right hip of the trainee 1000 via elastic member E1 originating from the training module 1040B. The resistance training assembly 1020 provides a training vector to the right shoulder of the trainee 1000 via elastic member E2 originating from the training module 1040A. The resistance training assembly 1030 located to the right of the trainee 1000 provides a training vector to the left hip of the trainee 1000 via elastic member E3 originating from the respective training module 1040B of the resistance training assembly 1030. The assembly 1030 also provides a training vector to the left shoulder of the trainee 1000 via elastic member E4 originating from the respective training module 1040A of the assembly 1030. The tension on all four resistance elements for the configuration shown will rotate the trainee's shoulders and hips clockwise to the right pulling and positioning hips and shoulders into the full back swing position or batting position for a right-handed trainee. This will elongate and stretch muscles associated with a right-handed golfer's or batter's swinging motion. Once in this position, the trainee 1000 performs the swinging motion and both hips and shoulders will rotate counter-clockwise about Axis A simultaneously working against the torque resistance created from all four resistance elements. Thus, should rotation about Axis A will result in elastic members E4 and E2 and their respective vector origins moving on Plane A. With reference to FIG. 64*b*, an alternative embodiment of a shoulder mast 1080 and telescoping member 1086 is shown. In this embodiment, rather than having a track provided on the distal end of the telescoping member 1086 as illustrated in FIGS. 57*a*-57*c*, the shoulder mast may be provided with a pulley assembly 2000 allowing for the direction of an elastic member from the training module 1040A up the shoulder mast 1080, second elongated member 1084 and telescoping member 1086 which may then be redirected by a redirect pulley assembly 2010 contained in or external to the telescoping member 1086. Of course, the telescoping member 1086 and second elongated member 1084 are rotatable about axis AX1 which extends perpendicular to the page.

Figure 65A:
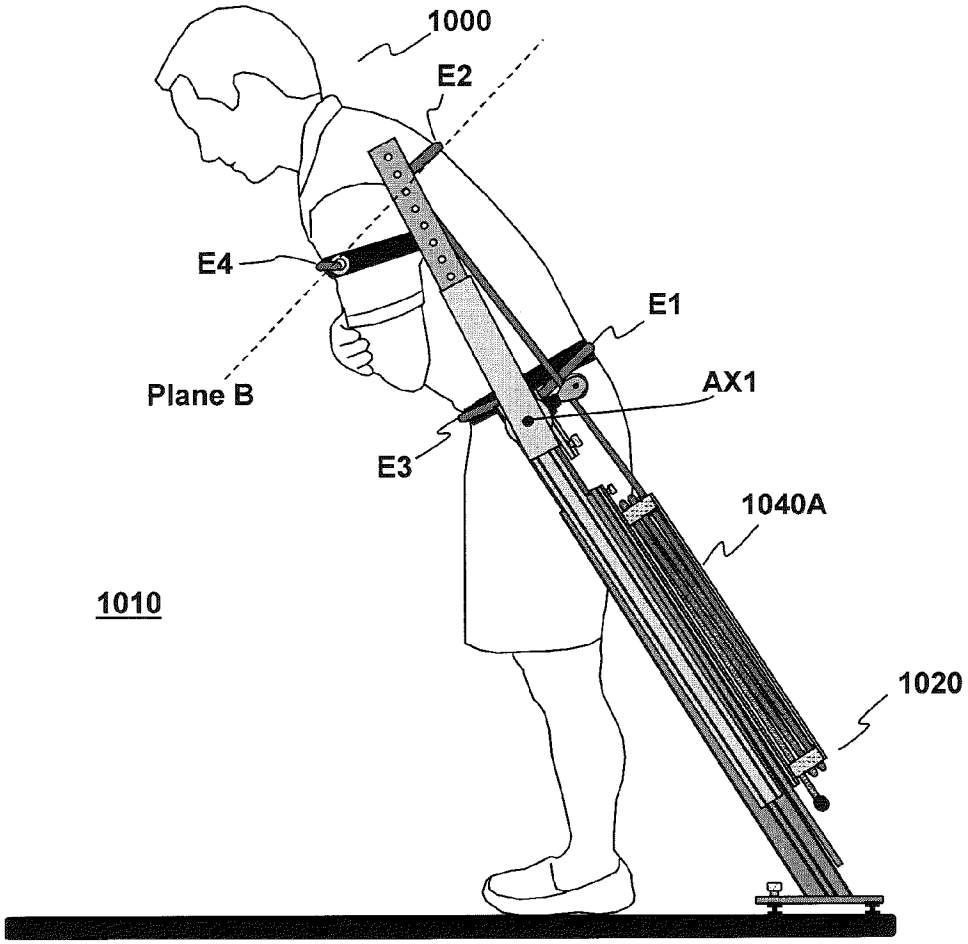
FIGS. 65*a* and 65*b* are side views of the physical training apparatus shown in FIGS. 64*a* and 64*b* for providing four training vectors to a trainee in a standing position slightly bent at the waist showing a restraining means providing a specified resistance with reference to the trainee.
Figure 65B:
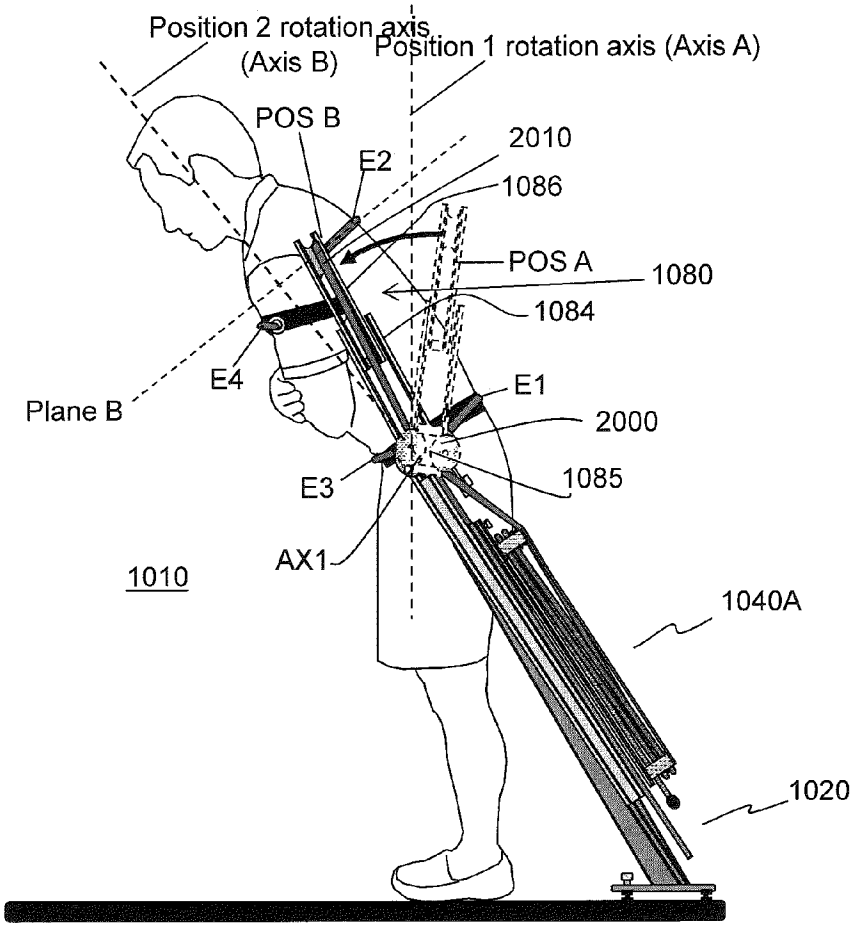

FIGS. 65*a* and 65*b* illustrate the rotational capabilities of the resistance training assemblies 1020, 1030 with respect to the position of the trainee 1000. With reference to FIG. 65*a*, the trainee 1000 is shown in a standing position, slightly bent at the waist. Accordingly, the shoulder mast 1080 of the assembly 1020 may rotate about the axis pin 1085 to follow the position of the torso of the trainee 1000. Thus, the magnitude of the training vectors provided by the elastic members E1, E2, E3, E4 may vary substantially linearly through a predetermined range of motion. With reference to FIG. 65*b*, an alternative embodiment of a shoulder mast 1080 and telescoping member 1086 is shown. In this embodiment, rather than having a track provided on the distal end of the telescoping member 1086 as illustrated in FIGS. 57*a*-57*c*, the shoulder mast may be provided with a pulley assembly 2000 allowing for the direction of an elastic member from the training module 1040A up the shoulder mast 1080, second elongated member 1084 and telescoping member 1086 which may then be redirected by a redirect pulley assembly 2010 contained in or external to the telescoping member 1086. As shown, the telescoping member 1086 and second elongated member 1084 are rotatable about axis AX1 which extends perpendicular to the page. Further, FIG. 65*b* illustrates the rotational capabilities of the resistance training assemblies 1020, 1030 with respect to the position of the trainee 1000 from Position A (FIGS. 64*a* and 64*b*) to Position B (FIGS. 65*a* and 65*b*). As shown, the shoulder mast 1080 of the assembly 1020 rotates about axis AX1 to follow the position of the torso of the trainee 1000. Thus, the magnitude of the training vectors provided by the elastic members E1, E2, E3, E4 may vary substantially linearly through a predetermined range of motion. Further, through the rotational and translational capabilities of this embodiment, the movement of elastic members E2, E4 may be shifted from Plane A in FIGS. 64*a* and 64*b* to Plane B in FIGS. 65*a* and 65*b*. As illustrated, Plane B is perpendicular to Axis B; and, as the user's rotational plane shifts from the Position 1 rotation axis to the Position 2 rotation axis, the movement planes for elastic members E2, E4 also change.

This exemplary embodiment may allow a fixed level of force application or torque applied to the shoulders and/or waist regardless of the user's degree of bend at the waist and also does not restrict bending movement even though elastic members E2, E4 are attached to the shoulder. As the user bends over from the standing position, the pivoting action of this embodiment allows a bending movement to be performed without the apparatus applying any counter resistance to the bending movement, that is, if the vector origins of E2, E4 were in a fixed position adjacent to the shoulders, any bending movement thereof would be restricted as the user attempted to move his or her shoulders forward away from the vector origins. Thus, elastic members E2, E4 would attempt to pull the user back towards the respective vector origins; however, in embodiments of the present disclosure as the vector origins are no longer fixed in space and may move along the same arc as the shoulders, there will be no counter force to the user's movement.

The magnitude of each the training vectors may also be varied with the effective length of the respective elastic members E1, E2, E3, E4. For example, elastic members E1 and E3 may have sufficient length so that the magnitude of the training vectors provided to the hips of the trainee is greater than the magnitude of the training vectors provided to the shoulders of the trainee via elastic members E2 and E4. In a further embodiment of the present disclosure, the training modules 1040A, 1040B for the resistance training assemblies 1020, 1030 may also include two or more elastic members having different diameters for providing a wider range of resistive force. It is also envisioned that multiple training modules 1040 may be stacked or combined to increase the useful resistance force range.

Figure 66B:
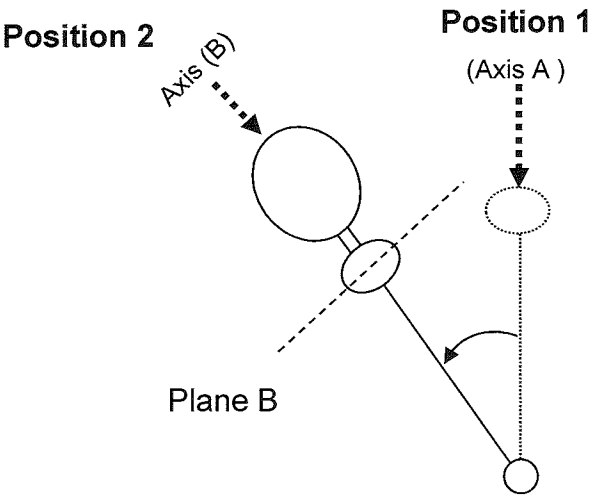
FIGS. 66*a* and 66*b* are pictorial representations of the rotational capabilities of embodiments of the present subject matter.
Figure 66A:
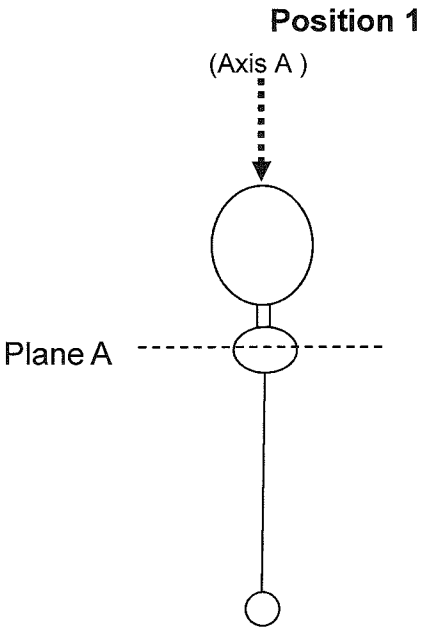

FIGS. 66*a* and 66*b* are pictorial representations of the rotational capabilities of embodiments of the present disclosure. With reference to FIG. 66*a*, a trainee is shown in a standing position with elastic members E2, E4, illustrated in previous figures, adaptable to move in Plane A as the trainee rotates his or her upper torso in the vertical position. As the trainee's shoulders rotate about Axis A, movement of the shoulders are dictated by the vector origins of elastic members E2, E4 in Plane A. With reference to FIG. 66*b*, the trainee is shown in a standing position, slightly bent at the waist. Elastic members E2, E4 are now adaptable to move in Plane B as the trainee rotates his or her upper torso in the bent position. Thus, as the trainee's shoulders rotate about Axis B, movement of the shoulders are dictated by the vector origins of elastic members E2, E4 in Plane B. This embodiment eliminates any net force acting against or opposing the trainee's bending movement at the hops as the shoulders are displaced from the position depicted in FIG. 66A. Thus, as the trainee bends at the waist, the axis of shoulder rotation will shift from Axis A to Axis B, and the pivoting capability of this embodiment allows the vector origins for the elastic members E2, E4 to shift along the arc of the shoulders and thus alter the plane defined by the elastic members E2, E4 as the trainee's shoulders rotate about axis B. It should be noted that this arcing movement of the shoulders from Position 1 to Position 2 will not be resisted even though torque will continually be applied to the shoulders.

Figure 67:
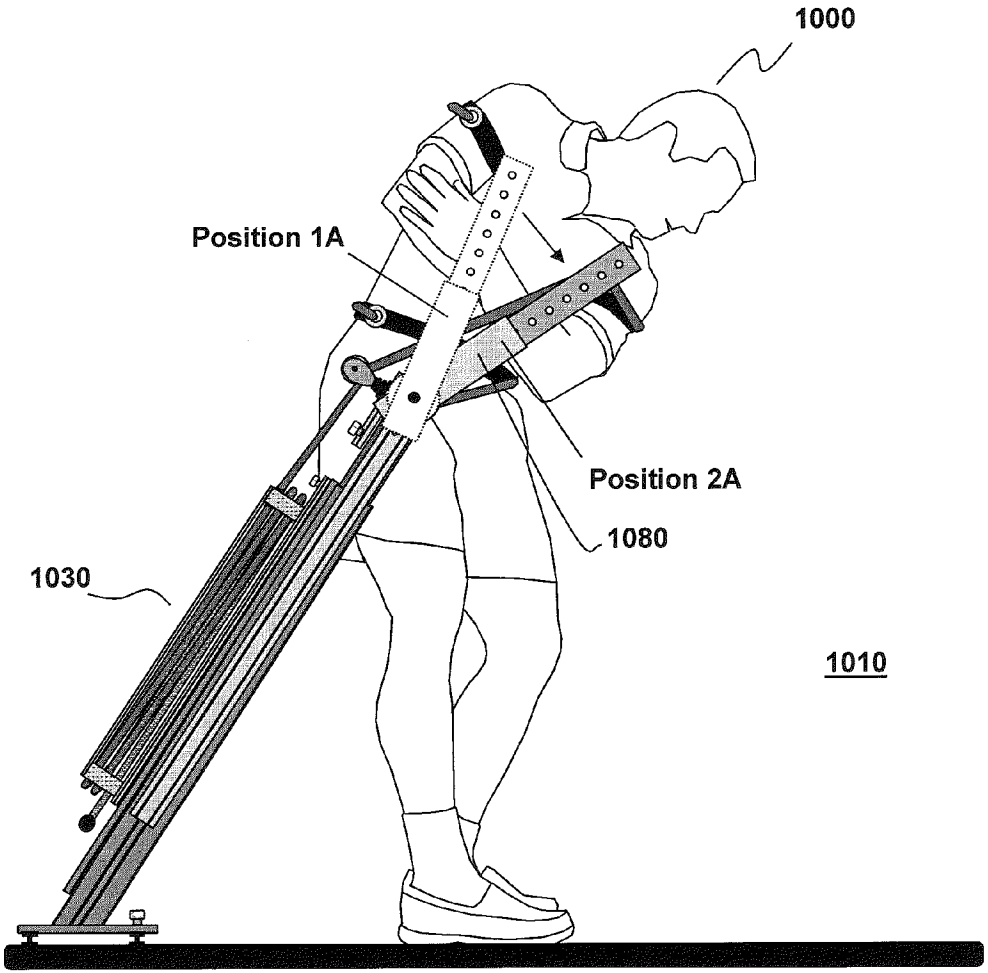
FIGS. 67 and 68 are side views of an embodiment of the present disclosure with a trainee in the backswing position of FIG. 44 showing a restraining means providing a specified resistance with reference to the trainee.
Figure 68:
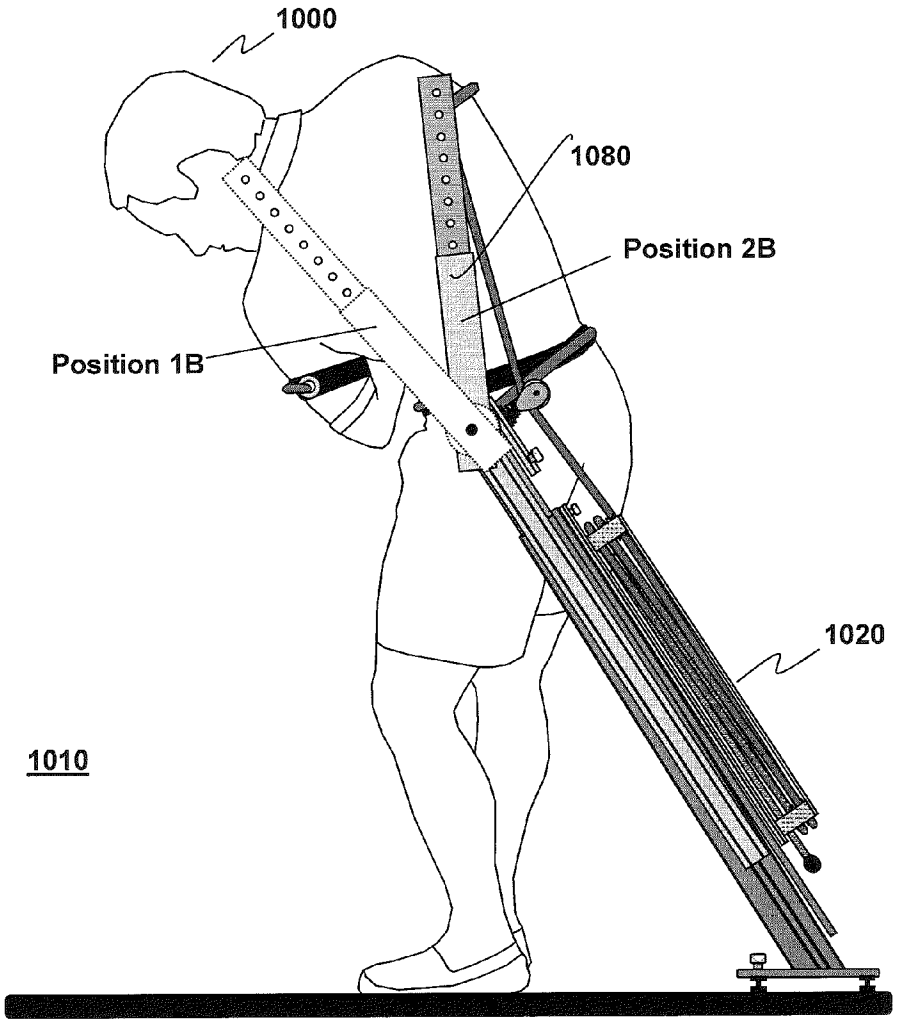

FIGS. 67 and 68 further illustrate the rotational capabilities of the resistance training assemblies showing the position of the assemblies in relation to a backswing position of the trainee 1000. With reference to FIG. 67, as the trainee 1000 rotates to a backswing position, the trainee's left shoulder drops causing the shoulder mast 1080 of the resistance training assembly 1030 to rotate from Position 1A to Position 2A. FIG. 67 illustrates a side view of a right-handed golfer simulating a back swing. As the golfer rotates to their right, his left shoulder drops causing the shoulder mast 1080 to move from Position 1A to Position 2A. The opposing shoulder mast 1080 (not shown) rotates counter clockwise rising to match the height of the right shoulder. This movement keeps the origin vectors of the respective elastic members more perpendicular to an axis that runs through both the golfer's shoulders as they move into the back swing. Such a mechanical movement effectively maximizes the net torque applied to the shoulders in the full back swing position. With reference to FIG. 68, as the trainee 1000 rotates to a backswing position, the trainee's right shoulder rises causing the shoulder boom 1080 of the resistance training assembly 1020 to rotate from Position 1B to Position 2B. FIG. 68 illustrates a transition into a right handed golfer's back swing and allows one to observe the rotational aspect of the embodiment as the shoulder mast 1080 rotates from Position 1B to Position 2B as the golfer's right shoulder rises during rotation in the back swing. The opposing shoulder mast 1080 (not shown) will rotate downward following movement of the left shoulder. Such a balanced design may allow automatic rotation to maximize applied torque at the end of the backswing rotational movement.

Figure 69C:
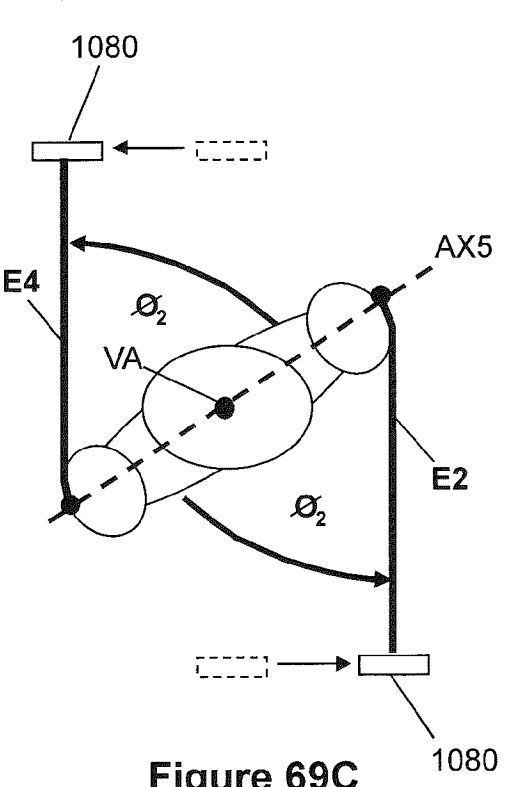
FIG. 69*c* is a pictorial representation of the rotational capabilities of an embodiment of the present subject matter.
Figure 69B:
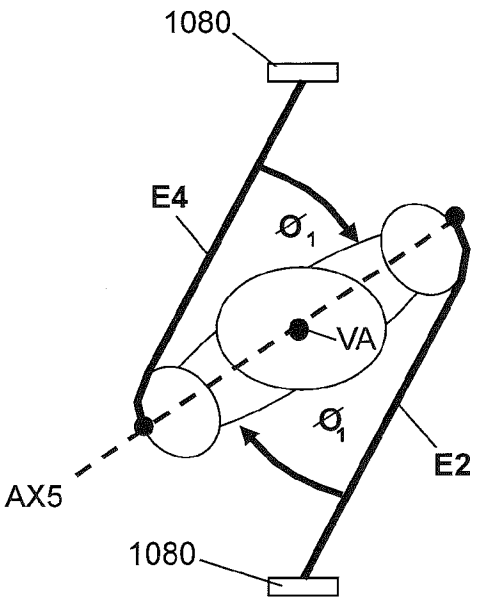
FIG. 69*b* is a pictorial representation of a conventional embodiment.
Figure 69A:
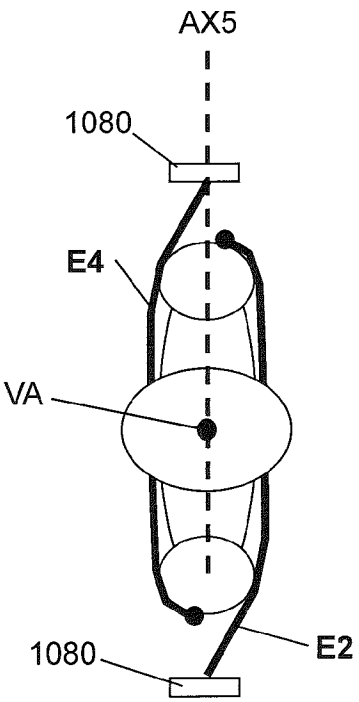
FIG. 69*a* is a pictorial representation of an embodiment of the present subject matter.

FIG. 69*a* is a pictorial representation of an embodiment of the present subject matter. FIG. 69*b* is a pictorial representation of a conventional embodiment. FIG. 69*c* is a pictorial representation of the rotational capabilities of an embodiment of the present subject matter. With reference to FIG. 69*a*, an axis AX5 defined by the shoulders of the trainee is relatively parallel to resistance elements or elastic members E2, E4 and thus little or no net torque is applied to the trainee relative to a vertical axis (VA). If the shoulder masts 1080 do not rotate when the trainee rotates his or her torso clockwise (as in the conventional embodiment of FIG. 69*b*), then the angle of resistance $\theta_1$ for the elastic members E2, E4 relative to the shoulder axis AX5 will be significantly less than 90 degrees. Thus, maximum torque may not be applied relative to VA for a given resistance applied by elastic members E2, E4. As the angle of resistance $\theta$ approaches 90 degrees relative to AX5, however, maximum torque may be applied about VA in embodiments of the present subject matter (as in the embodiment of FIG. 69*c*). With reference to FIG. 69*c*, as the trainee rotates his or torso clockwise, shoulder masts 1080 will automatically pivot and change position as shown, effectively relocating the vector origins of elastic members E2, E4 and thereby increasing the angle of resistance $\theta_2$ relative to AX5. For a given resistance provided by elastic members E2, E4, the greater the difference between $\theta_2$ and $\theta_1$ or the larger the $\theta$, more torque or moment about VA may be generated. Further, the rotation of the shoulder masts 1080 also allows the plane defined by the elastic members E2, E4, as described above, to remain parallel with the plane defined or scribed by AX5 rotation about the VA axis even when the trainee bends at the waist and VA is no longer vertical or perpendicular to the ground plane.

Figure 70:
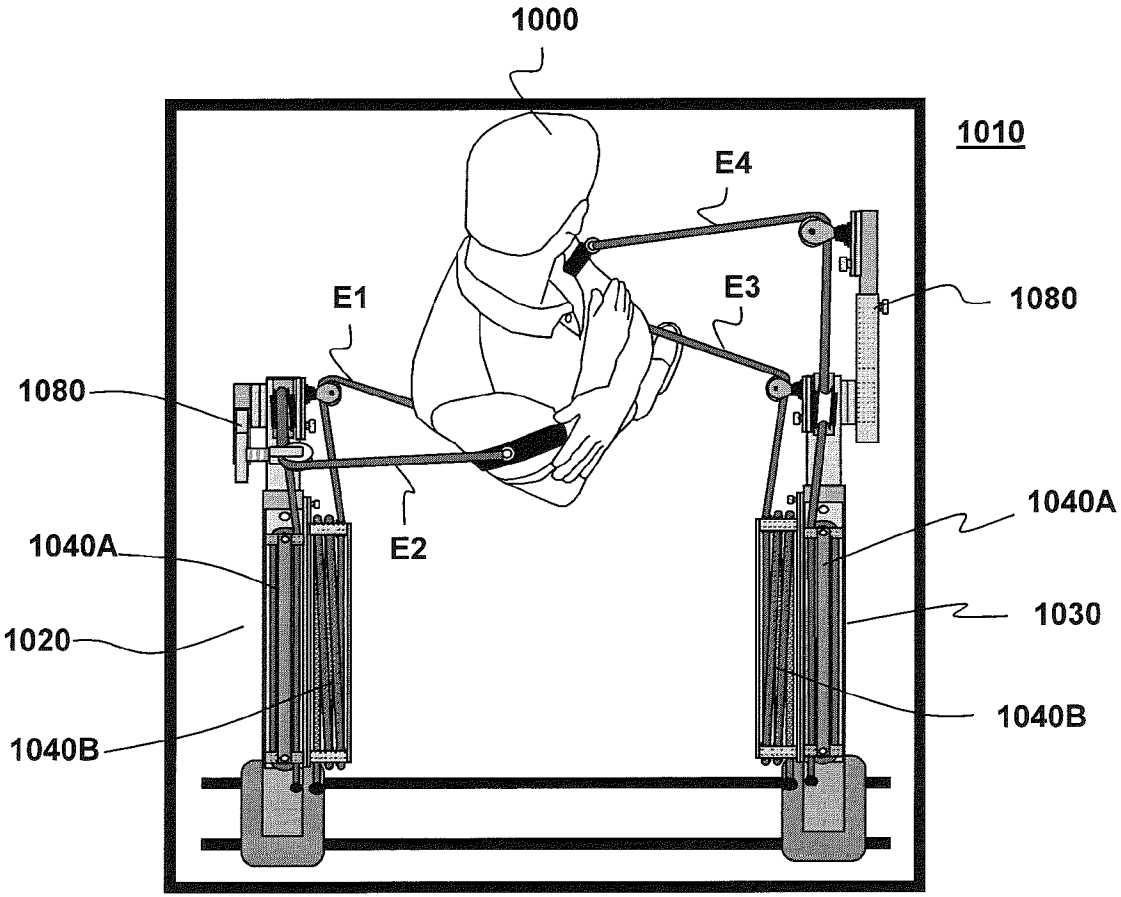
FIG. 70 is a top plan view of an embodiment of the present disclosure with a trainee in the backswing position of FIG. 44 showing a restraining means providing a specified resistance with reference to the trainee.
Figure 71:
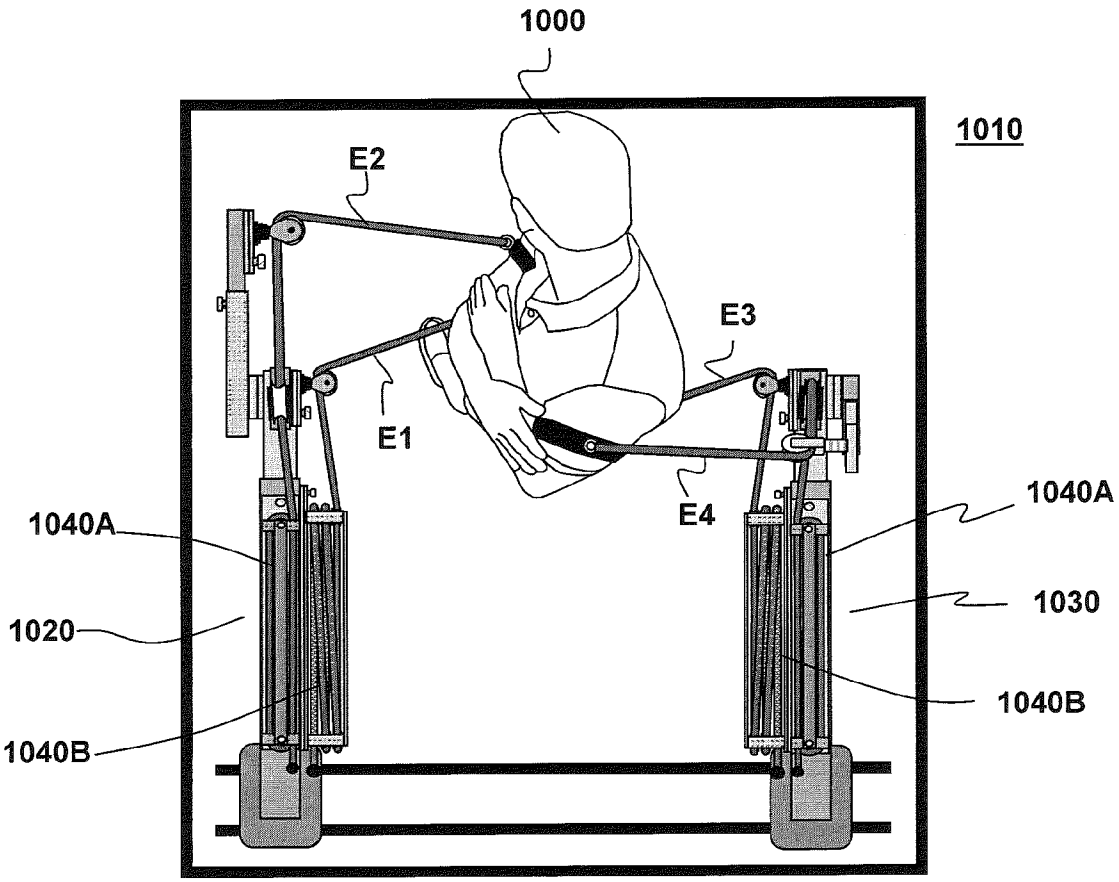
FIG. 71 is a top plan view of an embodiment of the present disclosure with a left-handed trainee in a backswing position showing a restraining means providing a specified resistance with reference to the trainee.

FIG. 70 illustrates a top view of the physical training apparatus shown in FIGS. 67 and 68 for providing four training vectors to a trainee 1000. With reference to FIG. 70, the trainee 1000 is right-handed and is in a full backswing position of a golf swing. The elastic members E1, E2, E3, E4 provide training vectors that pull the trainee 1000 into the backswing or coiled position, but resist the uncoiling thereafter to the mid-swing and follow-through positions of a golf swing as illustrated in FIGS. 45 and 46. With reference to FIG. 71, the trainee 1000 is left-handed and is in a full backswing position of a golf swing. The elastic members E1, E2, E3, E4 provide training vectors that pull the trainee 1000 into the backswing or coiled position, but resist the uncoiling thereafter to the mid-swing and follow-through positions of a golf swing.

Figure 72:
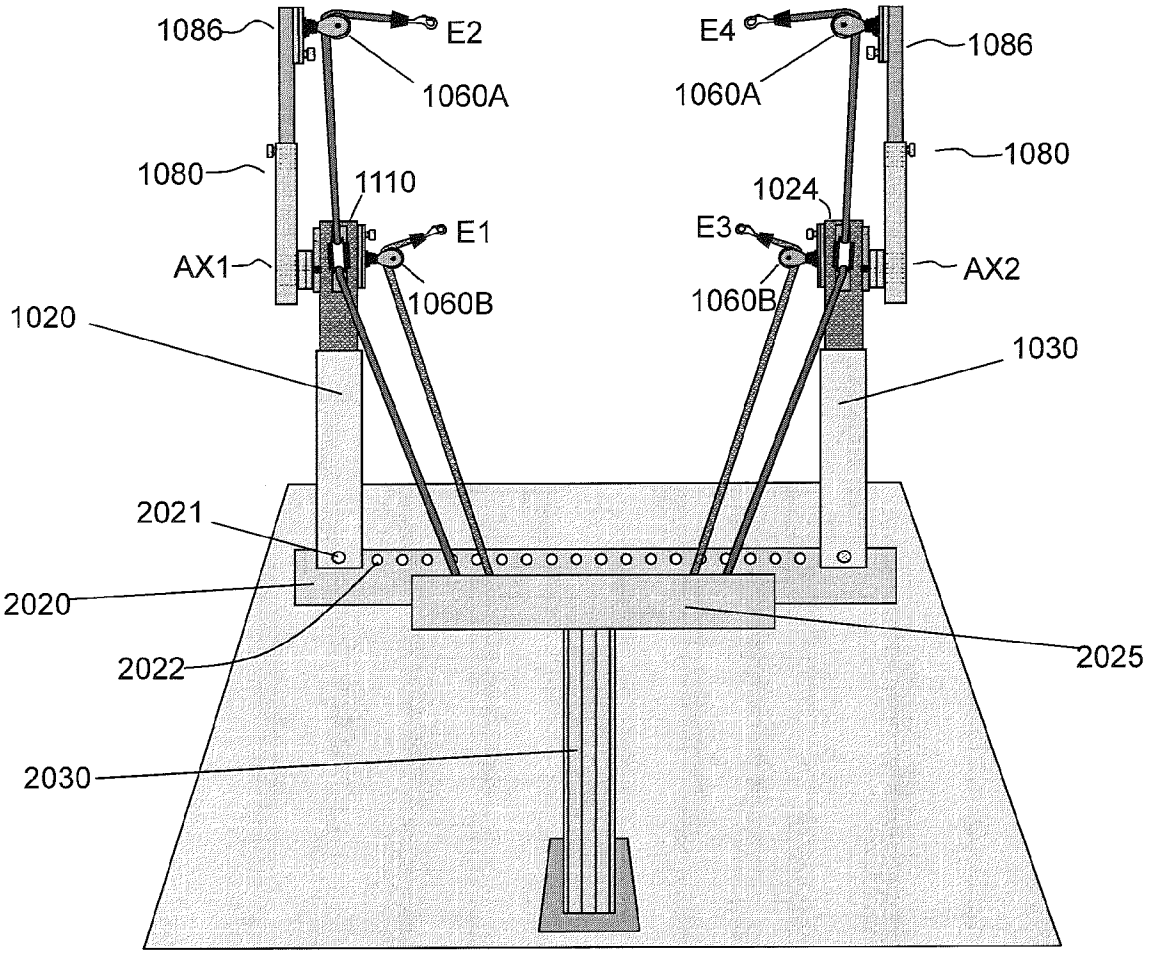
FIGS. 72 and 73 illustrate isometric views of an alternate embodiment of the present subject matter.
Figure 73:
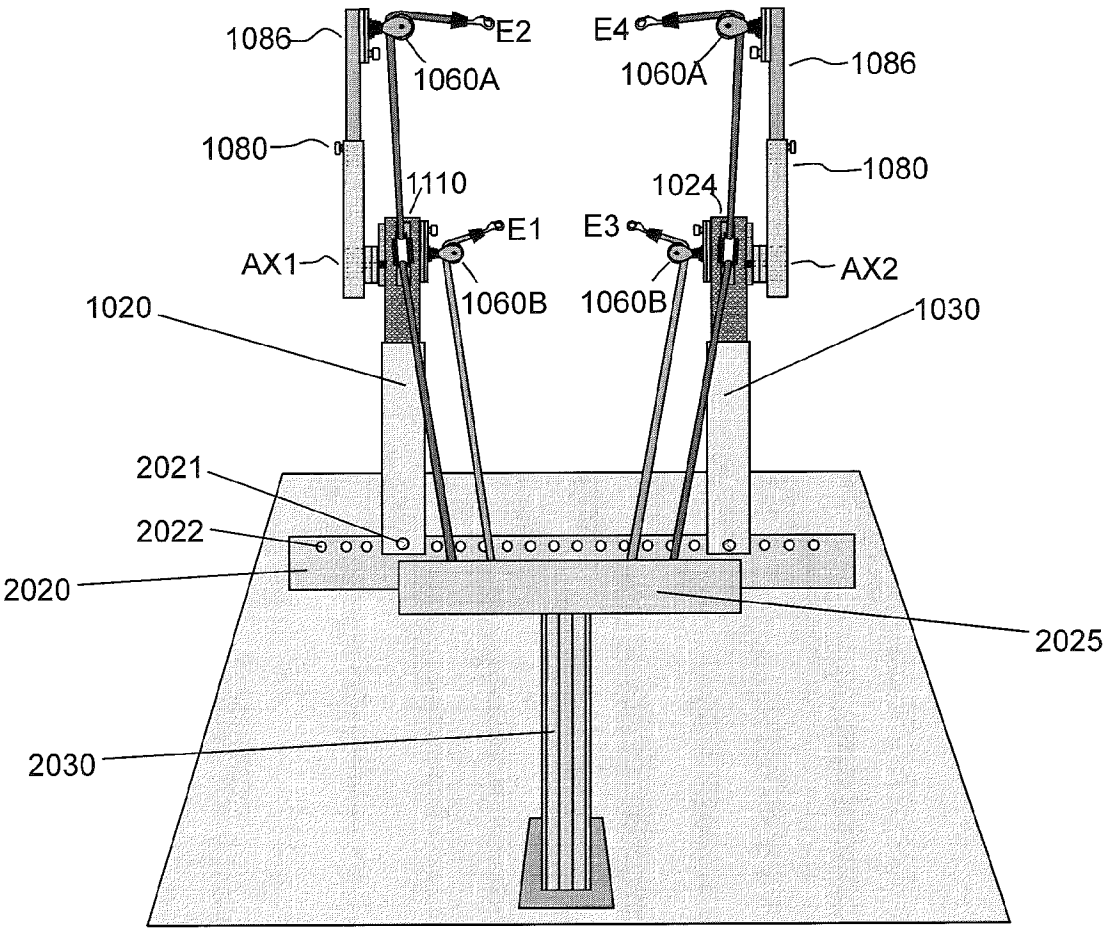

FIGS. 72 and 73 illustrate isometric views of an alternate embodiment of the present subject matter. With reference to FIG. 72, a single support element 2020 may provide support for a resistance module 2025 removably and fixedly attached thereto. The resistance module 2025 may contain components and pulley assemblies similar the training modules 1040A, 1040B in prior embodiments and may contain a plurality of modules providing resistance vectors of varying magnitude (e.g., one, two, three, four or more elastic members) or a single module providing a plurality of resistance vectors of varying magnitude (e.g., one, two, three, four or more elastic members). For example, one exemplary resistance module 2025 may include multiple elastic members for the entire apparatus thereby reducing the number of resistance modules. The support element 2020 may be connected to a base member 2030 which is removably attached to the base. Resistance training assemblies 1020, 1030 may be removably attached to the support element 2020 by any number of means. For example, support element 2020 may include a series of locking holes 2022 whereby the position of the resistance training assemblies 1020, 1030 may be adjusted using a pin 2021 or equivalent to lock the position of the respective assembly to the support element 2020 thereby eliminating any need for slide rails in previous embodiments. This embodiment provides second pulley assemblies 1110 and redirect pulley assemblies 1060A, 1060B for the resistance training assemblies 1020, 1030 to provide a path for elastic members E1, E2, E3, E4. The apparatus provides elastic members E1, E2, E3, E4 for attachment to a trainee so that training vectors may be applied to any number of, e.g., four, points on the trainee at differing or adjustable heights. For example, embodiments providing telescoping frame members 1024 may be adjusted to thereby alter the height of the pulley assemblies 1060A, 1060B and hence the elastic members therefrom. FIG. 72 illustrates an embodiment having shoulder masts 1080 mounted upon the outboard side of respective resistance training assemblies 1020, 1030. As previously described, the position of the shoulder masts 1080 may be adjusted and/or locked into place on the respective assemblies 1020, 1030. With the combined rotational capability of the shoulder masts 1080 about axes AX1 and AX2 and translational adjustment thereof through the telescoping frame members 1024, telescoping members 1086, and/or adjustable shoulder masts 1080, the vector origins of elastic members E1, E2, E3, E4 may be adjusted to suit a user's needs or height. Further, the distances between axes AX1, AX2 and the vector origins of the respective elastic members E1, E2, E3, E4 may also be adjusted as needed. The adjustment of the location of vector origins of elastic members E1, E2, E3, E4 may be set manually by a user or trainee and automatically and/or dynamically by a computer based upon position sensor data relative to the rotational and/or translational position of the shoulder masts 1080 and components thereof. Such adjustments may also be accomplished via electrical and/or pneumatic means. Further, position sensor data based on user position may also be employed to adjust the position of the vector origins and hence the position of the telescoping frame members 1024, telescoping members 1086, and/or adjustable shoulder masts 1080. FIG. 73 shows the resistance training assemblies 1020, 1030 in a relatively narrow linear position along the rails support member 2020 with the telescoping frame members 1024 in a telescoped position. The resistance training assemblies 1020, 1030 may be adaptable to lock in place on the support member 2020 as previously described. Additional support structures (not shown) may be provided to reinforce the resistance training assemblies 1020, 1030 thereby eliminating any substantial instability.

Figure 74:
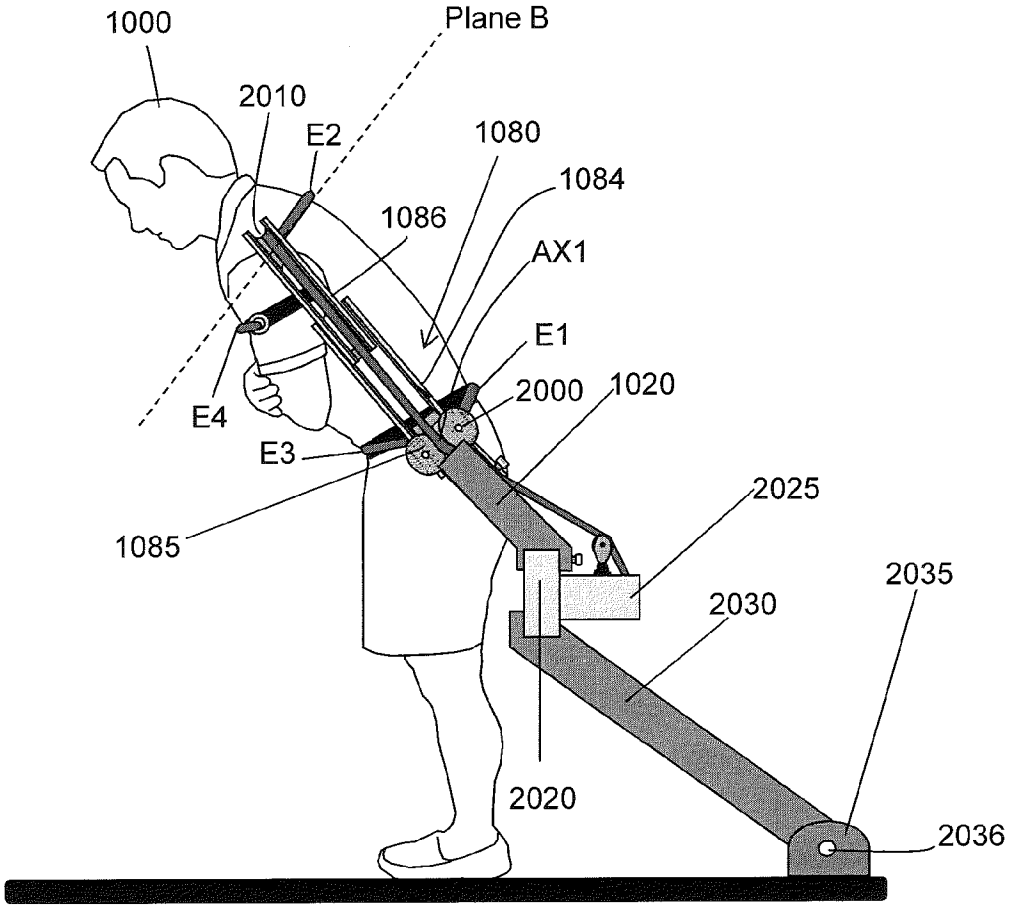
FIG. 74 is a side view of the embodiment illustrated in FIGS. 72 and 73.
Figure 75:
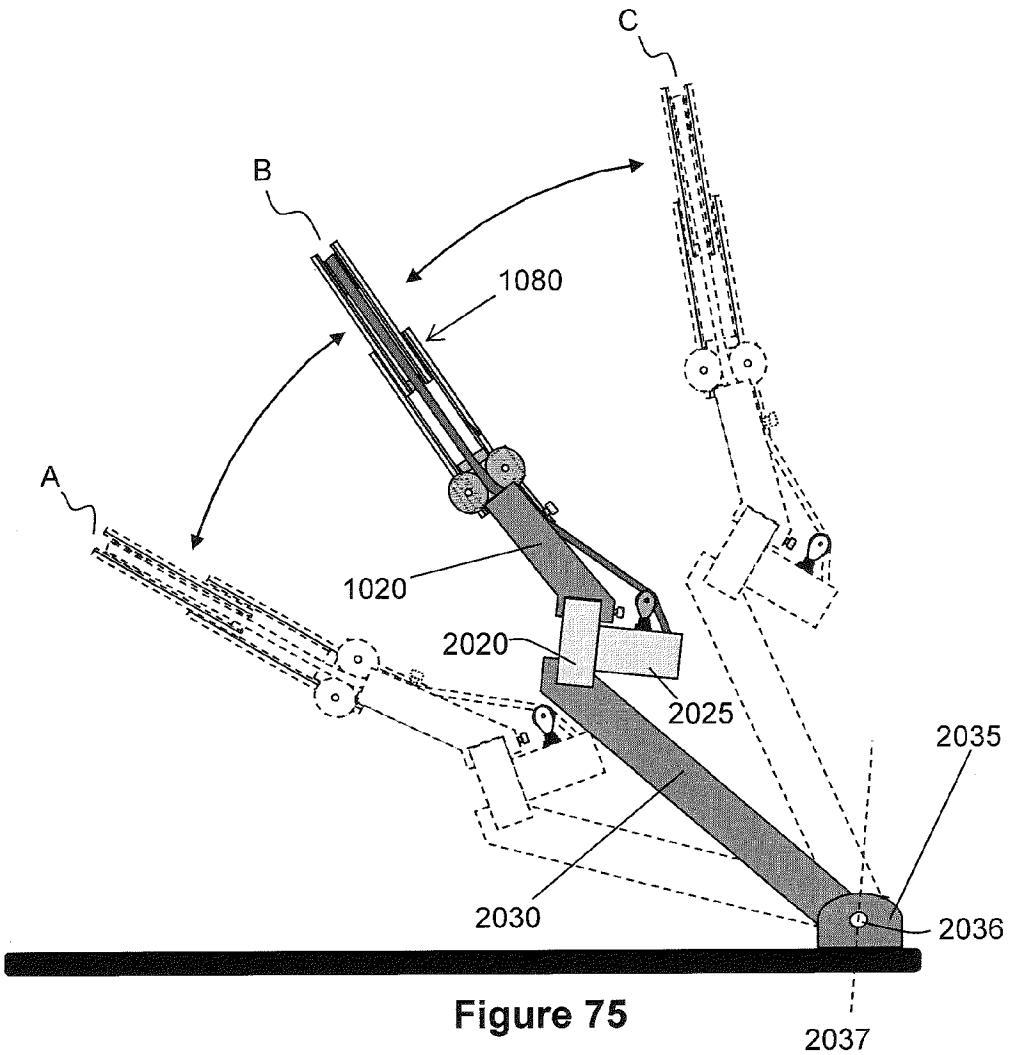
FIG. 75 is a side view of the embodiments of FIGS. 72-74 illustrating various angular positions of the apparatus.

FIG. 74 is a side view of the embodiment illustrated in FIGS. 72 and 73. With reference to FIG. 74, the rotational capabilities of the resistance training assemblies 1020, 1030 are shown with respect to the position of the trainee 1000. The trainee 1000 is shown in a standing position, slightly bent at the waist. Accordingly, the shoulder mast 1080 of the assembly 1020 rotates about the axis pin 1085 to follow the position of the torso of the trainee 1000. Thus, the magnitude of the training vectors provided by the elastic members E1, E2, E3, E4 may vary substantially linearly through a predetermined range of motion. FIG. 74 also illustrates an alternative embodiment of a shoulder mast 1080 and telescoping member 1086. In this embodiment, rather than having a track provided on the distal end of the telescoping member 1086 as illustrated in FIGS. 57*a*-57*c*, the shoulder mast may be provided with a pulley assembly 2000 allowing for the direction of an elastic member from the resistance module 2025 up the shoulder mast 1080, second elongated member 1084 and telescoping member 1086 which may then be redirected by a redirect pulley assembly 2010 contained in or external to the telescoping member 1086. As shown, the telescoping member 1086 and second elongated member 1084 are rotatable about axis AX1 which extends perpendicular to the page. Through the rotational and translational capabilities of this embodiment, the movement of elastic members E2, E4 may be shifted from a more horizontal plane to Plane B. The support element 2020 may provide support for the resistance module 2025 removably and fixedly attached thereto that contains a plurality of pulley assemblies or a single assembly providing resistance vectors of varying magnitude (e.g., one, two, three, four or more elastic members). The support element 2020 may be connected to a base member 2030 which is removably attached to the base. The angular position of the base member 2030 may be adjusted by means of a pin and/or locking mechanism, assembly 2035 or equivalent allowing the base member 2030 to rotate about an axis 2036 perpendicular to the page. FIG. 75 is a side view of the embodiments of FIGS. 72-74 illustrating various angular positions of the apparatus. With reference to FIG. 75, the base member 2030 is shown rotated to three different positions, A, B, C thereby altering the vector origin of elastic members E1, E2, E3, E4 provided by the apparatus. While three positions are illustrated, this should not limit the scope of the claims appended herewith as the base member 2030 may be rotated about the axis 2036 and locked in place to provide plural positions for the vector origin of elastic members E1, E2, E3, E4 provided by the apparatus. This combined with the translational/telescoping ability of the shoulder masts 1080 and training assemblies 1020, 1030 may thus provide hundreds of positions for the vector origin of elastic members E1, E2, E3, E4 provided by the apparatus to serve the needs of a trainee. While not shown, the pin and/or locking mechanism, assembly 2035 or equivalent may also be rotatable about an axis 2037 perpendicular to axis 2036 thereby allowing an additional rotational motion for the base member 2030 and the apparatus. Of course, rotation about this additional axis 2037 may also be fixed by a suitable locking mechanism or pin mechanism.

While the various configurations and embodiments of the physical training apparatus illustrated herein have been described with regard to elastic members, this should not limit the scope of the claims appended herewith as resistance may be generated electronically, pneumatically and/or electromechanically.

As shown by the various configurations and embodiments of the physical training apparatus illustrated in FIGS. 1-75, the physical training apparatus may be used for training athletes and physical therapy patients by providing training vectors to multiple muscle groups of the trainee from various angles and multiple elevations while providing varying or constant magnitudes. It can also be seen from the various figures illustrating many of the embodiments of the swing training apparatus according to the present disclosure that the swing training apparatus may be used in a variety of configurations and is particularly suitable for providing resistance to the rotation of the hips and shoulders as well as other body parts during sport specific movements, e.g., a golf, baseball, softball, tennis, cricket, squash, racquetball, badminton swing.

While preferred embodiments of the present disclosure have been described, it is to be understood that the embodiments described are illustrative only and that the scope of the disclosure is to be defined solely by the appended claims when accorded a full range of equivalence, many variations and modifications naturally occurring to those of skill in the art from a perusal hereof.

What is claimed is:

1. An apparatus for applying resistance to shoulder and hip rotation of a trainee, said apparatus comprising:

a pair of opposing modules positioned to define a training area on a training surface, one of said modules comprising:

a rigid member extending upward from the training surface;

a first pulley assembly and a second pulley assembly carried by said rigid member;

a first resistance member secured at one end and directed through said first pulley assembly to a first training vector origination device directing a free end of the first resistance member toward the training area, said first resistance member being adapted to provide a training vector opposing rotation of a backside shoulder of a trainee performing a golf or baseball swing;

a second resistance member secured at one end and directed through said second pulley assembly to a second training vector origination device directing a free end of the second resistance member toward the training area, said second resistance member being adapted to provide a training vector opposing rotation of a backside hip of a trainee performing a golf or baseball swing; and the other of said modules comprising:

a rigid member extending upward from the training surface;

a first pulley assembly and a second pulley assembly carried by said rigid member;

a first resistance member secured at one end and directed through said first pulley assembly to a first training vector origination device directing a free end of the first resistance member toward the training area, said first resistance member being adapted to provide a training vector opposing rotation of a frontside shoulder of a trainee performing a golf or baseball swing;

a second resistance member secured at one end and directed through said second pulley assembly to a second training vector origination device directing a free end of the second resistance member toward the training area, said second resistance member being adapted to provide a training vector opposing rotation of a frontside hip of a trainee performing a golf or baseball swing.

2. The apparatus of claim 1 wherein the combination of said first resistance members of each module provide a balanced torque to the upper body of a trainee without creating a force opposing or aiding a bending motion of the trainee.

3. The apparatus of claim 2 wherein the torque is provided in a clockwise direction.

4. The apparatus of claim 2 wherein the torque is provided in a counter-clockwise direction.

5. The apparatus of claim 1 wherein the position of each first training vector origination device is variable in three dimensions.

6. The apparatus of claim 5 wherein the position of each first training vector origination device varies in three dimensions during a swinging motion by a trainee.

7. The apparatus of claim 1 wherein the position of each second training vector origination device is variable in three dimensions.

8. The apparatus of claim 5 wherein the position of each second training vector origination device varies in three dimensions during a swinging motion by a trainee.

9. The apparatus of claim 1 wherein the position of each first training vector origination device and each second training vector origination device is variable in three dimensions.

10. The apparatus of claim 5 wherein the position of each first training vector origination device and each second training vector origination device varies in three dimensions during a swinging motion by a trainee.

* * * * *